US008663888B2

(12) United States Patent
Shitara et al.

(10) Patent No.: US 8,663,888 B2
(45) Date of Patent: Mar. 4, 2014

(54) TONER

(75) Inventors: Yasutada Shitara, Shizuoka (JP); Yohichiroh Watanabe, Shizuoka (JP); Yasuo Katano, Kanagawa (JP); Shinya Nakayama, Shizuoka (JP); Ryota Inoue, Osaka (JP); Yoshihiro Moriya, Shizuoka (JP); Akiyoshi Sabu, Kanagawa (JP); Shingo Sakashita, Shizuoka (JP); Yukiko Nakajima, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 175 days.

(21) Appl. No.: 12/973,206

(22) Filed: Dec. 20, 2010

(65) Prior Publication Data

US 2011/0151370 A1 Jun. 23, 2011

(30) Foreign Application Priority Data

Dec. 21, 2009 (JP) ..... 2009-289545

(51) Int. Cl.
*G03G 13/20* (2006.01)

(52) U.S. Cl.
USPC ..... 430/109.4; 430/105; 430/137.1; 430/124.21

(58) Field of Classification Search
USPC ..... 430/109.4, 108.1, 124.1, 124.21
See application file for complete search history.

(56) References Cited

U.S. PATENT DOCUMENTS 6,326,114 B1 * 12/2001 Itakura et al. ..... 430/108.3
7,655,374 B2 2/2010 Katano et al.
7,713,622 B2 5/2010 Katano et al.
7,713,673 B2 5/2010 Katano et al.
7,773,932 B2 8/2010 Katano et al.
7,794,835 B2 9/2010 Katano et al.
2005/0025540 A1 2/2005 Murai et al.
2007/0098469 A1 5/2007 Yoshino et al.
2007/0218386 A1 * 9/2007 Suzuki et al. ..... 430/108.4
2007/0218391 A1 9/2007 Yamada et al.
2007/0243483 A1 * 10/2007 Katano et al. ..... 430/124.21
2008/0063971 A1 3/2008 Watanabe et al.
2008/0069612 A1 3/2008 Nakamura et al.

(Continued)

FOREIGN PATENT DOCUMENTS

CN 101038453 A 9/2007
CN 101308340 A 11/2008

(Continued)

OTHER PUBLICATIONS

U.S. Appl. No. 12/779,432, filed May 13, 2010, Yuichi Aoyama, et al.

(Continued)

*Primary Examiner* — Mark F Huff
*Assistant Examiner* — Rashid Alam
(74) *Attorney, Agent, or Firm* — Oblon, Spivak, McClelland, Maier & Neustadt, L.L.P.

(57) ABSTRACT

The present invention provides a toner including: a colorant, and a binder resin, wherein the toner is fixed on a recording medium using a fixing liquid containing a softening agent for softening the toner, and wherein a weight average molecular weight of a THF soluble fraction of the toner in a molecular weight distribution measured by gel permeation chromatography (GPC) is 3,000 to 8,300; and a glass transition temperature of the toner measured by differential scanning calorimetry (DSC) is 50° C. to 70° C.

5 Claims, 18 Drawing Sheets

(56) References Cited

U.S. PATENT DOCUMENTS

| | | | | |
|---|---|---|---|---|
| 2008/0213002 | A1 | 9/2008 | Katano et al. | |
| 2008/0248416 | A1 | 10/2008 | Norikane et al. | |
| 2008/0286679 | A1 | 11/2008 | Norikane et al. | |
| 2008/0286680 | A1* | 11/2008 | Norikane et al. | 430/110.4 |
| 2008/0292985 | A1 | 11/2008 | Suzuki et al. | |
| 2009/0003903 | A1 | 1/2009 | Katano et al. | |
| 2009/0042118 | A1 | 2/2009 | Suzuki et al. | |
| 2009/0067904 | A1 | 3/2009 | Katano et al. | |
| 2009/0117486 | A1 | 5/2009 | Watanabe et al. | |
| 2009/0239170 | A1 | 9/2009 | Honda et al. | |
| 2009/0263584 | A1 | 10/2009 | Katano et al. | |
| 2009/0291380 | A1* | 11/2009 | Ayaki et al. | 430/108.1 |
| 2009/0317738 | A1 | 12/2009 | Honda et al. | |
| 2009/0325100 | A1 | 12/2009 | Watanabe et al. | |
| 2010/0003613 | A1 | 1/2010 | Honda et al. | |
| 2010/0021209 | A1 | 1/2010 | Watanabe et al. | |
| 2010/0055590 | A1 | 3/2010 | Honda et al. | |
| 2010/0227267 | A1 | 9/2010 | Shitara et al. | |
| 2010/0291481 | A1 | 11/2010 | Yamada et al. | |
| 2010/0297548 | A1 | 11/2010 | Honda et al. | |
| 2010/0310982 | A1 | 12/2010 | Ohtani et al. | |
| 2011/0013957 | A1 | 1/2011 | Katano et al. | |

FOREIGN PATENT DOCUMENTS

| | | |
|---|---|---|
| JP | 59-119364 | 7/1984 |
| JP | 3290513 | 3/2002 |
| JP | 2005-10368 | 1/2005 |
| JP | 2005-049530 | 2/2005 |
| JP | 2008-139504 | 6/2008 |
| JP | 4185742 | 9/2008 |
| JP | 2008-276037 | 11/2008 |
| JP | 2009-8967 | 1/2009 |
| JP | 2009-294492 | 12/2009 |
| JP | 2010-204395 | 9/2010 |
| WO | WO 2009/125824 A1 | 10/2009 |

OTHER PUBLICATIONS

U.S. Appl. No. 12/825,683, filed Jun. 29, 2010, Unknown.

U.S. Appl. No. 12/834,427, filed Jul. 12, 2010, Yoshihiro Norikane, et al.

Japanese Office Action issued Sep. 18, 2013, issued in corresponding Japanese patent application 2009-289545.

* cited by examiner

TONER

BACKGROUND OF THE INVENTION

1. Field of the Invention

The present invention relates to a toner, a method for producing a toner, a fixing method using the toner, an image forming method, and an image forming apparatus.

2. Description of the Related Art

Image forming apparatuses, such as printers, facsimiles and copiers, are apparatuses for forming images including characters and symbols on a recording medium such as paper, clothes and OHP sheets, based on image information. In particular, electrophotographic image forming apparatus enable forming high-definition images on regular paper at high speed, and thus they are widely used in offices. In such electrophotographic image forming apparatuses, the heat fixing method, in which a toner on a recording medium is heated to be melted and the melted toner is pressurized to thereby fix the toner on the recording medium, is widely used. The heat fixing method is preferably used because it can provide high fixing speed and high quality of fixed images and the like.

However, about half or more of the electric power in such an electrophotographic image forming apparatus is consumed by heating a toner in the heat fixing method. Meanwhile, from the viewpoint of environmental preservation in recent years, a fixing device of low (energy-saving) electric power consumption is desired. That is, a fixing method which enables extremely lowering the temperature of heating a toner for fixing the toner more than in the past or a fixing method which requires no heating a toner is desired. Particularly, a non-heating fixing method of fixing a toner on a recording medium without heating the toner at all is ideal in terms of low electric power consumption.

As such a non-heating fixing method, for example, Japanese Patent (JP-B) No. 3290513 proposes a wet-process fixing method in which an oil-in-water type fixing agent, in which an organic compound capable of dissolving or swelling a toner and being insoluble or sparsely soluble in water is dispersed in and mixed with water, is sprayed or dropped in the form of droplets on a surface of a fixing target material having an unfixed toner and provided at a predetermined position so as to make the toner dissolved or swollen, and then the fixing target material is dried.

However, in the wet-process fixing method of Japanese Patent (JP-B) No. 3290513, a fixing agent, in which the organic compound insoluble or sparsely soluble in water is dispersed in and mixed with water, is used, and thus when a large amount of the fixing agent is applied to a toner, a recording medium (fixing target material) such as transfer paper absorbs the moisture in the fixing agent, causing wrinkles and curling of the recording medium. Because of this shortcoming, stable and high-speed conveyance of a recording medium required for an image forming apparatus is considerably impaired. If an attempt is made to remove the moisture from the fixing agent that has been applied onto the recording medium by evaporating a large amount of water contained in the fixing agent, using a drier, it will require electric power equivalent to the electric power consumption of an image forming apparatus using a heat fixing method.

As a fixing agent which is nonrepellent to an unfixed toner having been subjected to water-repellent treatment, some fixing agents have been conventionally proposed, in which a material making a toner dissolved or swollen is dissolved in an oil-based solvent. As one of them, for example, Japanese Patent Application Laid-Open (JP-A) No. 2004-109749 proposes a fixing liquid in which a material which makes a resin component constituting a toner dissolved or swollen, such as aliphatic dibasic acid ester, is diluted with (dissolved in) dimethyl silicone as a nonvolatile diluent (solvent). In addition, as a fixing solution which can be used in a fixing method by which an unfixed image formed by an electrostatic method can be easily fixed on an image-receiving sheet with high definition, without disturbing the image, Japanese Patent Application Laid-Open (JP-A) No. 59-119364 proposes an unfixed toner image-fixing solution, in a miscible state, in which 8 volume parts to 120 volume parts of silicone oil is mixed in 100 volume parts of a solvent having compatibility with the silicone oil. Since such an oil-based fixing liquid contains an oil-based solvent having high affinity to an unfixed toner having been subjected to repellency treatment, it can make a toner dissolved or swollen without rejecting the unfixed toner having been subjected to repellency treatment and can make the toner fixed on a recording medium.

However, the methods disclosed in Japanese Patent (JP-B) No. 3290513, Japanese Patent Application Laid-Open (JP-A) Nos. 2004-109749, and 59-119364 have a problem that a toner is offset to a fixing agent-coating unit due to a surface tension of the fixing agent when a coated film is formed extremely thin, because the fixing liquid is applied onto the recording medium. In contrast, when the coated film is formed extremely thick, the fixing liquid in an excessive amount is applied onto a recording medium, and toner particles are flowed away by the flow of the fixing agent, resulting in degradation in image, the occurrence of curling of the recording medium and a paper jam in an image forming apparatus.

Then, as a fixing method capable of simultaneously solving the above-mentioned various problems, Japanese Patent Application Laid-Open (JP-A) No. 2009-8967 proposes to fix a foam-like fixing liquid and to control the foam-like fixing liquid to a desired value.

However, even with use of the proposal, it cannot be said that sufficient fixability is achieved, and there are increasing demands for further improvements in fixing a toner.

In the meanwhile, as a method of strongly improving the properties of toner to be fixed on a recording medium using a fixing liquid as described above, Japanese Patent Application Laid-Open (JP-A) No. 2008-139504 discloses a toner-fixing method using a toner having a $\Delta Tg$ (a variation in glass transition temperature) of 30° C. or higher in the DSC measurement when a softening agent is added in an amount of 3% by weight to the toner. With use of the fixing method disclosed in JP-A No. 2008-139504, it is possible to sufficiently soften the toner even when a small amount of a softening agent is used, because the compatibility between the toner and the softening agent is sufficient, and thus the fixing method is sufficient to speed up the fixing speed. That is, the fixing method enables high-speed fixing operation in the light of improving the compatibility of a toner and a softening agent.

However, higher fixing speed operation is desired, and to respond to the demands, there is a need to take an approach from other standpoints.

Further, in such a fixing method, in order to fix a toner on paper, it is necessary to sufficiently soften the toner as well as to rapidly soften the toner through penetration of a fixing liquid containing a softening agent, and when the softened state of a toner is insufficient or nonuniform, or when the softening speed is slow, there is a problem that a sufficient strength of the toner against paper cannot be obtained particularly in high-speed printing, easily causing peel-off in particular of halftone images.

The present invention aims to solve the above-mentioned conventional problems and to achieve the following object.

That is, an object of the present invention is to provide a toner which is capable of obtaining images having high strength immediately after being fixed with the toner regardless that the consumption energy is extremely small in a fixing step and having strong abrasion resistance (even in halftone images) and which is also excellent in heat-resistant storage stability; a fixing method, an image forming method and an image forming apparatus each using the toner.

The present invention also aims to provide a method for producing a toner by which the toner can be stably produced so as to have small particle diameters and a sharp particle size distribution.

BRIEF SUMMARY OF THE INVENTION

The present inventors carried out extensive studies and examinations to achieve the above-mentioned object and found to provide a toner having strong fixing strength against paper (recording media) even in high-speed printing, capable of preventing peel-off of halftone images and excellent in heat-resistant storage stability by appropriately designing a binder resin constituting the toner and making a fixing liquid containing a softening agent rapidly penetrated through the toner so as to sufficiently soften the toner.

Further, since the toner of the present invention has a narrow particle size distribution, when the fixing liquid is applied to the toner, the softening agent is uniformly penetrated through the toner. In other words, the degree of softness of individual toner particles is uniform, the fixed toner can further exhibit the resistance to peel-off in a halftone image where toner particles are singularly fixed. As a result of this, in an image forming method in which a toner is fixed on a recording medium using a fixing liquid containing a softening agent for dissolving or softening a resin in the toner, the present invention can provide a toner which is resistant to peel-off in particular of halftone images immediately after being fixed.

That is, to solve the above-mentioned problems, the toner, the method for producing a toner, the fixing method using the toner, the image forming method and the image forming apparatus according to the present invention each have technical characteristics described in the following <1> to <19>:

<1> A toner including:

a colorant, and a binder resin, wherein the toner is fixed on a recording medium using a fixing liquid containing a softening agent for softening the toner, and wherein a weight average molecular weight of a THF soluble fraction of the toner in a molecular weight distribution measured by gel permeation chromatography (GPC) is 3,000 to 8,300; and a glass transition temperature of the toner measured by differential scanning calorimetry (DSC) is 50° C. to 70° C.

<2> The toner according to <1> above, wherein the toner has a weight average particle diameter of 3.0 μm to 6.0 μm, and a ratio of the weight average particle diameter to a number average particle diameter of 1.15 or less.

<3> The toner according to <2> above, wherein the ratio of the weight average particle diameter to the number average particle diameter is 1.10 or less.

<4> The toner according to any one of <1> to <3> above, wherein the binder resin contains a polyester resin.

<5> A method for producing a toner, the method including:

a step (A): periodically forming and discharging liquid droplets of a toner composition liquid from a liquid chamber filled with the toner composition liquid by a thin film having a plurality of nozzles provided in the liquid chamber and a vibration generating unit having a vibration surface in parallel with the thin film, from the plurality of nozzles, and a step (B): solidifying the liquid droplets so as to produce a toner, wherein the toner composition liquid is prepared by dispersing or dissolving a toner composition containing a binder resin and a colorant, wherein the toner contains the binder resin and the colorant, and is fixed on a recording medium using a fixing liquid containing a softening agent for softening the toner, and wherein a weight average molecular weight of a THF soluble fraction of the toner in a molecular weight distribution measured by gel permeation chromatography (GPC) is 3,000 to 8,300; and a glass transition temperature of the toner measured by differential scanning calorimetry (DSC) is 50° C. to 70° C.

<6> The method according to <5> above, wherein the plurality of nozzles has a diameter of 4 μm to 20 μm, and the vibration generating unit has a vibration frequency of 20 kHz or more and less then 2.0 MHz.

<7> The method according to one of <5> and <6> above, wherein the number of the plurality of nozzles disposed in the liquid chamber is 10 to 5,000.

<8> The method according to any one of <5> to <7> above, wherein an air flow path is further provided outside the liquid chamber, and an air flow is formed in a direction in which the toner composition liquid is discharged from the plurality of nozzles, and wherein the air flow path is provided with an air flow restrictor which reduces the cross-sectional area of the air flow path through which air flow passes immediately after a position at which the toner composition liquid is discharged from the plurality of nozzles.

<9> The method according to any one of <5> to <8>, wherein the toner composition contains a solvent, and the step (B) is drying the liquid droplets in a solvent removal unit.

<10> The method according to <9>, wherein the step (B) is conveying the liquid droplets by a dry gas flowing, in the solvent removal unit, in the same direction as the discharged direction of the liquid droplets, so that the solvent is removed.

<11> The method according to any one of <5> to <10> above, wherein the toner has a weight average particle diameter of 3.0 μm to 6.0 μm, and a ratio of the weight average particle diameter to a number average particle diameter of 1.15 or less.

<12> The method according to any one of <5> to <11> above, wherein the binder resin contains a polyester resin.

<13> A fixing method including:

fixing a toner on a recording medium by applying a fixing liquid containing a softening agent for softening the toner onto a toner image on the recording medium, wherein the toner is the toner according to any one of <1> to <4> above.

<14> The fixing method according to <13>, further including:

foaming the fixing liquid to generate a foam-like fixing liquid, adjusting the thickness of the foam-like fixing agent on a contact surface of a foam-like fixing liquid applying unit into a predetermined value, and applying the foam-like fixing agent formed into the predetermined thickness onto the toner image on the recording medium, wherein the fixing liquid further contains a diluent containing water and a foaming agent for foaming the fixing liquid.

<15> The fixing method according to <14> above, wherein the softening agent is a solid plasticizer which is solid at normal temperature and soluble in the diluent, and makes at least a part of the toner softened and swollen, in a state of being dissolved in the diluent.

<16> The fixing method according to <15> above, wherein the solid plasticizer is polyethylene glycol.

<17> An image forming method including:

forming a latent electrostatic image on a latent electrostatic image bearing member, developing the latent electrostatic image using a developer containing a toner to form a toner image, transferring the toner image to a recording medium, and fixing the toner image on the recording medium, wherein the fixing is carried out by the fixing method according to any one of <13> to <16>.

<18> An image forming apparatus including:

a latent electrostatic image bearing member, a latent electrostatic image forming unit configured to form a latent electrostatic image on the latent electrostatic image bearing member, a developing unit including a developer bearing member which carries, on its surface, a developer to be supplied to the latent electrostatic image bearing member; a developer supplying member which supplies the developer to the surface of the developer bearing member; and a developer housing for accommodating the developer containing a toner and configured to develop the latent electrostatic image using the developer, a transferring unit configured to transfer the toner image onto a recording medium, and a fixing unit configured to fix the toner image transferred to the recording medium, wherein the fixing unit includes a fixing liquid applying unit configured to apply a fixing liquid onto the toner on the recording medium, and wherein the toner is the toner according to any one of <1> to <4> above.

<19> An image forming apparatus including:

a latent electrostatic image bearing member, a latent electrostatic image forming unit configured to form a latent electrostatic image on the latent electrostatic image bearing member, a developing unit including a developer bearing member which carries, on its surface, a developer to be supplied to the latent electrostatic image bearing member; a developer supplying member which supplies the developer to the surface of the developer bearing member; and a developer housing for accommodating the developer containing a toner and configured to develop the latent electrostatic image using the developer, a transferring unit configured to transfer the toner image onto a recording medium, and a fixing unit configured to fix the toner image transferred to the recording medium, wherein the fixing unit includes a foam-like fixing liquid-generating unit configured to foam a fixing liquid to generate a foam-like fixing liquid; a foam-like fixing liquid-applying unit configured to apply the foam-like fixing liquid onto the toner image on the recording medium; and a film thickness controlling unit configured to control the film thickness of the foam-like fixing liquid on the foam-like fixing liquid-applying unit, and wherein the toner is the toner according to any one of <1> to <4> above.

The present invention can solve the above-mentioned conventional problems and provide a toner which is capable of obtaining images having high strength immediately after being fixed with the toner regardless that the consumption energy is extremely small in a fixing step and having strong abrasion resistance (even in halftone images) and which is also excellent in heat-resistant storage stability; a fixing method, an image forming method and an image forming apparatus each using the toner.

Further, the present invention can provide a method for producing a toner by which the toner can be stably produced so as to have small particle diameters and a sharp particle size distribution.

DETAILED DESCRIPTION OF THE INVENTION (Toner)

Figure 1:
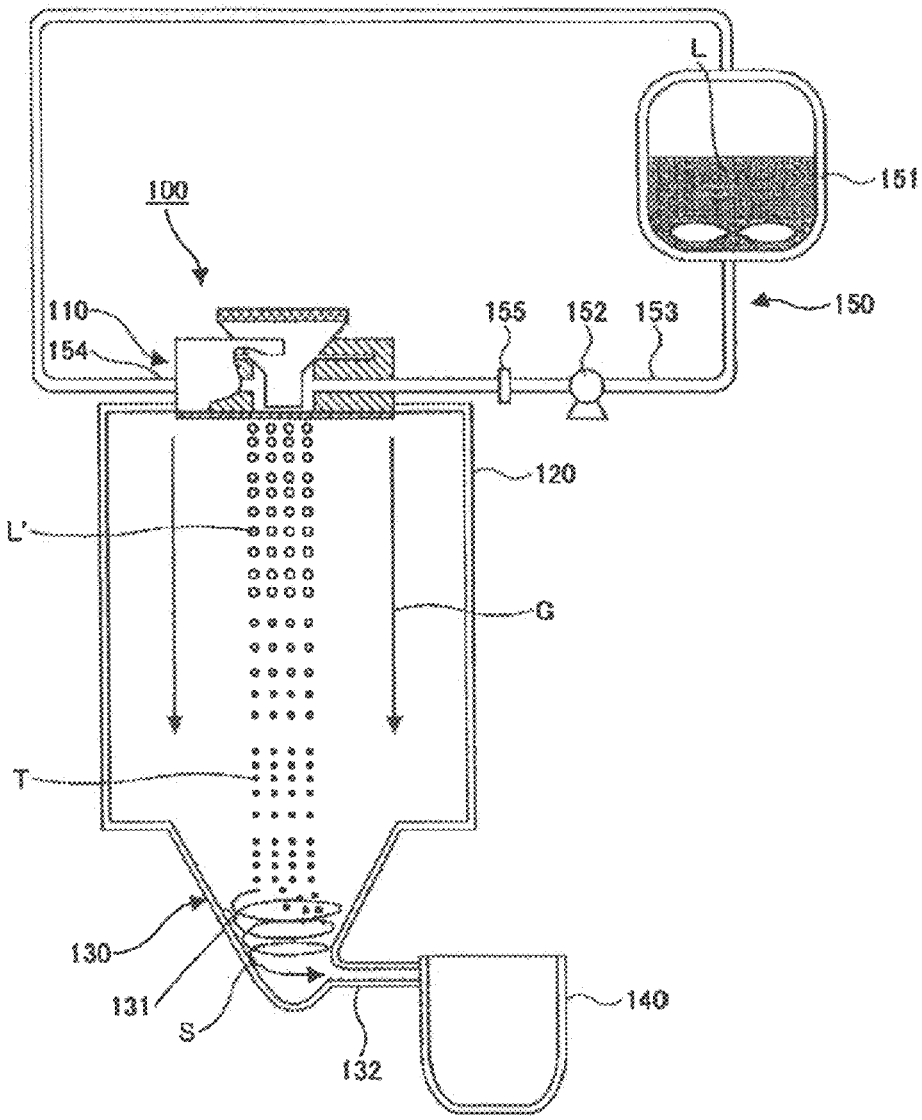
FIG. 1 is a schematic view illustrating one example of a toner production apparatus used in the present invention.

A toner according to the present invention contains a colorant, and a binder resin, wherein the toner is fixed on a recording medium using a fixing liquid containing a softening agent for softening the toner, and wherein a weight average molecular weight of a THF soluble fraction of the toner in a molecular weight distribution measured by gel permeation chromatography (GPC) is 3,000 to 8,300; and a glass transition temperature of the toner measured by differential scanning calorimetry (DSC) is 50° C. to 70° C.

Next, the toner of the present invention will be further described in detail.

Since embodiments described below are preferred embodiments of the present invention, they are provided with various preferred technical limitations, however, the scope of the present invention shall not be limited to the embodiments, unless otherwise specified in the following description.

—Effect of Molecular Weight Distribution—

A toner according to the present invention is fixed on a recording medium using a fixing liquid containing a softening agent for dissolving or swelling a resin contained in the toner. At this time, the toner is softened by penetration of the softening agent in the fixing liquid through the toner, subsequently, the softened toner is pressed against the recording medium by a pressure roller, and thereby the toner is fixed on the recording medium. The important things at this point are the penetration speed of the softening agent to the toner and the softened state of the toner. Particularly in high-speed printing, the time from when the fixing liquid is contacted with the toner to when the toner is pressurized by a pressure roller is extremely short, and thus it is indispensable to increase the penetration speed of the softening agent.

The present inventors carried out extensive studies and examinations and have found that as requirements relating to the toner, especially, the molecular weight of a binder resin constituting the toner greatly influences the above-mentioned properties. This can be considered because by designing the molecular weight of the binder resin in an appropriate range, molecular chains are prevented from being excessively entangled each other and the components of the softening agent are easily made to rapidly penetrate into a binder resin layer. It was also found that when the molecular weight of the binder resin is excessively lowered, it causes another problem that the heat resistant storage stability of the tone degrades.

In the present invention, to solve the problem, by designing the glass transition temperature of the resin within an appropriate range, in addition to the molecular weight of the binder resin, it is achieved to make the softening agent rapidly penetrate into the toner to sufficiently soften the toner while maintaining the heat resistant storage stability of the toner, to make the toner have high fixing strength to paper even in high-speed printing, and to prevent peel-off of halftone images.

In the present invention, the weight average molecular weight of the toner is 3,000 to 8,300. The weight average molecular weight is preferably 3,000 to 6,000, and still more preferably 3,000 to 5,000. When the weight average molecular weight of the toner is less than 3,000, unfavorably, the heat resistant storage stability of the toner considerably degrades. When it is more than 8,300, unfavorably, the penetration speed of the fixing liquid to the toner is slow and the toner is hardly softened by the softening agent. Note that the weight average molecular weight of the toner of the present invention means a weight average molecular weight of a THF soluble fraction of the toner in a molecular weight distribution measured by gel permeation chromatography (GPC).

As a method of measuring the weight average molecular weight of the toner, for example, it can be measured by GPC (gel permeation chromatography) under, for example, the following conditions.

Device: GPC-150C (manufactured by Waters Instruments, Inc.)

Column: KF801 to KF807 (manufactured by Showdex Co.)

Temperature: 40° C.

Solvent: THF (tetrahydrofuran)

Rate of flow: 1.0 mL/min

Sample: 0.1 mL of a sample having a concentration of 0.05% by weight to 0.6% by weight is injected.

Monodispersed polystyrene standard sample for preparation of an analytical curve: having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$ (produced by Toyo Soda Manufacturing Co., Ltd.)

For a molecular weight distribution of toner measured under the above-mentioned conditions, a weight average molecular weight of the toner can be calculated using the analytical curve prepared with the monodispersed polystyrene standard sample.

In the present invention, the glass transition temperature (Tg) of the toner is 50° C. to 70° C. It is more preferably 60° C. to 70° C.

When the glass transition temperature (Tg) of the toner is lower than 50° C., unfavorably, the heat resistant storage stability of the toner considerably degrades, and when it is higher than 70° C., the molecular weight of the binder resin is outside the range of the present invention, unfavorably, the penetration speed of the fixing liquid to the toner is slow and the toner is hardly softened by the softening agent.

As a method of measuring a glass transition temperature (Tg) of the toner, it can be measured using, for example, a DSC system (differential scanning calorimetry meter) ("DSC-60", produced by Shimadzu Corporation. Specifically, the toner is sufficiently pulverized by a mortar, about 5.0 mg of the pulverized toner is put in an aluminum-sample container, the sample container is loaded on a holder unit and then placed in an electric oven. Next, the toner sample is heated from 20° C. to 150° C. at an temperature increase rate of 10° C./min under a nitrogen atmosphere, and then the DSC curve is measured by DSC. Thereafter, the toner sample is cooled from 150° C. to 0° C. at a temperature decrease rate of 10° C./min and then heated again to 150° C. at a temperature increase rate of 10° C./min, and the DSC curve is measured. From the DSC curve measured after the second time temperature increase, an endothermic peak derived from the binder resin is analyzed using an analysis program in the DSC-60 system, and from a shoulder temperature of the endothermic peak on the low-temperature side, a glass transition temperature (Tg) of the binder resin can be determined. Similarly, the glass transition temperature (Tg) of the binder resin can be also measured.

In the toner of the present invention, the penetration time of the softening agent when a fixing liquid containing the softening agent in an amount of 30% by mass is applied to the binder resin is desirably 1.0 sec/1 μm or shorter. When the penetration time of the softening agent is longer than 1.0 sec/1 μm, the penetration speed of the softening agent becomes slow particularly in high-speed printing, the toner cannot be sufficiently softened to the inside in an extremely short time, and unfavorably, this may cause a problem that the fixed toner may be pealed off from the paper due to abrasion or the like.

—Measurement Method of Penetration Time of Softening Agent—

Electrode used: comb-shaped electrode Au 10 μm (having no insulation film) Model No. 012259, manufactured by BAS Co. Ltd.

Capillary: EM MEISTER MINICAPS 4 μL, manufactured by ASONE

The resin was dissolved to methylethylketone (solvent) at a rate of 70%, and foreign matters were removed therefrom using a 0.45 μm-filter to obtain a resin solution.

The resin solution was spin-coated on the comb-shaped electrode using a spin-coater (Model name: 1H-DX, manufactured by MIKASA Co., Ltd.) at 3,000 rpm for 20 seconds. To volatilize the solvent, the resin solution was heated at an atmosphere of 100° C. for 2 hours and then cooled to room temperature in a drying chamber to thereby obtain a thin film. The thickness of the thin film was measured at this point of time using a needle-type level difference meter (DECTAK3).

The thin film was contacted, near measurement portions, with a liquid using the capillary, and then the time interval from the liquid contact to when the electric current value run through the liquid and the comb-shaped electrode exceeded 10-8A was measured by a potentiostat manufactured by ALS Co. Ltd. (Model name: CHI-660C). The time interval at that time was measured with a voltage of 5V.

From the obtained thickness of the thin film and tine interval until the electric current run through the comb-shaped electrode, the time elapsed until the liquid was diffused in a thickness of 1 μm of the thin film to 1% was calculated as a penetration time, using the diffusion equation of Fick's second equation represented by the following equation. (As for the Fick's second equation, see Fick A. Uber diffusion. Ann. Phys (ik). 1855:94:59-86. (in the Tokyo University Library possession). As for the diffusion of a liquid into a solid, see "DIFFUSION IN SOLIDS SHEWMON P; translated by Kazuo Fueki; Hirokazu Kitazawa, published from Corona Co., in 1985/07/15).

$$\frac{\partial c}{\partial t} = D\frac{\partial^2 c}{\partial x^2}$$

In the above equation, D represents a coefficient of diffusion (diffusion coefficient) and the dimension is [L2T-1]; c represents a concentration and the dimension is [ML-3]; and t represents a time and the dimension is [T].

Next, a toner composition (toner material) constituting a toner according to the present invention will be described below. The toner according to present invention contains a binder resin and a colorant and further contains other components as required.

<Binder Resin>

The binder resin is not particularly limited and may be suitably selected from among known ones. Examples thereof include styrene (e.g., polystyrene, poly-p-styrene, and polyvinyltoluene) or copolymers of substitution products thereof; styrene-based copolymers (e.g., styrene-p-chlorostyrene copolymers, styrene-propylene copolymers, styrene-vinyltoluene copolymers, styrene-methylacrylate copolymers, styrene-ethylacrylate copolymers, styrene-methacrylic acid copolymers, styrene-methylmethacrylate copolymers, styrene-ethylmethacrylate copolymers, styrene-butylmethacrylate copolymers, styrene-α-chloromethyl acrylate copolymers, styrene-acrylonitrile copolymers, styrene-vinyl methyl ether copolymers, styrene-vinyl methylethylketone copolymers, styrene-butadiene copolymers, styrene-isopropyl copolymers, and styrene-maleic, acid ester copolymers); polymethyl methacrylate resins, polybutyl methacrylate resins, polyvinyl chloride resins, polyvinyl acetate resins, polyethylene resins, polyester resins, polyurethane resins, epoxy resins, polyvinyl butyral resins, polyacrylic acid resins, rosin resins, modified rosin resins, terpene resins, phenol resins, aliphatic or aromatic hydrocarbon resins, and aromatic petroleum resins. These may be used alone or in combination. Among these, from the viewpoint of the affinity to recording media, it is particularly preferable to use polyester resins.

As a monomer constituting the polyester resin, the following are exemplified.

Examples of divalent alcohol components include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, or diol obtained by polymerizing a cyclic ether such as ethylene oxide and propylene oxide, with bisphenol A.

Further, to make the polyester resin crosslinked, it is preferable to use a trihydric or higher polyhydric alcohol in combination.

Examples of the trihydric or higher polyhydric alcohol include sorbitol, 1,2,3,6-hexanetetrol, 1,4-sorbitan, pentaerythritol (e.g., dipentaerythritol, tripentaerythritol), 1,2,4-butanetriol, 1,2,5-pentatriol, glycerol, 2-methylpropanetriol, 2-methyl-1,2,4-butanetriol, trimethylolethane, trimethylolpropane, and 1,3,5-trihydroxybenzene.

Examples of an acid component forming a polyester-based polymer include benzene dicarboxylic acids such as phthalic acid, isophthalic acid, and terephthalic acid or anhydrides thereof; alkyl dicarboxylic acids such as succinic acid, adipic acid, sebacic acid, and azelaic acid or anhydrides thereof;

unsaturated dibasic acids such as maleic acid, citraconic acid, itaconic acid, alkenylsuccinic acid, fumaric acid, and mesaconic acid; and unsaturated dibasic acid anhydrides such as maleic anhydrides, citraconic anhydrides, itaconic anhydrides, and alkenylsuccinic anhydrides. Examples of trihydric or higher polyhydric carboxylic acid components include trimellitic acid, pyromellitic acid, 1,2,4-benzene tricarboxylic acid, 1,2,5-benzene tricarboxylic acid, 2,5,7-naphthalene tricarboxylic acid, 1,2,4-naphthalene tricarboxylic acid, 1,2,4-butane tricarboxylic acid, 1,2,5-hexane tricarboxylic acid, 1,3-dicarboxy-2-methyl-2-methylenecarboxy propane, tetra (methylenecarboxy)methane, 1,2,7,8-octane tetracarboxylic acid, Empol trimer acid, and their anhydrides and partial lower alkyl esters.

—Modified Polyester (Prepolymer) Reactive with an Active Hydrogen Group-Containing Compound—

The binder resin for use in the present invention may contain a modified polyester (which may be referred to as "polyester prepolymer") reactive with an active hydrogen group-containing compound. The active hydrogen group-containing compound acts as a chain extending agent, a crosslinking agent and the like used when the polyester reactive with the active hydrogen group-containing compound is subjected to an extension reaction, a crosslinking reaction etc. in the toner production process. By subjecting the polyester prepolymer to an extension reaction so as to have a high molecular weight, it is possible to improve the heat resistant storage stability of the toner and to efficiently reduce the stickiness of a fixed image. The polyester prepolymer used in this case is not particularly limited, as long as it is capable of reacting with an active hydrogen group-containing compound. Examples thereof include modified polyesters containing an isocyanate group, an epoxy group, a carboxylic acid, an acid chloride group or the like. Among these, a modified polyester containing an isocyanate group is particularly preferable.

The active hydrogen group-containing compound is not particularly limited, as long as it contains an active hydrogen group, and may be suitably selected in accordance with the intended use. For example, when the modified polyester reactive with the active hydrogen group-containing compound is an isocyanate group-containing-modified polyester, amines are suitable in terms that the polyester prepolymer can have a high molecular weight through a reaction such as extension reaction and crosslinking reaction.

The amines are not particularly limited and may be suitably selected in accordance with the intended use. Examples thereof include phenylene diamine, diethyl toluene diamine, 4,4'-diaminodiphenylmethane, 4,4'-diamino-3,3'dimethyldicyclohexylmethane, diaminecyclohexane, isophorone diamine, ethylene diamine, tetramethylene diamine, hexamethylene diamine, diethylene triamine, triethylene tetramine, ethanolamine, hydroxyethylaniline, aminoethyl mercaptan, aminopropyl mercaptan, aminopropionic acid, and aminocaproic acid. In addition, ketimine compounds, oxazolidine compounds in which these amino groups are blocked with ketones (e.g., acetone, methylethylketone, and methyl isobutyl ketone) are exemplified.

<Colorant>

The colorant is not particularly limited and may be suitably selected from among known dyes and pigments in accordance with the intended use. Examples there of include but not limited to, carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, para-chloro-ortho-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, and lithopone. These may be used alone or in combination.

The amount of the colorant contained in the toner is preferably 1% by mass to 15% by mass, and more preferably 3% by mass to 10% by mass.

The colorant may also be used as a masterbatch obtained by combining with a resin. The resin is not particularly limited and may be suitably selected from among known resins in accordance with the intended use. Examples of the resin include styrene or polymers of substitution products thereof, styrene-based polymers, polymethyl methacrylate resins, polybutyl methacrylate resins, polyvinyl chloride resins, polyvinyl acetate resins, polyethylene resins, polypropylene resins, polyester resins, epoxy resins, epoxy polyol resins, polyurethane resins, polyamide resins, polyvinyl butyral resins, polyacrylic acid resins, rosin, modified rosin, terpene resins, aliphatic hydrocarbon resins, alicyclic hydrocarbon resins, aromatic petroleum resins, paraffin chloride, and paraffin. These may be used alone or in combination.

<Other Components>

As described above, the toner according to the present invention may contain other components. The other components are not particularly limited and may be suitably selected in accordance with the intended use. Examples thereof include charge controlling agents, inorganic fine particles, flowability improving agents, and magnetic materials.

<<Charge Controlling Agent>>

The charge controlling agent is not particularly limited and positive or negative charge controlling agents can be suitably selected for use depending on the positive or negative polarity of a charge applied to the after-mentioned latent electrostatic image bearing member (photoconductor).

—Negative Charge Controlling Agent—

As the negative charge controlling agent, for example, a resin or a compound having an electron-donating functional group, azo dyes, metal complexes of organic acids can be used.

Specific examples of the negative charge controlling agent include BONTRON (product No.: S-31, S-32, S-34, S-36, S-37, S-39, S-40, S-44, E-81, E-82, E-84, E-86, E-88, A, 1-A, 2-A, and 3-A) (all produced by ORIENT CHEMICAL), KAYACHARGE (product No.: NJ, and N-2), KAYASET BLACK (product No.: T-2, 004) (all produced by Nippon Kayaku Co., Ltd.); AIZEN SPILON BLACK (T-37, T-77, T-95, TRH, and TNS-2) (all produced by HODOGAYA CHEMICAL Co., Ltd.); and FCA-1001-N, FCA-1001-NB, and FCA-1001-NZ, (all produced by Fujikura Kasei Co., Ltd.). These may be used alone or in combination.

—Positive Charge Controlling Agent—

As the positive charge controlling agent, for example, basic compounds such as nigrosine dyes; cationic compounds such as quaternary ammonium salts; and metal salts of higher fatty acids can be used.

Specific examples of the positive charge controlling agent include BONTRON (product No. N-01, N-02, N-03, N-04, N-05, N-07, N-09, N-10, N-11, N-13, P-51, P-52, and AFP-B) (all produced by ORIENT CHEMICAL); TP-302, TP-415, and TP-4040 (all produced by Nippon Kayaku Co., Ltd.); COPY BLUE PR, and COPY CHARGE (product No.: PX-VP-435, and NX-VP-434) (all produced by Hoechst AG); FCA (product No.: 201, 201-B-1, 201-B-2, 201-B-3, 201-PB, 201-PZ, and 301) (all produced by Fujikura Kasei Co., Ltd.); and PLZ (product No.: 1001, 2001, 6001, and 7001) (all produced by Shikoku Kasei K.K.). These may be used alone or in combination.

The amount of the charge controlling agent is not particularly limited and may be suitably selected depending on the kind of the binder resin, and the toner production method including a dispersion method. It is, however, preferably 0.1 parts by mass to 10 parts by mass, more preferably 0.2 parts by mass to 5 parts by mass per 100 parts by mass of the binder resin. When the addition amount of the charge controlling agent is more than 10 parts by mass, the effect of the charge controlling agent is diminished due to excessively high chargeability of the toner, and the electrostatic attraction force of the toner to a developing roller used increases, which may cause a degradation in flowability of the developer and a degradation in image density. When the addition amount is less than 0.1% by mass, the charge rising capability and the chargeability of the toner may be insufficient, which may adversely affect toner images.

<<Inorganic Fine Particles>>

As the inorganic fine particles, for example, silica, titanium, alumina, cerium oxide, strontium titanate, calcium carbonate, magnesium carbonate, and calcium phosphate can be used. It is more preferable to use silica fine particles having been hydrophobized with silicone oil, hexamethyldisilazane or the like, or a titanium oxide having been subjected to a specific surface treatment.

Specific examples of usable silica fine particles include AEROSIL (product No.: 130, 200V, 200CF, 300, 300CF, 380, OX50, TT600, MOX80, MOX170, COK84, RX200, RY200, R972, R974, R976, R805, R811, R812, T805, R202, VT222, RX170, RXC, RA200, RA200H, RA200HS, RM50, RY200, REA200) (all produced by Nippon Aerosil Co., Ltd.); HDK (product No.: H20, H2000, H3004, H2000/4, H2050EP, H2015EP, H3050EP, KHD50), and HVK2150 (all produced by Wacker Chemical Co.); and CABOSIL (product No.: L-90, LM-130, LM-150, M-5, PTG, MS-55, H-5, HS-5, EH-5, LM-150D, M-7D, MS-75D, TS-720, TS-610, and TS-530) (all produced by Cabot Co.). These may be used alone or in combination.

The addition amount of the inorganic fine particles is preferably 0.1 parts by mass to 5.0 parts by mass, and more preferably 0.8 parts by mass to 3.2 parts by mass per 100 parts by mass of toner base particles.

<<Magnetic Material>>

Examples of the magnetic material usable in the present invention include (1) magnetic iron oxides (e.g., magnetite, maghemite, and ferrite), and iron oxides containing other metal oxides, (2) metals (e.g., iron, cobalt, and nickel), or metal alloys of these metals with other metals (e.g., aluminum, cobalt, copper, lead, magnesium, tin, zinc, antimony, beryllium, bismuth, cadmium, calcium, manganese, selenium, titanium, tungsten, and vanadium); and (3) mixtures thereof.

Specific examples of the magnetic material include $Fe_3O_4$, $\gamma$-$Fe_2O_3$, $ZnFe_2O_4$, $Y_3Fe_5O_{12}$, $CdFe_2O_4$, $Gd_3Fe_5O_{12}$, $CuFe2O_4$, $PbFe_{12}O$, $NiFe_2O_4$, $NdFe_2O$, $BaFe_{12}O_{19}$, $MgFe_2O_4$, $MnFe_2O_4$, $LaFeO_3$, iron powder, cobalt powder, and nickel powder. These may be used alone or in combination. Among these, fine powders of iron oxide black, and $\gamma$-iron sesquioxide are exemplified as suitable ones.

In addition, as the magnetic material, magnetic iron oxides such as magnetite, maghemite, and ferrite containing heterogeneous elements, or mixtures thereof can also be used. Examples of the heterogeneous elements include lithium, beryllium, boron, magnesium, aluminum, silicon, phosphorous, germanium, zirconium, tin, sulfur, calcium, scandium, titanium, vanadium, chromium, manganese, cobalt, nickel, copper, zinc, and gallium. Preferred heterogeneous elements are selected from magnesium, aluminum, silicon, phosphorous and zirconium. The heterogeneous elements may be incorporated into crystal lattices of the iron oxide or may exist as an oxide or a hydroxide on a surface of the iron oxide. However, they are preferably incorporated as an oxide into crystal lattices of the iron oxide.

The heterogeneous element can be incorporated into particles of the iron oxide by mixing a salt of any of these heterogeneous elements in the iron oxide in the production of a magnetic material and adjusting the pH. Alternatively, after the production of magnetic material particles, a salt of any of these heterogeneous elements is added to the iron oxide, the pH is adjusted, and thereby the heterogeneous element can be precipitated on the surface of particles.

The amount of the magnetic material used is preferably 10 parts by mass to 200 parts by mass, and more preferably 20 parts by mass to 150 parts by mass per 100 parts by mass of the binder resin. The number average particle diameter of the magnetic material is preferably 0.1 μm to 2 μm, and more preferably 0.1 μm to 0.5 μm, The number average particle diameter can be determined by measurement of an enlarged photographic image taken by a transmission electron microscope, using a digitizer.

As for magnetic properties of the magnetic material, preferred is a magnetic material having magnetic properties, a coercivity of 20 oersteds to 150 oersteds, a saturation magnetization of 50 emu/g to 200 emu/g, and a remanent magnetization of 2 emu/g to 20 emu/g under application of 10 kilo-oersteds.

The magnetic material can also be used as a colorant.

—Effect of Particle Size Distribution—

A toner generally has a particle size distribution. In an image forming method used for the toner of the present invention, the toner is fixed using a fixing liquid containing a softening agent for dissolving or swelling a binder resin contained in the toner. At this time, the toner is impregnated with the softening agent in the fixing liquid, and thereby softening of the toner is achieved. Subsequently, the toner is pressed against a recording medium by a pressure roller, and thereby fixing of the toner on the recording medium is achieved. It was found that when the toner has a wide particle size distribution, the fixing quality becomes unstable. More specifically, it was found that the toner has low-image abrasion resistance, particularly on halftone images, and when the toner has a narrow particle size distribution, the toner has high abrasion resistance.

The mechanism is not clear, but it is presumed that when a toner is softened by making it contact with a fixing liquid, it takes time for a toner having large particle diameters to penetrate through the toner and thus the softening speed is slow, and in contrast, when the toner has small particle diameters, the softened state of the toner particles varies depending on the difference in particle diameter because of the rapid softening speed. In halftone images, since a toner exists in the form of particles on a recording medium, when a toner having nonuniform particle diameters is fixed on a recording medium, the softening speed of toner particles varies depending on the particle size. It can be considered that immediately after a fixing process, the adhesion strength of toner particles having large particle diameters to a recording medium is insufficient and the toner particles are selectively peeled off from the recording medium. This can be considered because the penetration depth of the fixing liquid through toner particles is limited to some extent, and relatively, only surface layer portions of the toner particles are softened. In other words, it can be considered that with use of a toner having large particle diameters, the softening agent does not sufficiently penetrate through the toner, the toner cannot be deformed at a fixing nip portion, and when the toner is rubbed against a fixed halftone image, the toner is liable to suffer stress because of the small deformation and the small area contacting with the recording medium. It can be considered that, in contrast to be above, with use of a toner having small particle diameters, the softening agent penetrates through the toner, the toner is sufficiently deformed and crushed, the contact area with the recording medium is sufficiently large, and thus the toner has resistance to abrasion stress on a fixed halftone image.

As described above, the toner of the present invention preferably has a narrow particle size distribution and small particle diameters. By doing so, in the case where a fixing liquid is applied to the toner, the softening agent uniformly penetrates into the toner, and thus the toner can maintain a sufficient strength not only a solid image but also on a halftone image, immediately after being fixed.

Therefore, the toner of the present invention has smaller particle diameters and a narrower particle size distribution than typical toners. The average particle diameter of the toner is preferably from 3.0 μm to 6.0 μm, and from the viewpoint of the softening response speed, more preferably from 3.0 μm to 5.5 μm. When the average particle diameter is smaller than 3.0 μm, unfavorably, the cleaning of untransferred toner provided in the developing step and transferring step in an electrophotographic process cannot be sufficiently achieved. When the average particle diameter is greater than 6.0 μm, it is difficult to obtain the strength of a halftone image immediately after being fixed because the response speed of plasticization brought by penetration of the softening agent into the toner surface slows down.

The particle size distribution can be represented by a ratio (Dv/Dn) of a weight average particle diameter (Dv) to a number average particle diameter (Dn). The smallest value of Dv/Dn is 1.0, and this means that all the particle diameters have the same particle diameter. The greater the ratio Dv/Dn, the wider the particle size distribution is. Typical pulverized toners have a Dv/Dn ratio of about 1.15 to about 1.25. In addition, polymerized toners have a Dv/Dn ratio of about 1.10 to about 1.15. The toner of the present invention is designed to have a Dv/Dn ratio of 1.15 or less. With this, the effect of improving the print quality was verified. More preferably, the Dv/Dn ratio of the toner is 1.10 or less.

The average particle diameter of the toner can be determined according to the following procedure.

—Particle Size Distribution—

The weight average particle diameter (Dv) and the number average particle diameter (Dn) of the toner of the present invention were measured by a particle size measuring device ("MULTISIZER III", manufactured by Beckman Coulter Electronics Inc.) with an aperture diameter of 100 μm and analyzed by analysis software (BECKMAN COULTER MUTLISIZER 3 Version 3.51). More specifically, in a 100 mL glass beaker, a 10 wt % surfactant (alkylbenzene sulfonate, NEOGEN SC-A; produced by DAI-ICHI KOGYO SEIYAKU CO., LTD.) (0.5 mL) was added, each toner (0.5 g) was further added, stirred with a micro-spatula, and then ion exchanged water (80 mL) was added thereto to obtain a dispersion liquid. The thus obtained dispersion liquid was placed in an ultrasonic wave dispersing device (W-113MK-II, manufactured by Honda Electronics Co., Ltd.) and subjected to dispersion treatment for 10 minutes. The dispersion liquid was measured using the MULTISIZER III, and ISOTON-III (from Beckman Coulter Electronics Inc.) as a measurement solution. The toner sample dispersion liquid was added dropwise into the device so that the concentration indicated by the device was 8%±2%.

In this measurement method, from the perspective of measurement reproductivity of particle diameters, it is important to maintain the concentration of the dispersion liquid with the range of 8%±2%. Within this range, no error in measurement of particle diameter arises. In the measurement, the following 13 channels were used to measure particles having diameters of 2.00 μm or greater and smaller than 40.30 μm: a channel having a diameter of 2.00 μm or larger and smaller than 2.52 μm, a channel having a diameter of 2.52 μm or larger and smaller than 3.17 μm; a channel having a diameter of 3.17 μm or larger and smaller than 4.00 μm; a channel having a diameter of 4.00 μm or larger and smaller than 5.04 μm; a channel having a diameter of 5.04 μm or larger and smaller than 6.35 μm; a channel having a diameter of 6.35 μm or larger and smaller than 8.00 μm; a channel having a diameter of 8.00 μm or larger and smaller than 10.08 μm; a channel having a diameter of 10.08 μm or larger and smaller than 12.70 μm; a channel having a diameter of 12.70 μm or larger and smaller than 16.00 μm; a channel having a diameter of 16.00 μm or larger and smaller than 20.20 μm; a channel having a diameter of 20.20 μm or larger and smaller than 25.40 μm; a channel having a diameter of 25.40 μm or larger and smaller than 32.00 μm; and a channel having a diameter of 32.00 μm or larger and smaller than 40.30 μm. After the volume and the number of toner particles or toner are measured, a volumetric distribution and a number distribution are calculated. From the obtained distributions, the weight average particle diameter (Dv) and the number average particle diameter (Dn) of the toner can be determined. As an indicator of the particle size distribution, a ratio Dv/Dn obtained by divining a weight average particle diameter (Dv) of the toner by a number average particle diameter (Dn) is used. If the toner sample dispersion liquid is completely monodispersed, the ratio Dv/Dn is 1, and the greater the value of the ratio Dv/Dn means a wider distribution the toner has.

<Toner Production Method>

Concerning the toner production method, a toner may be obtained by any methods, as long as the intended particle size distribution can be obtained. Generally, there are the following toner production methods, however, to precisely control the particle size distribution, an emulsification polymerization method, a suspension polymerization method, a method of emulsifying or dispersing a specific binder resin in an aqueous medium, and a jet granulation method are desirable.

<<Pulverization Method>>

The pulverization method is a method of obtaining base particles of the toner, in which toner materials are dissolved or kneaded, and the obtained product is subjected to pulverization, classification and other treatments. Note that in the case of the pulverization method, for the purpose of obtaining a higher average circularity of the toner, a mechanical impact may be applied to the obtained base particles of toner to control the shape. In this case, the mechanical impact can be applied to the base particles of toner using a device, such as a hybridizer and a mechanofusion.

The toner materials described above are mixed, and the mixture is charged into a melt-kneader to be melt-kneaded. As the melt-kneader, for example, a uniaxial-consecutive kneader, a biaxial-consecutive kneader, and a batch-type kneader using a roll mill can be used. Specific preferred melt-kneader include a KTK type biaxial extruder manufactured by KOBE STEEL., LTD., a TEM type biaxial extruder manufactured by TOSHIBA MACHINE CO., LTD., a PCM type biaxial extruder manufactured by IKEGAI, LTD., and a co-kneader manufactured by BUSS. It is important to conduct melt-kneading under appropriate conditions so that the molecular chain of the binder resin is not cleaved. Specifically, melt-kneading is preferably conducted at a temperature with reference to the softening point of the binder resin. If the melt-kneading temperature is excessively higher than the softening point, the molecular chain of the binder resin is severely cleaved, and if it is excessively lower than the softening point, dispersion process may not proceed.

In the pulverization, a kneaded product obtained in the kneading process is pulverized. In the pulverization, first, the kneaded product is preferably coarsely crushed, and the finely pulverized. At this time, the kneaded toner materials are preferably pulverized by hitting the kneaded toner materials against a collision board in a jet air stream, by making coarse particles collide with each other in a jet stream, or by passing through a narrow gap between a rotor which mechanically revolves and a stator.

In the classification, the pulverized product obtained in the pulverization process is classified to prepare toner particles having a predetermined particle diameter. The particles can be classified by removing fine particle fractions by, for example, a cyclone, a decanter, a centrifugal separator, etc.

After completion of the pulverization and classification, the pulverized product is classified in an air stream by a centrifugal force, so that a toner having a predetermined particle diameter is produced.

<<Suspension Polymerization Method>>

In the suspension polymerization method, a colorant and other toner materials are dispersed in an oil-soluble polymerization initiator, a polymerization monomer and then emulsified and dispersed in an aqueous medium containing a surfactant and other materials such as a solid dispersant by the after-mentioned emulsification method. Subsequently, the emulsified liquid is subjected to a polymerization reaction to form particles, followed by drying, and thereby a toner (toner base particles) can be obtained.

<<Emulsification Polymerization Method>>

In the emulsification polymerization method, a water-soluble polymerization initiator and a polymerizable monomer are emulsified in water using a surfactant, and then a latex is synthesized by a common emulsification polymerization method. Separately, a dispersion in which a colorant and other materials are dispersed in an aqueous medium is prepared, and then mixed with the latex. The mixture is made agglomerated to a toner size, followed by heat-fusing, and thereby a toner (toner base particles) is obtained.

<<Method of Emulsifying or Dispersing a Specific Binder Resin in an Aqueous Medium>>

In the method of emulsifying or dispersing a specific binder resin in an aqueous medium, a solution liquid or dispersion liquid of toner materials is emulsified or dispersed in an aqueous medium to prepare an emulsion or a dispersion liquid, and then toner (toner particles) is subjected to a granulation treatment (aqueous granulation. This method includes the following steps [1] to [4].

Step [1]: Preparation of Solution or Dispersion Liquid of Toner Materials

The solution or dispersion liquid of toner materials is prepared by dissolving or dispersing toner materials such as a colorant and a binder resin in an organic solvent. Note that the organic solvent is removed during or after granulation of toner.

Step [2]: Preparation of Aqueous Medium

The aqueous medium is not particularly limited and may be suitably selected from among known aqueous media. Examples thereof include water, alcohol miscible with water; solvents such as dimethyl formaldehyde, tetrahydrofuran, Cellosolves, and lower ketones; and mixtures thereof. Among these, water is particularly preferable.

The aqueous medium can be prepared, for example, by dispersing a dispersion stabilizer, like resin fine particles (resin fine particles as an additive) in the aqueous medium. The addition amount of the resin fine particles in the aqueous medium is not particularly limited and may be suitably selected in accordance with the intended use. For example, it is preferably 0.5% by mass to 10% by mass.

The resin fine particles to be added in the aqueous medium is not particularly limited, as long as it is a resin capable of forming an aqueous dispersion liquid in the aqueous medium, and may be suitably selected from among known resins. The resin fine particles may be a thermoplastic resin or may be a thermosetting resin. Examples thereof include vinyl resins, polyurethane resins, epoxy resins, polyester resins, polyamide resins, polyimide resins, silicon resins, phenol resins, melamine resins, urea resins, aniline resins, ionomer resins, and polycarbonate resins.

These may be used alone or in combination. Among these, the resin fine particles are preferably formed of at least one selected from vinyl resins, polyurethane resins, epoxy resins and polyester resins, in terms that an aqueous dispersion liquid of fine and spherical-shaped resin particles is easily obtained.

In the aqueous medium, it is preferable to use a dispersant as required, from the viewpoint of, in the after-mentioned emulsification or dispersion process, stabilizing oil droplets of the solution or dispersion liquid and obtaining a sharp particle size distribution with a desired particle shape. The dispersant is not particularly limited and may be suitably selected in accordance with the intended use. Examples thereof include a surfactant, a water-sparsely inorganic compound-based dispersant, and a polymer protective colloid. These may be used alone or in combination. Among these, the surfactant is preferable.

Step [3]; Emulsification or Dispersion

When the solution or dispersion liquid containing toner materials is emulsified or dispersed in the aqueous medium, the solution or dispersion liquid containing toner materials is preferably dispersed while being stirred in the aqueous medium. The dispersion method is not particularly limited, however, it is preferable to use, for example, batch-type emulsifiers (e.g., homogenizer (manufactured by IKA Co., Ltd.), POLYTRON (manufactured by KINEMATICA), and TK auto homomixer (manufactured by Tokush Kikai Kogyo Co. Ltd.)); consecutive emulsifiers (e.g., EBARA MILDER (manufactured by Ebara Corp.), TK FILL MIX, TK PIPELINE HOMOMIXER (manufactured by Tokush Kikai Kogyo Co. Ltd.), COLLOID MILL (manufactured by Shinko Pantec Co., Ltd.), SLUSHER, and TRIGONAL wet pulverizer (each manufactured by Mitsui Miike Kakoki Co., Ltd.), Cavitron (manufactured by Eurotec Co.), and FINE FLOW MILL (manufactured by Taiheiyo Kiko Co.)); high-pressure emulsifiers (e.g., MICRO FLUIDIZER (manufactured by Mizuho Kogyo Co., Ltd.), NANOMIZER (manufactured by Nanomizer Co.), and APV GAURIN (manufactured by Gaurin Corp.); film emulsifier (manufactured by Reika Kogyo K.K.); vibration type emulsifiers (e.g., VIBRO MIXER (manufactured by Reika Kogyo K.K.); and a ultrasonic wave homogenizer (manufactured by BRANSON). Among these machines, from the viewpoint of the uniformity of particle size, it is preferable to use APV GAURIN, homogenizer, TK auto-homomixer, EBARA MILDER, TK FILL MIX, or TK PIPELINE HOMOMIXER.

In the case where as the binder resin contained in the solution or dispersion liquid, the solution or dispersion liquid contains a modified polyester (prepolymer) reactive with an active hydrogen group-containing compound, the reaction proceeds during emulsification or dispersion process. The reaction conditions are not particularly limited, and may be suitably selected depending on a combination of a polymer reactive with the active hydrogen group-containing compound and the active hydrogen group-containing compound. The reaction time is preferably 10 minutes to 40 hours, and more preferably 2 hours to 24 hours.

Step [4]: Removal of Solvent

Next, from an emulsion slurry obtained in the emulsification or dispersion process, the organic solvent is removed.

As the method of removing an organic solvent, there may be exemplified: (1) a method in which the entire reaction system is slowly increased in temperature to completely evaporate an organic solvent in oil droplets, (2) a method in which an emulsified dispersion is sprayed in a dry atmosphere, an water-insoluble organic solvent in oil droplets is completely removed to form toner fine particles, and simultaneously, an aqueous dispersant is evaporation removed.

—Jet Granulation Method—

The get granulation method is a toner production method in which using a droplet forming unit having a liquid chamber filled with a toner composition containing at least a binder resin and a colorant is dispersed or dissolved, and is composed of a vibration generating unit having a thin film provided in the liquid chamber and provided with a plurality of nozzles on its surface and having a vibration surface disposed in parallel with the thin film, periodically discharging the toner composition from the plurality of nozzles; and solidifying the discharged liquid droplets so as to form particles. The get granulation method is suitably used as a method of producing a toner of the present invention.

In other words, the jet granulation method is method of producing a toner, which includes a step (A): periodically forming and discharging liquid droplets of a toner composition from a plurality of nozzles from a liquid chamber filled with the toner composition liquid by a thin film having a plurality of nozzles provided in the liquid chamber and a vibration generating unit having a vibration surface in parallel with the thin film; and a step (B): solidifying the liquid droplets so as to produce a toner.

In toners used in conventional heat pressure fixing method, releasing agents have been used as a toner material for the purpose of preventing hot offset in a fixing process. The releasing agents are a material (e.g., low molecular weight polyolefin, waxes) having an effect of preventing adhesion between a roller and a toner which is dissolved when fixing is performed with a heat roller.

However, the releasing agents are hardly uniformly dispersed in binder resin contained in a toner. When a releasing agent is present in a large amount on the surface of toner, it may cause problems such as degradation of blocking resistance, toner filming on a latent electrostatic image bearing member (also called a photoconductor), carrier or the like, toner spent, and smear on members with time.

Meanwhile, a toner for use in a method in which a fixing liquid containing a softening agent for softening toner is used to fix the toner on a recording medium is used in a non-heating fixing method, and thus the toner has no need to include a material having an effect of preventing adhesion between a roller and a toner which is dissolved when fixing is performed with a heat roller.

When a toner containing a releasing agent as a toner material is produced by a jet granulation method, the ejection nozzle clogs, liquid droplets cannot be stably discharged, and thus it is difficult to obtain a toner having small particle diameters and a sharp particle size distribution.

As a result of analysis on the cause of nozzle clogging, it was found that aggregates of particulated releasing agent contained in toner materials and particulated releasing agent particles having relatively a large particle diameter cause clogging of nozzle holes. In particular, it is known that particulated releasing agent particles tend to aggregate and form aggregates only when the toner composition liquid is left standing. Thus, it is significantly difficult to solve the problems.

The toner of the present invention contains no releasing agent, and thus does not cause clogging of jet nozzles even when liquid droplets are discharged periodically from a plurality of nozzles. Therefore, the toner of the present invention can be easily produced by the jet granulation method, and consequently, it is possible to obtain a toner for use in non-heating fixing, which has small diameters and a sharge particle distribution and have not yet been provided so far.

The jet granulation method will be further described in detail with reference to drawings.

FIG. 1 illustrates one example of a toner production apparatus used in the present invention. A toner production apparatus 100 includes a liquid droplet discharging unit 110 configured to discharge a toner material liquid (toner composition liquid) L in which toner materials containing a binder resin and a colorant are dissolved or dispersed in an organic solvent; a dry column (solvent removal unit) 120 which is provided on the lower part of the liquid droplet discharging unit 110 and configured to dry liquid droplets L' discharged from the liquid droplet discharging unit 110 using a dry gas G to form a toner base T; a trapping unit 130 configured to trap the base particle T; a reservoir unit 140 to retain the base particle T trapped by the trapping unit 130; and a supply unit 150 configured to supply the liquid droplet discharging unit 110 with the toner material liquid L. Note that the dry gas G means a gas having a dew-point temperature of −10° or lower under the atmospheric pressure.

Figure 2A:
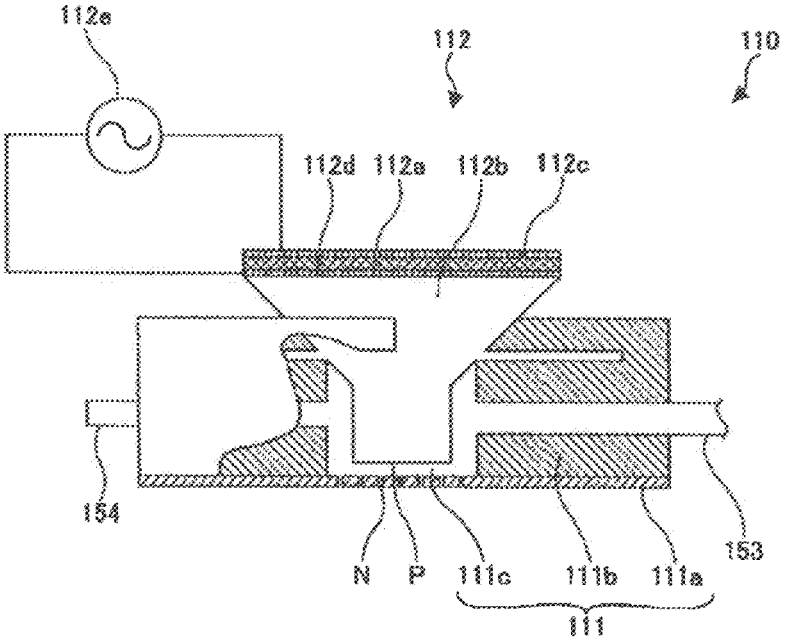
FIG. 2A is a schematic cross-sectional view illustrating a liquid droplet discharging unit in FIG. 1.
Figure 2B:
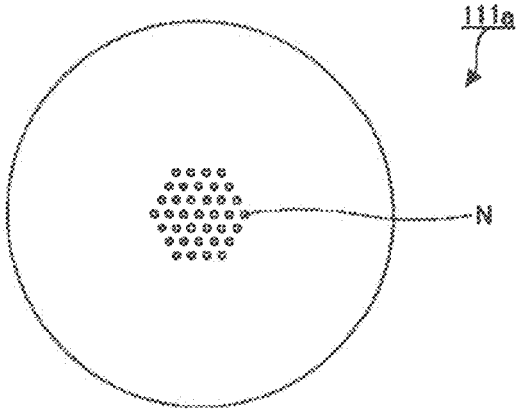
FIG. 2B is a bottom view illustrating the liquid droplet discharging unit in FIG. 1.

FIGS. 2A and 2B illustrate the liquid droplet discharging unit 110. The liquid droplet discharging unit 110 includes a flow path member 111 through which the toner material liquid L is conveyed, and a vibration member (vibration generating unit) 112. Note that FIG. 2A and FIG. 2B are a schematic cross-sectional view and a bottom view, respectively.

The flow path member 111 has a thin film 111*a* with a plurality of discharge openings Ns formed therein, a flow path member main body 111*b* and a liquid chamber 111*c* which transmits vibrations to the toner material liquid L.

The thin film 111*a* is jointed to the flow path member main body 111*b* using a bonding material having resistance to the organic solvent contained in the toner material liquid L.

The material constituting the thin film 111*a* is not particularly limited as long as it is a material having a high elastic modulus. Examples thereof include nickel, nickel alloys, SUS, silicon, and silicon oxides. Among these, nickel, nickel alloys, silicon and silicon oxides are preferable because of their ability of precisely forming the discharge opening having a large aspect ratio.

As the production method of the thin film 111*a*, there are exemplified electroforming methods and silicon process. The thin film 111*a* may be produced by forming the discharge opening N through the use of a punch.

The thin film 111*a* commonly has a thickness of from 5 μm to 500 μm, and an opening size (diameter of nozzle) of the discharge opening N of from 4 μm to 20 μm. When the thickness is less than 5 μm, the rigidity of the thin film 111*a* may be reduced, and when the thickness is more than 500 μm, it may be difficult to discharge the toner material liquid L. When the opening size of the discharge opening N is smaller than 4 μm, the discharge opening N easily causes a clogging, and when the opening size is greater than 20 μm, it may be difficult to form a toner base particle T having a particle size suitable for toner.

Note that as for the opening size of the discharge opening N, if the shape of the discharge opening N is a perfect circle, it means a diameter, and if the shape is an ellipse, it means an average diameter.

In the thin film 111*a*, 10 to 5,000 discharge openings Ns are formed. When the number of discharge opening Ns is less than 10, the productivity may decrease, and when it is more than 5,000, it may be difficult to form toner base particles having a narrow particle size distribution.

The flow path member 111 is provided with a support member (not illustrated). With this, the liquid droplet discharging unit 110 is held on the top surface part of the dry column 120. In this embodiment, the liquid droplet discharging unit 110 may be held on the side surface of the dry column 120.

The vibration member 112 includes an electrostrictive torsional vibrator 112*a* having a surface in parallel with the thin film 111*a*, a horn 112*b* which amplifies the amplitude of a bending vibration generated at the electrostrictive torsional vibrator 112*a*, electrodes 112*c* and 112*d* pinching the electrostrictive torsional vibrator 112*a*, and a power source 112*e* which applies a alternating-current bias voltage between the electrode 112*c* and 112*d*. At this time, when an alternating-current bias voltage is applied between the electrodes 112*c* and 112*d*, the surface of the electrostrictive torsional vibrator 112*a* in parallel with the thin film 111*a* periodically generates a bending vibration in a direction perpendicular to the thin film 111*a*. Further, the amplitude of the bending vibration generated in the electrostrictive torsional vibrator 112*a* is amplified in the horn 112*b*, and a surface P of the horn 112*b* in parallel with the thin film 111*a* periodically generates a bending vibration in a direction perpendicular to the thin film 111*a*. As a result, the thin film 111*a* periodically generates a bending vibration, and thereby the toner material liquid L is discharged from the plurality of discharge openings Ns.

The frequency necessary for the thin film 111*a* to generate a bending vibration is usually 20 kHz or more and less than 2 MHz, more preferably 50 kHz or more and less than 500 kHz. When the frequency is less than 20 kHz, the discharge openings Ns easily cause a clogging, the toner material liquid L suffers from cavitation due to the vibration generated from vibration member 112, which may cause unstable discharge of the toner material liquid L. When the frequency is more than 2 MHz, it may be difficult to form the base particle T having a narrow particle size distribution. At this time, the oscillation waveform of the bending vibration generated by the electrostrictive torsional vibrator 112*a* is not particularly limited. For example, a sin waveform, and a square waveform are exemplified.

The material of the electrostrictive torsional vibrator 112*a* is not particularly limited. For example, piezoelectric ceramics such as lead zirconium titanate (PZT) are exemplified. Since piezoelectric ceramics typically have a small displacement of vibration, they are used as laminates. As electrostrictive torsional vibrator 112*a* other than those described above, piezoelectric polymers (e.g., polyvinyl fluoride (PVDF)), and piezoelectric crystal materials (e.g., quartz crystals, $LiNbO_3$, $LiTaO_3$, $KNbO_3$) are exemplified.

Also, the electrostrictive torsional vibrator 112*a* is preferably a bolting Langevin vibrator because it is mechanically combined with piezoelectric ceramics and has high strength. With this, it is possible to prevent fracture when the electrostrictive torsional vibrator 112*a* generates excitation at high amplitude.

Instead of the electrostrictive torsional vibrator 112*a*, a magnetostrictive torsional vibrator may be used to apply an alternating-current bias voltage between the electrodes 112*c* and 112*d*. The magnetostrictive torsional vibrator is not particularly limited. For example, ferromagnetic materials such as nickel, iron, and ferrite, are exemplified.

Since the horn 112*b* can amplify the amplitude of a bending vibration generated at the electrostrictive torsional vibrator 112*a*, the amplitude of the bending vibration generated at the electrostrictive torsional vibrator 112*a* may be made small, the mechanical burden is alleviated, and thus it is possible to prolong the operation life of the vibration member 112. The vibration member 112 is designed such that the surface of the horn 112*b* in parallel with the thin film 111*a* will be a maximum plane of vibration.

When the amplitude of a bending vibration generated at the electrostrictive torsional vibrator 112*a* is large, the provision of the horn 112*b* may be omitted.

Figure 3:
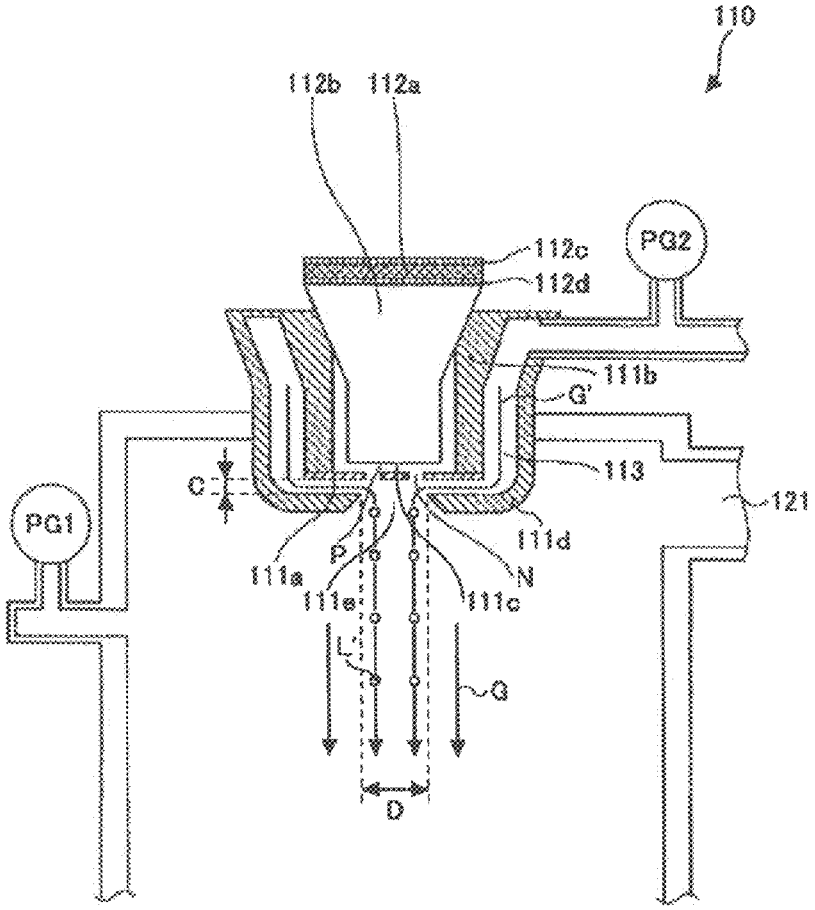
FIG. 3 is a side cross-sectional view illustrating the liquid droplet discharging unit in FIG. 1.

As illustrated in FIG. 3, the liquid droplet discharging unit 110 is formed with a vapor phase flow path 113 which supplies a dry gas G' in a substantially same direction as the direction to which the toner material liquid L is discharged. A flow rate V1 of the dry gas G' is sufficient to be higher than the initial discharge speed of discharged liquid droplets, and the flow rate V1 is preferably higher than an initial speed V0 of liquid droplets L' discharged from the discharge openings Ns. Since the dry gas G' controls the speed of the liquid droplets L' discharged from the plurality of discharge openings Ns, it can prevent coalescence of the liquid droplets L'. The dry gas G' preferably forms a laminar flow uniform in the circumferential direction of the vapor phase flow path 113. When the dry gas G' forms a turbulent flow, the liquid droplet L' may be combined with other liquid droplets. Such a phenomenon unfavorably leads to a hindrance to an attempt to obtain a toner having a uniform particle size. The dry gas G' is not particularly limited. For example, air and nitrogen are exemplified.

The vapor phase flow path 113 is provided with an air flow restrictor 111*d* which restricts flow of the dry gas G' in the vicinity of the plurality of discharge openings Ns, and an opening 111*e* facing to the plurality of discharge openings Ns is provided at the air flow restrictor 111*d*. That is, the air flow path is provided with an air flow restrictor which reduces the cross-sectional area of the air flow path through which air flow passes immediately after that at which the toner material liquid is discharged from the plurality of discharge openings Ns.

At this time, a clearance C between the thin film 111*a* and the restrictor 111*d* with respect to a width D of the opening 111*e* is small, the clearance C is a main factor to determine the flow rate of the dry gas G'. In addition, the opening 111*e* has a tapered shape expanding from the upstream side toward the downstream side, and thus it is possible to prevent the liquid droplets L' from adhering to the restrictor 111*d*.

A dry gas G is supplied from a dry air supply port 121 into the dry column 120. The dry gas G is formed of a laminar flow uniform in the circumferential direction of the dry column 120, conveys the liquid droplets L' discharged from the opening 111*e* and dry the liquid droplets L'. With this configuration, it is possible to prevent coalescence of the liquid droplets L' discharged from the opening 111*e*. At this time, a flow rate V2 of the dry gas G is preferably higher than the flow rate of the dry gas G'. When the flow rate V2 is lower than V1, a turbulent flow may be formed. In addition, a pressure P1 indicated by a pressure gauge PG1 is preferably lower than a pressure P2 indicated by a pressure gauge PG2. When the pressure P1 is higher than P2, a negative pressure works at the liquid droplets L' to cause a backward current.

In this case, the liquid droplets L' may be sucked from the lower part of the dry column 120, instead of supplying the dry gas G from the, dry air supply port 121.

Figure 4:
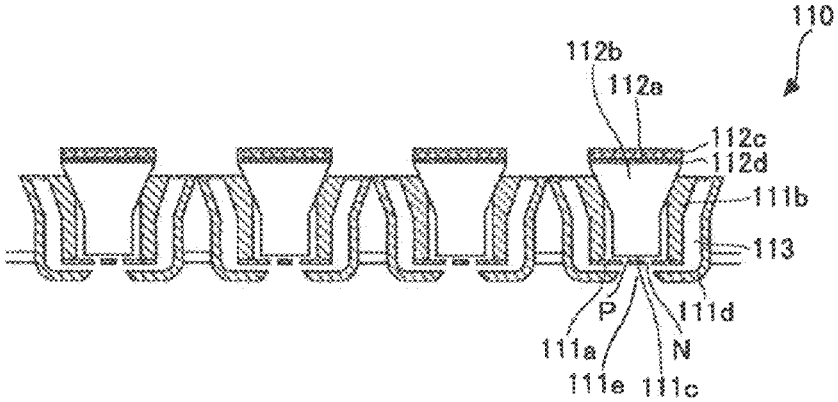
FIG. 4 is a cross-sectional view illustrating one example of the construction where a plurality of liquid droplet discharging units are held on a dry column.

Note that in FIG. 1, one unit of the liquid droplet discharging unit 110 is held on the dry column 120, however, to further increase the productivity, a plurality of units of the liquid droplet discharging unit 110 may be held on the dry column 120 as illustrated in FIG. 4. In this case, the number of units of the liquid droplet discharging unit 110 to be held on the dry column 120 is preferably 100 to 1,000. When the number of units of the liquid droplet discharging unit 110 is less than 100, the productivity of toner may decrease, and when it is more than 1,000, it may become difficult to control the liquid droplet discharging units 110. In this case, the toner production apparatus may be configured such that the toner material liquid L is supplied from a single supply port to the plurality of liquid droplet discharging units 110.

In the dry column 120, liquid droplets L' discharged from the liquid droplet discharging unit 110 is conveyed using the dry gas G flowing in a substantially same direction as the direction to which the toner material liquid L is discharged, and thereby the liquid droplets L' are dried and a toner base T is formed.

A trap unit 130 is continuously provided with the dry column 120 at the downstream side of the conveyance direction of the toner base particle T, and has a taper surface 131 with an opening size diminishing from the upstream side toward the downstream side. Further, by sucking the inside the dry column 120 using a suction pump (not illustrated), a vortex flow S flowing the upstream side toward the downstream side of the trap unit 130 is generated. With this configuration, the toner base particle T is trapped and transferred, via a pipe 132, to a reservoir 140 to be stored. At this time, the toner base particle T is pressure-fed from the trap unit 130 to the reservoir 140, or may be sucked from the side of the reservoir 140.

A supply unit 150 includes a tank 151 to store the toner material liquid L, a pump 152 to pressure-feed the toner material liquid L, a pipe 153 for supplying the toner material liquid L to the liquid droplet discharging unit 110, and a pipe to discharge the toner material liquid L from the liquid droplet discharging unit 110, and is structured to have a circulating system. In addition, the circulating system is provided with a flow rate sensor 155 to detect the flow rate of the toner material liquid L.

Figure 5:
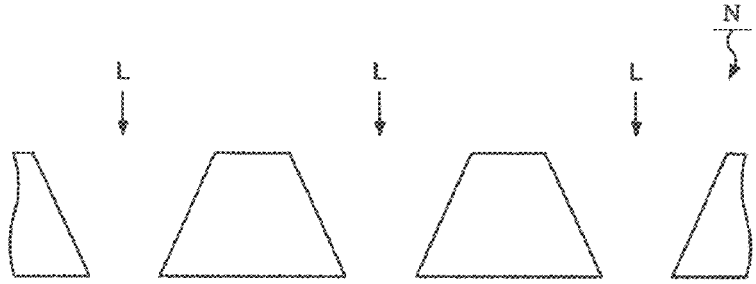
FIG. 5 is a cross-sectional view illustrating one example of a nozzle in FIG. 1.

FIG. 5 illustrates one example of a part of the cross-section of a nozzle N. The nozzle N may be merely a cylindrical space or may be formed in a taper shaped hole having a hole diameter diminishing from the liquid feeding side toward the liquid discharging side. As an effect of this configuration, the discharge speed of the toner material liquid L is increased when the toner material liquid L is pushed out in the discharging direction, and thus the liquid droplets can be efficiently discharged. At this time, a taper angle θ of the taper-shaped hole is usually 30° to 80°, and more preferably 45° to 70°.

Note that the hole diameter of the nozzle N means, in the case where the hole diameter varies from the liquid feeding side toward the liquid discharging side, a minimum value of hole diameter of the nozzle.

Figure 6:
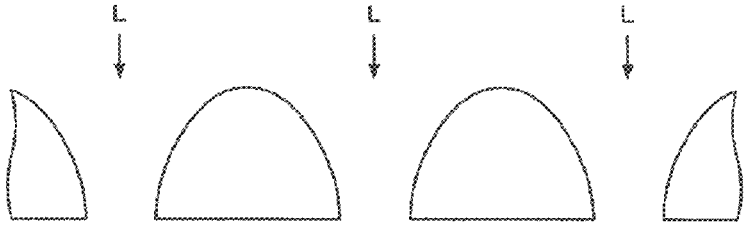
FIG. 6 is a cross-sectional view illustrating a variant example of a nozzle in FIG. 5.

As illustrated in FIG. 6, a nozzle formed with a curved hole having a hole diameter diminishing the liquid feeding side toward the liquid discharging side as viewed in the cross-section thereof.

Next, using a toner production apparatus 100, the method of producing a toner is described. First, by applying an alternating-current bias voltage to the electrostrictive torsional vibrator 112*a* of the vibration member 112 in a state where the toner material liquid L is supplied to the flow path member 111 of the liquid droplet discharging unit 110, a bending vibration is generated in the electrostrictive torsional vibrator 112*a*. The amplitude of the bending vibration is amplified by the horn 112*b*, and the surface P of the horn 112*b* in parallel with the thin film 111*a* periodically vibrates in a direction perpendicular to the thin film 111*a*. That is, the bending vibration of the surface P of the vibration member 112 in parallel with the thin film 111*a* is transmitted to the toner material liquid L in the reservoir unit 111, and the pressure inside the reservoir unit 111 periodically varies. As a result of this, the thin film 111*a* periodically generates a bending vibration and the toner material liquid L is discharged in a state of being formed into liquid droplets (as liquid droplets L') in the dry column 120.

The liquid droplets L' discharged into the dry column 120 is conveyed using the dry gas G which flows in a substantially same direction as the direction to which the toner material liquid L is discharged. Thereby the organic solvent is removed, and a toner base particle T is formed. Further, the toner base particle T is trapped by the trap unit 130 disposed downstream the dry column 120 using a vortex current S, and transferred to the reservoir unit 140 to be stored. As a result, a toner base particle T having a ratio of a weight average particle diameter to a number average particle diameter of 1.00 to 1.10 can be produced. In addition, a toner base particle T having a weight average particle diameter of 3 μm to 6 μm can be produced.

Figure 7:
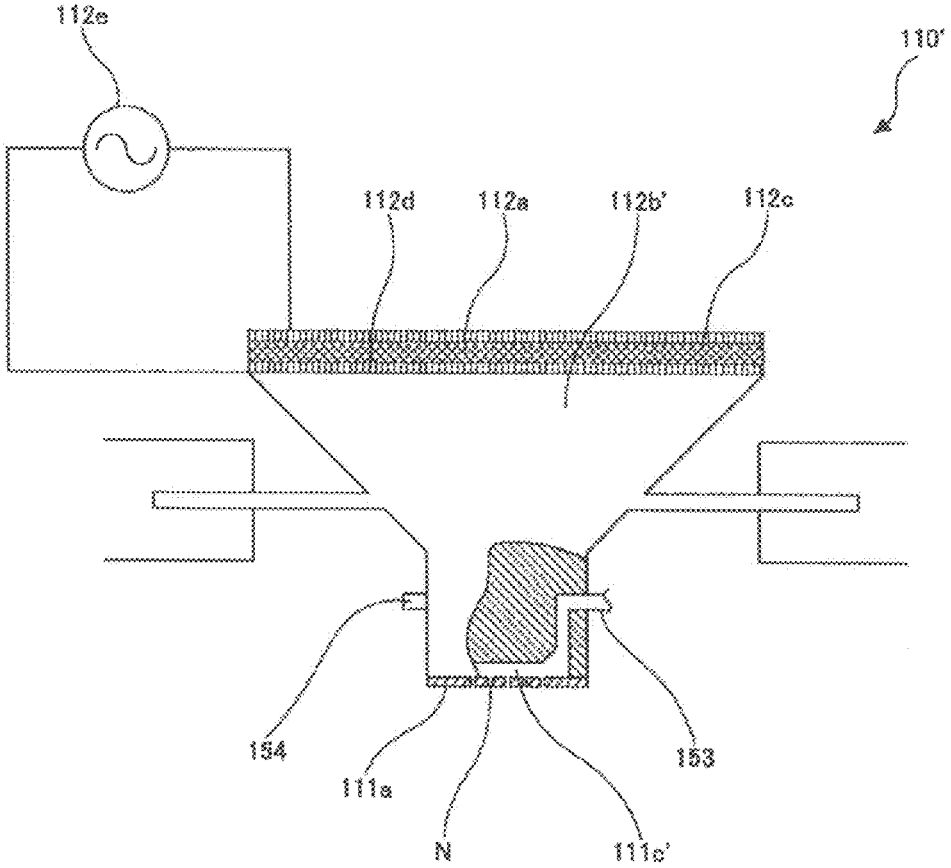
FIG. 7 is a schematic cross-sectional view illustrating a variant example of the liquid droplet discharging unit of FIG. 2.

FIG. 7 illustrates a variant of the liquid droplet discharging unit 110. A liquid droplet discharging unit 110' has the same construction as that of the liquid droplet discharging unit 110, except that a horn 112*b*' having a liquid chamber 111*c*' through which a toner material liquid is passed, instead of the flow path member 111 and the horn 112*b*. In this embodiment, the horn 112*b*' is jointed to a thin film 111*a* using a bonding agent having resistance to the organic solvent contained in the toner material liquid L and also serves as a part of the flow path member. The liquid chamber 111*c*' is connected to pipes 153 and 154, and the liquid droplet discharging unit 110' is held on a dry column 120 using an elastic material, as required.

Figure 8:
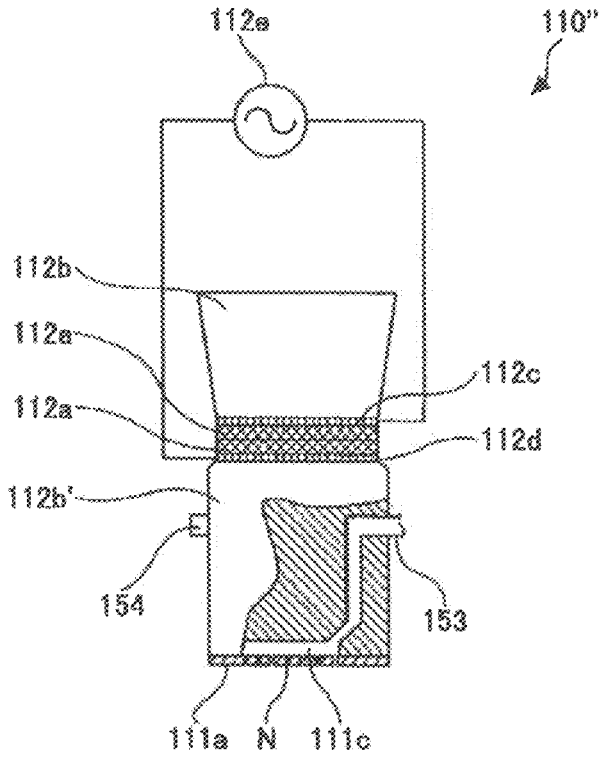
FIG. 8 is another schematic cross-sectional view illustrating a variant example of the liquid droplet discharging unit of FIG. 2.

FIG. 8 illustrates another variant of the liquid droplet discharging unit 110. A liquid droplet discharging unit 110" has the same construction as that of the liquid droplet discharging unit 110, except that a bolting Langevin vibrator, in which a laminate having two layers of the electrostrictive torsional vibrator 112*a* is pinched by a horn 112*b* and a horn 112*b*' having a liquid chamber 111*c*' for storing a toner material liquid, is used instead of the electrostrictive torsional vibrator 112*a* and the horn 112*b*.

Figure 9:
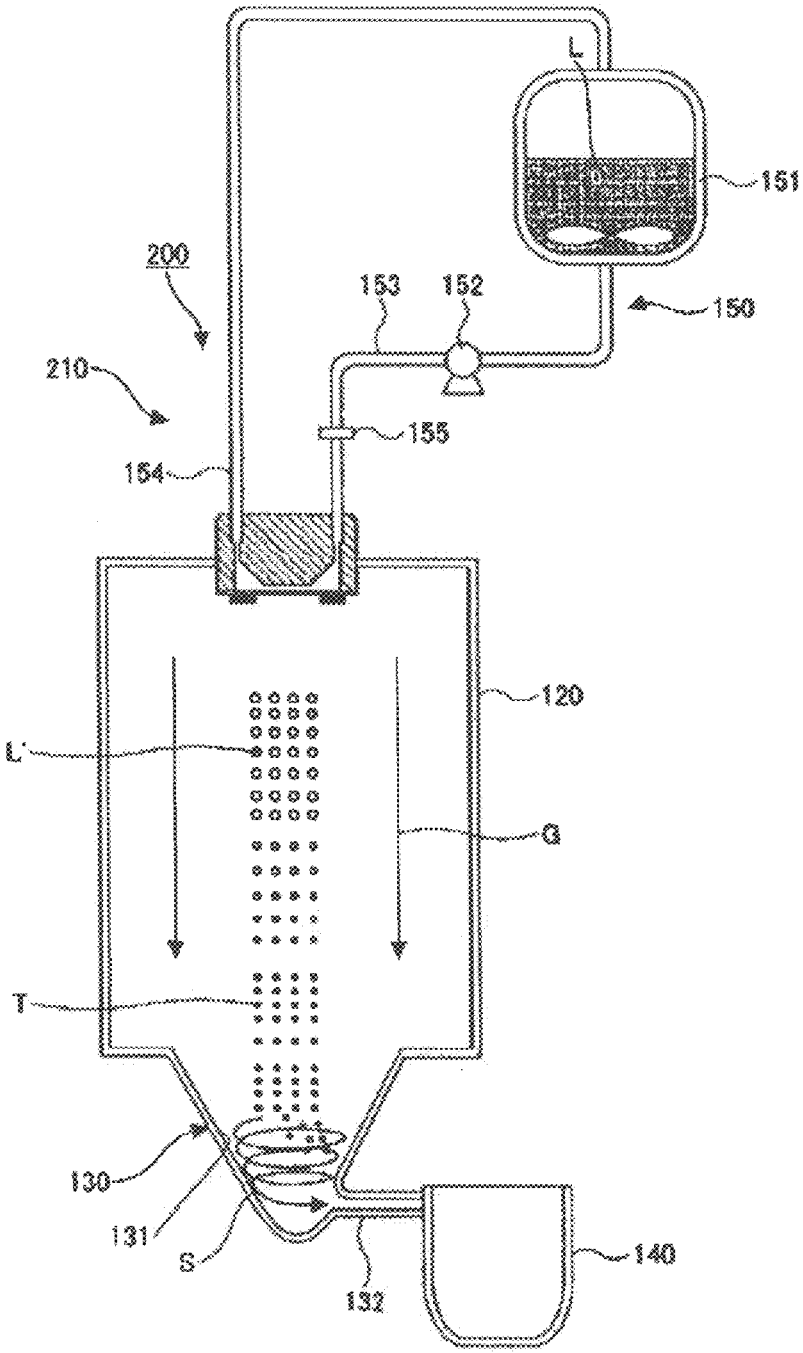
FIG. 9 is a schematic view illustrating a variant example of the toner production apparatus of FIG. 1.

FIG. 9 illustrates a variant of the toner production apparatus 100. A toner production apparatus 200 has the same construction as that of the toner production apparatus 100, except that it is provided with a liquid droplet discharging unit 210, instead of the liquid droplet discharging unit 110.

Figure 10A:
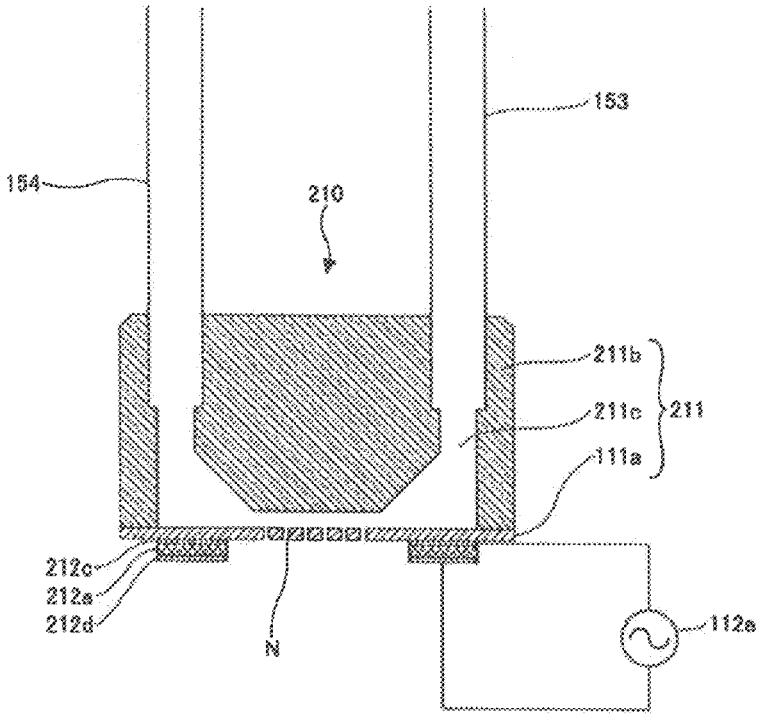
FIG. 10A is a schematic cross-sectional view illustrating a liquid droplet discharging unit in FIG. 9.
Figure 10B:
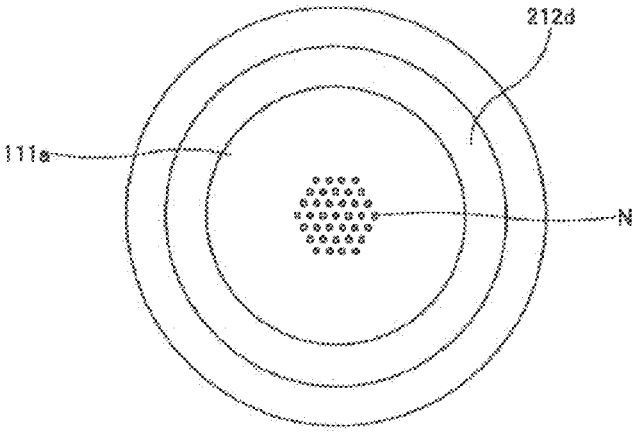
FIG. 10B is a bottom view illustrating the liquid droplet discharging unit of FIG. 9.

FIGS. 10A and 10B illustrate the liquid droplet discharging unit 210. The liquid droplet discharging unit 210 includes a flow path member 211 through which the toner material liquid L is conveyed, and a vibration member 212. Note that FIGS. 10A and 10B are each a bottom view. In this embodiment, similarly to the liquid droplet discharging unit 110, the liquid droplet discharging unit 210 is formed with a vapor phase flow path 113 for supplying a dry gas in a substantially same direction as the direction to which the toner material liquid L is discharged.

The flow path member 211 has the same construction as that of the flow path member 111 except that a flow path member main body 211*b* and a liquid chamber each having a different shape, instead of the flow path member main body 111*b* and the liquid chamber 111*c*.

The thin film 111*a* is jointed to the flow path member main body 211*b* using a bonding material having resistance to the organic solvent contained in the toner material liquid L, and for the cross-sectional shape of a nozzle N, the shapes illustrated in FIGS. 5 and 6 are suitable.

Note that the flow path member 211 is provided with a support member (not illustrated). With this configuration, the liquid droplet discharging unit 210 is held on the top surface part of a dry column 120. In this embodiment, the liquid droplet discharging unit 110 may be held on the side surface of the dry column 120.

The vibration member 212 has the same construction as that of the vibration member 112, except that no horn 112*b* is provided, and laminate in which an electrostrictive torsional vibrator 212*a* having a surface in parallel with a thin film 111*a* is pinched by electrodes 212*c* and 212*d*, is provided in an annular manner in the periphery of a plurality of discharge openings Ns of the thin film 111*a*, instead of the laminate in which the electrostrictive torsional vibrator 112*a* is pinched by the electrodes 112*c* and 112*d*.

At this time, when an alternating-current bias voltage is applied between the electrodes 112*c* and 112*d*, the surface of the electrostrictive torsional vibrator 112*a* in parallel with the thin film 111*a* periodically generates a bending vibration in a direction perpendicular to the thin film 111*a*. As a result of this, the thin film 111*a* periodically generates a bending vibration and the toner material liquid L is discharged in a state of being formed into liquid droplets (as liquid droplets L') in the dry column 120.

The frequency necessary for the thin film 111*a* to generate a bending vibration is usually 20 kHz or more and less than 2 MHz, more preferably 50 kHz or more and less than 500 kHz. When the frequency is less than 20 kHz, the discharge openings Ns easily cause a clogging, the toner material liquid L suffers from cavitation due to the vibration generated from vibration member 112, which may cause unstable discharge of the toner material liquid L. When the frequency is more than 2 MHz, it may be difficult to form the base particle T having a narrow particle size distribution. At this time, the oscillation waveform of the bending vibration generated by the electrostrictive torsional vibrator 112*a* is not particularly limited. For example, a sin waveform, and a square waveform are exemplified.

Note that in FIG. 9, one unit of the liquid droplet discharging unit 210 is held on the dry column 120, however, to further increase the productivity, a plurality of units of the liquid droplet discharging unit 210 may be held on the dry column 120. In this case, the number of units of the liquid droplet discharging unit 210 to be held on the dry column 120 is preferably 100 to 1,000. When the number of units of the liquid droplet discharging unit 210 is less than 100, the productivity of toner may decrease, and when it is more than 1,000, it may become difficult to control the liquid droplet discharging units 210. In this case, the toner production apparatus may be configured such that the toner material liquid L is supplied from a single supply port to the plurality of liquid droplet discharging units 210.

Figure 11A:
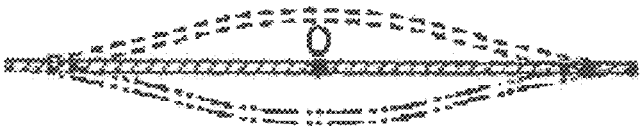
FIG. 11A is a view illustrating the basic vibration of a bending vibration in the case where the circumference of a round film is fixed.
Figure 11B:
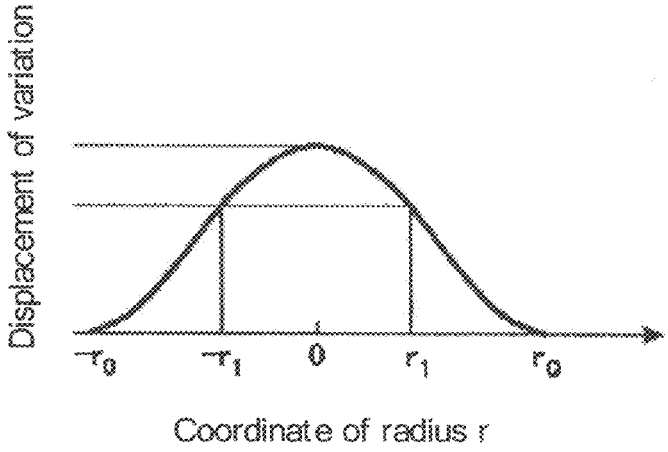
FIG. 11B is a graph illustrating a relationship of vibration displacement with respect to a radius coordinate of the round film of FIG. 11A in a time t.

Next, the mechanism for discharging liquid droplets using the liquid droplet discharging unit 210 is described. Note that the following describes a case where the circumference of a round film having a radius r0 is fixed. A plurality of discharge openings having a radius r1 are concentrically formed in the round film. In this case, as for the basic vibration of a bending vibration, as illustrated in FIG. 11, the circumference (r=r0) is a node, a vibration displacement ΔL at a center O (r=0) becomes a maximum value (ΔLmax), and the round film periodically generates a bending vibration. FIG. 11A is a cross-sectional view of the round film in its radius direction, and 11B illustrate a relationship of vibration displacement with respect to a radius coordinate of the round film in a time t.

Figure 12:
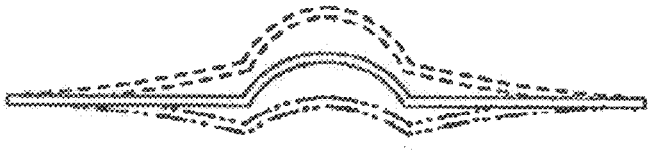
FIG. 12 is a view illustrating bending vibration in the case where the circumference of a round film having a convex shape at its center portion is fixed.

Further, as illustrated in FIG. 12, by forming the center portion of the round film so as to have a convex, it is possible to control the direction to which liquid droplets are discharged and to control the amplitude of the bending vibration.

Meanwhile, when the round film generates a bending vibration and thereby a toner material liquid is present in the vicinity of discharge openings provided in the round film, a sound pressure Pac proportional to a bending vibration speed Vm of the round film is generated. It is known that the sound pressure Pac is generated as a counteraction of a radiation impedance Zr of a toner material liquid. The sound pressure Pac is a product obtained between the radiation impedance Zr and the bending vibration speed Vm of the round film, and is represented by the equation, $Pac(r,t)=Zr\cdot Vm(r,t)$. In this case, the bending vibration speed Vm of the round film periodically varies, and thus the sound pressure Pac proportional to the bending vibration speed Vm of the round film also varies. With this mechanism, the toner material liquid L in the vicinity of the discharge openings are discharged in a vapor phase. The discharged toner material liquid has a sphere shape due to a difference in surface tension from the vapor phase, and thus liquid droplets of the toner material liquid are periodically generated.

In this case, the amount of displacement of the sound pressure Pac is usually 10 kPa to 500 kPa, more preferably 10 kPa to 100 kPa. When the amount of displacement of the sound pressure Pac is less than 10 kPa, the discharge openings easily cause a clogging, and when it is more than 500 kPa, the toner material liquid easily suffers from cavitation.

Note that there is a tendency that the greater the displacement of bending vibration in the vicinity of the discharge openings, the larger diameter of liquid droplets. In addition, when the displacement of bending vibration in the case of r=r1 is regarded as ΔLmin (see FIG. 11B), the particle size distribution of the base particle can be made narrower, provided that a ratio of ΔLmax/ΔLmin is 2.0 or smaller.

<<Addition and Mixing of Inorganic Fine Particle>>

Meanwhile, in order to improve the flowability, storage stability, developing properties and transferability of the toner, inorganic fine particles, such as a hydrophobized silica fine powder, may be added to and mixed with the toner base particle produced as described above.

In the mixing of additives, a typical mixer for powder is used, however, it is preferable to mount a jacket to the mixer so as to control the temperature of the system. To change the hysteresis of load applied to additives, the additives may be added at some midpoint or gradually in the mixing process. In this case, the number of revolutions, rolling rate, time, temperature etc. of the mixer may be changed. Alternatively, a strong load is applied to the system initially and then a relatively weak load may be applied, and vice versa. The equipment for use as the mixer, a V-shaped mixer, a rocking mixer, a Loedige mixer, a Nauter mixer and a HENSCHEL miser are exemplified. Next, the mixture is passes through a sieve of 250 mesh, followed by removal of coarse particles and aggregated particles, to thereby produce a toner.

<Developer>

A developer for use in the present invention contains at least the toner of present invention, and contains other suitably selected components such as carrier. The developer may be a one-component developer or a two-component developer. However, when it is used in a high-speed printer or the like, which is responsible to the recent improvement in information processing speed, the two-component developer is preferably used in terms of improvement of its operation lifetime.

When the one-component developer using the toner is used, stable developing properties and an image excellent in quality can be obtained without causing variation in particle diameter of the toner even when the toner balance is varied, and without causing toner filming on a developing roller serving as a developer bearing member and toner fusion to a layer thickness-regulating member such as a blade for making the toner formed into a thin layer, even when the developing unit is used for a long time (even in a long time agitation in the developing unit). In addition, when the two-component developer using the toner is used, favorable and stable developing properties can be obtained without substantially causing variation in particle diameter of the toner in the developer even in a long time agitation in the developing unit.

<<Carrier>>

The carrier is not particularly limited and may be suitably selected in accordance with the intended use. It is, however, a carrier having a core material and a resin layer for coating the core material is preferable.

—Core Material of Carrier—

The core material is not particularly limited as long as it is a particle having magnetism. Preferred examples thereof include ferrite, magnetite, iron and nickel. In consideration of the applicability to environmental aspects which are remarkably fostered recently, in the case of ferrite, for example, it is preferable to use manganese ferrite, manganese-magnesium ferrite, manganese-strontium ferrite, manganese-magnesium-strontium ferrite, lithium-based ferrite, not using conventional copper-zinc ferrite.

For the purposes of controlling the resistance of the core material and for increasing the production stability, one or more elements selected other elements, as a component of the core material, for example, from Li, Na, K, Ca, Ba, Y, Ti, Zr, V, Ag, Ni, Cu, Zn, Al, Sn, Sb, and Bi may be incorporated. The amount of these elements used in the core material is preferably 5 atomic % or less relative to the total amount of metal elements in the core material, and more preferably 3 atomic % or less.

—Coating Layer—

The coating layer contains at least a binder resin and may contain other components such as inorganic fine particles as required.

—Binder Resin—

The binder resin for use in forming the coating layer of the carrier is not particularly limited and may be suitably selected from among known resins. Specific examples thereof include polyolefins (e.g., polyethylene, and polypropylene) and modified products thereof, crosslinkable copolymers containing acrylonitrile, vinyl acetate, vinyl alcohol, vinyl chloride, vinyl carbazole, or vinyl ether; silicone resins containing an organosiloxane bond or modified products thereof (e.g, modified products prepared with alkyd resins, polyester resins, epoxy resins, polyurethane, or polyimide); polyamide, polyester, polyurethane, polycarbonate, urea resins, melamine resins; benzoguanamine resins, epoxy resins; ionomer resins; polyimide resins, and derivatives thereof. These may be used alone or in combination. Among these, acrylic resins and silicone resins are particularly preferable.

(Fixing Method)

Next, a fixing method according to the present invention is described.

In the fixing method according to the present invention, a fixing liquid containing a softening agent for softening the toner is applied onto a toner image on a recording medium, and the toner is fixed on the recording medium. In this process, as the toner, the toner described above is used.

<Fluid-Form Fixing Liquid>

A fluid-form fixing liquid serving as a toner fixing liquid contains a component for swelling or softening at least a part of the binder resin (softening agent) contained in the toner, an aqueous dispersion medium, and a non-aqueous dispersion medium. The fluid-form fixing liquid is formed by dispersing the component for swelling or softening at least a part of the binder resin in the aqueous dispersion medium, and dispersing the aqueous medium in the non-aqueous dispersion medium, so as to fix the toner on a recording medium in a state where at least a part of the binder resin contained in the toner is swollen or softened.

<<Softening Agent>>

The softening agent serving as the component for swelling or softening at least a part of the binder resin is not particularly limited. As a specific example thereof, aliphatic ester is used. The aliphatic ester includes saturated aliphatic ester. When the aliphatic ester contains saturated aliphatic ester, it is possible to improve the storage stability (resistance to oxidation and hydrolytic degradation) of the component for swelling or softening at least a part of the binder resin contained in the toner.

—Aliphatic Ester—

The aliphatic ester is not particularly limited and may be suitably selected in accordance with the intended use. For example, it may be saturated aliphatic ester, aliphatic monocarboxylic acid ester, aliphatic dicarboxylic acid ester, or aliphatic dicarboxylic acid dialkoxy alkyl.

—Saturated Aliphatic Ester—

When the aliphatic ester is saturated aliphatic ester, it is possible to improve the storage stability (resistance to oxidation and hydrolytic degradation) of the fluid plasticizer (softening agent). In addition, the saturated aliphatic ester has high safety to human body, and most of saturated aliphatic esters can dissolve or swell the binder resin contained in the toner for a short time (e.g., within one second). Further, the saturated aliphatic ester can decrease the tackiness of the toner provided on a recording medium. This can be considered because the saturated aliphatic ester forms an oil film on the surface of the dissolved or swollen toner.

—Aliphatic Monocarboxylic Acid Ester—

The saturated aliphatic ester preferably contains a compound represented by the following General Formula (2).

$$R^1COOR^2 \qquad \text{General Formula (2)}$$

[In General Formula (2), $R^1$ represents an alkyl group having 11 to 14 carbon atoms, and $R^2$ represents a linear or branched alkyl group having 1 to 6 carbon atoms.]

When the aliphatic ester contains the compound, the swellability and softening properties thereof to the binder resin contained in the toner can be improved.

Examples of the aliphatic monocarboxylic acid ester include ethyl laurate, hexyl laurate, ethyl tridecylate, isopropyl tridecylate, ethyl myristate, and isopropyl myristate. Most of these aliphatic monocarboxylic acid esters are dissolved in oil solvents, but are not dissolved in water. From this result, when aliphatic monocarboxylic acid ester is used to prepare a fixing liquid made from an aqueous solvent, glycols may be incorporated, as the after-mentioned dissolution auxiliary, into the aliphatic monocarboxylic acid ester to form it in the form of a solution or a micro-emulsion.

—Aliphatic Dicarboxylic Acid Ester—

The aliphatic ester preferably contains aliphatic dicarboxylic acid ester. When the aliphatic ester contains aliphatic dicarboxylic acid ester, the binder resin contained in the toner can be dissolved or swollen in a shorter time.

The aliphatic dicarboxylic acid ester is preferably a compound represented by the following General Formula (3).

$$R^3(COOR^4)_2 \qquad \text{General Formula (3)}$$

[In General Formula (3), $R^3$ represents an alkylene group having 3 to 8 carbon atoms, and $R^4$ represents a linear or branched alkyl group having 2 to 5 carbon atoms.]

When aliphatic ester contains a compound represented by General Formula (3), the swellability and softening properties thereof to the binder resin contained in the toner can be improved.

Examples of the aliphatic dicarboxylic acid ester include diethyl succinate, diethyl adipate, diisobutyl adipate, diisopropyl adipate, diisodecyl adipate, diethyl sebacate, and dibutyl sebacate. Most of these aliphatic dicarboxylic acid esters (the above-mentioned compounds) are dissolved in non-aqueous dispersion media, but are not dissolved in aqueous dispersion media. Accordingly, most of aliphatic dicarboxylic acid esters can be dispersed in an aqueous dispersion medium to obtain a toner fixing liquid.

—Aliphatic Dicarboxylic Acid Dialkoxy Alkyl—

The aliphatic ester for use in forming a toner fixing liquid may further contain aliphatic dicarboxylic acid dialkoxy alkyl. When the aliphatic ester contains aliphatic dicarboxylic acid dialkoxy alkyl, the fixability of the toner to recording media can be improved. The aliphatic dicarboxylic acid dialkoxy alkyl preferably a compound represented by the following General Formula (4).

$$R^5(COOR^6—O—R^7)_2 \qquad \text{General Formula (4)}$$

[In General Formula (4), $R^5$ represents an alkylene group having 2 to 8 carbon atoms, $R^6$ represents an alkylene group having 2 to 4 carbon atoms, and $R^7$ represents an alkyl group having 1 to 4 carbon atoms.]

When the toner fixing liquid contains a compound represented by General Formula (4), the swellability and softening properties of the fixing liquid to the binder resin contained in toner 3 can be improved.

Examples of the aliphatic dicarboxylic acid dialkoxy alkyl (compounds represented by General Formula (4)) include diethoxyethyl succinate, dibutoxyethyl succinate, diethoxyethyl adipate, dibutoxyethyl adipate, and diethoxyethyl sebacate. Most of these aliphatic dicarboxylic acid dialkoxy alkyl (the above-mentioned compounds) are slightly dissolved in water (slightly aqueous-based). Accordingly, by dispersing most of these aliphatic dicarboxylic acid dialkoxy alkyls (as a compound represented by General Formula (4)) directly, as particles, in a non-aqueous medium, a toner fixing liquid can be obtained.

Further, as an analogous structure of the aliphatic dicarboxylic acid dialkoxy alkyl, a compound represented by General Formula (5) contains ether groups at a high percentage, and the compound has significantly high solubility in water. Thus, with use of the compound, a fixing liquid containing high concentration of a fluid plasticizer can be obtained.

$$R^8(COO—(R^9—O)n\text{-}R^{10})_2 \qquad \text{General Formula (5)}$$

In General Formula (5), n is an integer of 1 to 3, $R^8$ represent an alkylene group having 2 to 8 carbon atoms, $R^9$ represents an alkylene group having 1 to 3 carbon atoms, and $R^{19}$ represents an alkyl group having 1 to 4 carbon atoms.

Examples of the compound represented by General Formula (5) include diethoxyethoxyethyl succinate, diethoxyethoxyethyl adipate, dimethoxyethoxyethyl succinate, and dimethoxypropyl succinate.

<<Dispersion Medium>>

The aqueous dispersion medium may contain monohydric or polyhydric alcohols, for example, propylene glycol, 1,3-butylene glycol, and glycerin. When the aqueous dispersion medium contains ethanol, ethanol is an extremely safe material to human body, and is the only one material usable in office environments among volatile organic materials. In addition to the above, ethanol is a material capable of exhibiting excellent permeability to various kinds of porous members. With use of ethanol as a dispersion medium, it is possible to obtain excellent permeability to recording media and to improve the fixing responsiveness.

The non-aqueous dispersion medium preferably contains n-alkane. A non-aqueous dispersion medium containing n-alkane exhibits high affinity in particular to a toner that has been subjected to water repellency treatment, and can make the water-repellency treated toner greatly wet. That is, n-alkane which is a paraffin-based solvent has a low surface tension of 25 mN/m or lower and has high affinity to a water-repellency treated toner. As a result, when the toner fixing liquid is applied to a water-repellency treated toner formed on a recording medium, it is possible to reduce the disturbance of an image formed by the water-repellency treated toner. For example, among n-alkanes, decane, dodecene, undecane and tridecane have low volatility, and thus it is preferable to use one of these n-alkanes.

The non-aqueous dispersion medium may contain dimethyl silicone. A non-aqueous dispersion medium containing dimethyl silicone has high affinity, in particular, to a water-repellency-treated toner and can make the water-repellency treated toner greatly wet. That is, a non-aqueous dispersion medium containing dimethyl silicone which is a silicone-based solvent has a low surface tension of 20 mN/m or lower and has high affinity to a water-repellency treated toner. As a result, when the toner fixing liquid is applied to a water-repellency treated toner formed on a recording medium, it is possible to reduce the disturbance of an image formed by the water-repellency treated toner. For example, dimethyl silicone having a viscosity of 3 mPa·sec or higher has low volatility and thus is preferably used.

<Foam-Like Fixing Liquid>

The foam-like fixing liquid is used in the form of foams made of the fluid-form fixing liquid. The foam-like fixing liquid contains a diluent containing water, a foaming agent for foaming a fixing liquid, and a plasticizer serving as a softening agent for softening resin fine particles such as toner (hereinafter, a toner is exemplified), and further contains other components as required. In the fixing method of the present invention, it is preferable to use the foam-like fixing liquid.

<<Softening Agent>>

—Solid Plasticizer—

The solid plasticizer is not particularly limited, as long as it is solid normal temperature, soluble in diluent and capable of softening resin fine particles such as toner in a state of being dissolved in the diluent. Here, "normal temperature" is a temperature which is achieved without heating and cooling. For example, the normal temperature is preferably 5° C. to 35° C., which is defined in JIS Z8703. Within the normal temperature range, the solid plasticizer is in a solid state. That is, since water is contained in a fixing liquid in a foamed state, the solid plasticizer is in a fused state, however, when the fixing liquid is applied to an unfixed toner, permeates through the toner and the amount of water in the fixing liquid permeated into the toner is reduced by vaporization, the solid plasticizer is changed to be solid. When a fixing liquid containing a solid plasticizer is used, it is possible to increase the solidity of the toner after application of the fixing liquid can be increased by utilizing the properties of the solid plasticizer, focusing on the change of the solid plasticizer into a solid state. In addition, it is preferable in that under appropriate conditions of normal temperature, the solid plasticizer can exhibit its plasticizing ability to toner (hereinafter, may be referred to as resin fine particles), and when the solid plasticizer loses the plasticizing ability to be in a solid state, the solid plasticizer itself is hardened and can contribute to prevention of tack The solid plasticizer preferably contains a functional group having affinity with resin fine particles, which are a fixing target, such as having constant compatibility with resin fine particles. The functional group having affinity mentioned here means that, preferably, in the case where the functional group contained the molecule constituting resin fine particles is identical to the functional group contained in the solid plasticizer, and in the case where the solid plasticizer has a functional group having a constant compatibility between these functional groups. When the functional group contained in the solid plasticizer is a functional group which is constantly compatible with molecules constituting the resin fine particles, the solid plasticizer is triggered to enter the molecules constituting the resin fine particles by the interaction between these functional groups, and as a result, it is effective when a so-called polymer blend state is formed between the solid plasticizer and the resin fine particles, and the solid plasticizer softens or swell at least a part of the resin fine particles such as toner.

As a specific example of a combination of the solid plasticizer and the resin fine particles, the solid plasticizer is polyethylene glycol, and an ethylene oxide group is contained in the polyethylene glycol. Meanwhile, the corresponding resin fine particles contain an ethylene oxide group in the resin molecules. In this case, both the solid plasticizer and the resin fine particles contain an ethylene oxide group. With this, the affinity can be increased, and thereby the effect of improving the compatibility therebetween is exhibited. In the meanwhile, since this concept holds true when both the solid plasticizer and the resin fine particles have a functional group having affinity to each other, the functional group is not limited to the ethylene oxide group. As an another example, a propylene oxide group can be used, and further it effectively works in the case where a functional group contained in a known toner is incorporated in the solid plasticizer.

As the solid plasticizer, beside the above-mentioned requirements, those exhibiting plasticizing ability under certain conditions are exemplified. For example, the following solid plasticizers are exemplified.

(1) A solid plasticizer exhibiting plasticizing ability by dissolving in the after-mentioned diluent:

Materials having an ethylene oxide group: polyethylene glycols having a molecular weight of 1,000 to 2,000

(2) A solid plasticizer which does not exhibit plasticizing ability even when dissolved in a diluent, however, is capable of exhibiting its plasticizing ability when a small amount of the after-mentioned liquid plasticizer is present therein Material having an ethylene oxide group: polyethylene glycols having a molecular weight of 2,000 to 10,000

(3) A solid plasticizer which does not exhibit plasticizing ability even when dissolved in a diluent, however, is capable of exhibiting its plasticizing ability when slightly heated (for example, heated at 50° C. to about 100° C.)

Material having an ethylene oxide group: polyethylene glycols having a molecular weight of 2,000 to 10,000

Polyoxyethylene monoalkyl ethers: polyoxyethylene monolauryl ether, polyoxyethylene monocetyl ether, etc When the molecular weight of polyethylene glycol exemplified in (1) above is less than 1,000, a fixed image may be fused depending on the circumferential environments, and when it is more than 2,000, the solid plasticizer is not in a solid state at normal temperature, and thus in a system of a fixing liquid using only the solid plasticizer without containing the after-mentioned liquid plasticizer as an optional component, a sufficient plasticizing ability may not be exhibited. Based on the technical meanings, the molecular weight of polyethylene glycol is preferably 1,000 to 2,000.

When the molecular weight of polyethylene glycol exemplified in (2) above is more than 10,000, it is apparent that the solid plasticizer is not in a solid state at normal temperature, and thus a grain boundary may be generated between resin fine particles serving as a fixing target. From this viewpoint, in a system of a fixing liquid using only the solid plasticizer without containing the after-mentioned liquid plasticizer and the molecular weight is more than 10,000, it is difficult to use the fixing liquid. In addition, it was found that when the fixing liquid is used in an aspect where it contains water, the usable molecular weight of polyethylene glycol is in the range of 1,000 to 10,000.

The heating temperature of the solid plasticizer exemplified in (3) above is not particularly limited, as long as the plasticizing ability can be exhibited. It is, however, preferably 50° C. to 100° C. When the heating temperature is lower than 50° C., toner may not be sufficiently fixed, and when it is higher than 100° C., t is uneconomical in terms of energy consumption.

The amount of the solid plasticizer is not particularly limited, however, it is preferably 5% by mass to 30% by mass relative to the mass of the fixing liquid. When the solid plasticizer content is less than 5% by mass, it is difficult to per-form fixing, and when it is more than 30% by mass, the viscosity of the fixing liquid as a foam-like fixing liquid is increased, and poor foamability and a lack in stability of foams are caused, leading to a problem with quality.

—Liquid Plasticizer—

The fixing liquid may contain a liquid plasticizer. The liquid plasticizer is not particularly limited as long as it is soluble in diluents and can exhibit plasticizing ability under certain conditions. For example, it may be a liquid plasticizer which exhibits plasticizing ability alone to dissolve or swell at least a part of toner to thereby soften the toner, and a liquid plasticizer which exhibits plasticizing ability by combining the above-mentioned solid plasticizer.

Examples of the liquid plasticizer include ester compounds, in terms of their excellence in solubility or swellability under certain conditions. Among these ester compounds, aliphatic ester or carbonic acid ester are more preferable in terms of their excellence in softening ability of binder resins or in that the degree of inhibition of foamability caused by the after-mentioned diluent is low. The aliphatic ester can be suitably selected from the aliphatic esters (e.g., saturated aliphatic ester, aliphatic monocarboxylic acid ester, aliphatic dicarboxylic acid ester and aliphatic dicarboxylic acid dialkoxy alkyl) exemplified as a softening agent of the fluid-form fixing liquid, and these can be preferably used.

From the viewpoint of safety to human body, the acute oral toxicity LD50 of the liquid plasticizer is preferably greater than 3 g/kg, and more preferably 5 g/kg or more. As the liquid plasticizer, the above-mentioned aliphatic esters are particularly preferable because of their high safety to human body, as they are frequently used as cosmetic raw materials.

Fixing of toner on a recording medium is performed by a machine frequently used in a sealed condition, and a liquid plasticizer remains after fixing of toner on a recording medium and during the fixing, and thus the fixing of toner on a recording medium is preferably not attended with volatile organic compounds (VOC) and occurrence of unpleasant odor. In this point, it is preferable that the liquid plasticize contains no volatile organic compounds (VOC) and no material causing occurrence of unpleasant odor. The above-mentioned aliphatic esters are more preferable in comparison with generally used organic solvents (e.g., toluene, xylene, methylethylketone, and ethyl acetate), in terms of having a high boiling point, low volatility and having no suffocating odor.

—Carbonic Acid Ester—

Examples of carbonic acid ester as an example of the liquid plasticizer include cyclic esters such as ethylene carbonate, propylene carbonate; glycerol 1,2-carbonate, and 4-methoxymethyl-1,3-dioxolan-2-one.

Examples of ester compounds other than those described above include citrates (e.g., triethyl citrate, triethyl acetyl citrate, tributyl citrate, and tributyl acetyl citrate); compounds obtained by esterification of glycol (e.g., ethylene glycol diacetate, diethylene glycol diacetate, and triethylene glycol diacetate); and compounds obtained by esterification of glycerin (e.g., monoacetin, diacetin, and triacetin).

The amount of the liquid plasticizer contained in the fixing liquid is preferably 0.5% by mass to 50% by mass, and more preferably 5% by mass to 40% by mass relative to the mass of the fixing liquid. When the liquid plasticizer content is less than 0.5% by mass, the effect of dissolving or swelling the resin fine particles contained in the toner may be insufficient. When the liquid plasticizer content is more than 50% by mass, the flowability of resins contained in the toner cannot be reduced over a long time, and there is a probability that the fixed toner layer has tackiness.

<<Dissolution Auxiliary>>

The fixing liquid may contain a dissolution auxiliary for the purpose of dissolving a liquid plasticizer contained in the fixing liquid. The dissolution auxiliary is not particularly limited, as long as capable of dissolving the liquid plasticizer. For example, polyhydric alcohols are exemplified. Examples of the polyhydric alcohols include ethylene glycol, diethylene glycol, triethylene glycol, polyethylene glycol, propylene glycol, dipropylene glycol, tripropylene glycol, 1,3-butylene glycol, and glycerin. Among these, propylene glycol, and dipropylene glycol are preferable in that they can dissolve liquid plasticizers even when the liquid plasticizer is contained at high concentration, and they do not degrade foamability of foaming agents. The amount of the polyhydric alcohols contained in the fixing liquid is preferably from 1% by mass to 30% by mass relative to the mass of the fixing liquid. When the polyhydric alcohol content is more than 30% by mass, it is unsuitable because the foamability of the fixing liquid rather degrades. When the polyhydric alcohol content is less than 1% by mass, the concentration of the liquid plasticizer in the fixing liquid is increased, it may be difficult to dissolve the liquid plasticizer in water as a diluent solution.

<<Foam Increasing Agent>>

The fixing liquid is formed into foams and is used for fixing resin fine particles as the after-mentioned foam-like fixing liquid. At this stage, when the foam-like fixing liquid is made penetrate through a fine particle layer such as toner while the foam-like fixing liquid pushed against the fine particle layer at a coating contact nip part, and foams are broken, it inhibits permeation of the foam-like fixing liquid. To solve this problem, the fixing liquid of the present invention may further contain a foam increasing agent, for the purpose of preventing such a phenomenon and improving the foam stability. The foam increasing agent is not particularly limited, however, it is preferably aliphatic alkanol amide. In terms of the foam stability, it is more preferably aliphatic alkanol amide (II) type.

The amount of the foam increasing agent contained in the fixing liquid is preferably 0.01% by mass to 3% by mass relative to the mass of the fixing liquid.

<<Foaming Agent>>

The foaming agent contained in the fixing liquid in the present invention is not particularly limited, as long as it can foam the fixing liquid. With use of the foaming agent, excellent foamability and excellent foam stability can be realized. Examples of the foaming agent include saturated or unsaturated fatty acid salts, sulfonates (e.g., monoalkyl sulfates, alkyl polyoxyethylene sulfates, alkyl polyoxyethylene sulfates, and alkylbenzene sulfonates); and anionic surfactants such as phosphates (e.g., monoalkyl phosphate).

—Fatty Acid Salt—

Among foaming agents, fatty acid salts are most excellent in foam stability, and most suitable for a foaming agent of a fixing liquid.

The fatty acid salt is preferably fatty acid sodium salt, fatty acid potassium salt or fatty acid amine salt. It is more preferably fatty acid amine salt. The method of producing these fatty acid salts is not particularly limited. For example, the fatty acid salt may be produced as follows: water is heated, a fatty acid is added thereto, and then triethanolamine is further added, followed by heating to undergo a saponification reaction while being stirred for a certain time. At this time, the molar ratio of the fatty acid to triethanol amine is within the range of 1:0.5 to 1:0.9. By increasing the fatty acid molar ratio, unreacted fatty acid remains in the system after the saponification reaction, and the fatty acid and fatty acid amine salt can be mixed in the fixing liquid. The same result can be obtained when sodium salt and potassium salt are used.

The unsaturated fatty acid salt usable as a foaming agent is not particularly limited, however, an unsaturated fatty acid salt having 18 carbon atoms and having 1 to 3 double bonds is preferable. Specific examples thereof include oleate, linoleate, and linolenate. When the number of double bonds is 4 or higher, the left-standing stability of the fixing liquid degrades because of strong reactivity. These unsaturated fatty acid salts containing the unsaturated fatty acids may be used singularly or in combination for use as a foaming agent. In addition, the above-mentioned saturated fatty acid and the unsaturated fatty acid may be mixed for use as a foaming agent.

The liquid plasticizer has strong defoaming effect, the foamability and foam stability of the fixing liquid degrades with an increase in the concentration of the liquid plasticizer in the fixing. The liquid plasticizer hardly foams, foams are broken soon, and therefore, a foam-like fixing liquid having low bubble density may not be obtained.

Then, to prevent degradation of foamability of the fixing agent when the concentration of the liquid plasticizer in the fixing liquid is increased, among anionic surfactants, a fatty acid salt having 12 to 18 carbon atoms is used as a foaming agent and further a fatty acid having 12 to 18 carbon atoms is incorporated into the fixing liquid. Thereby, the foamability of the fixing liquid can be maintained high even when the concentration of the liquid plasticizer is increased.

In the foaming agent contained in the fixing liquid, the number of carbon atoms of the fatty acid salt is preferably 12 to 18, from the viewpoint of the excellence in foamability as compared with the case where water is merely foamed. Specific examples thereof include laurates (number of carbon atoms: 12), myristate (number of carbon atoms: 14), pentadecylic acid (number of carbon atoms: 15), palmitate (Number of carbon atoms: 16), margaric acid (number of carbon atoms: 17), and stearate (number of carbon atoms: 18).

The following describes the interaction between a fatty acid for use together with a fatty acid salt for use as a foaming agent and the liquid plasticizer. When an ester compound is used as a liquid plasticizer, the ester compound has an ester group in the chemical structure, and the fatty acid has a carbonyl group in the chemical structure. From this point, it can be considered that the ester group in the liquid plasticizer and the carbonyl group in the fatty acid electrically interact with each other in a system of the fixing liquid, which generates a bonding effect between molecules thereof, and thereby the foamability and foam stability as properties of the fixing liquid can be improved.

In the fatty acid having 12 to 18 carbon atoms usable as the foaming agent, the one having lower carbon atoms is more excellent in foamability but inferior in foam stability, and the one having higher carbon atoms is poor in foamability but remarkably excellent in foam stability. Therefore, as the fatty acid salt, a fatty acid salt may be singly used, but it is more preferable to use and mix a plurality of fatty acid salts having different carbon atoms from 12 to 18. As the mixing ratio, it is preferable that myristate (number of carbon atoms: 14) be most contained and laurate (number of carbon atoms: 12) and stearate be contained in smaller amounts. As specific ratio of fatty acid salts, in terms of the mass ratio of laurate:myristate:palmitate:stearate, it is preferable, 0:6:3:1, 0:4:3:1, 1:5:3:1, 1:4:4:1.

The amount of the foaming agent contained in the fixing liquid is preferably 0.1% by mass to 20% by mass and more preferably 0.5% by mass to 10% by mass relative to the mass of the fixing liquid. When the foaming agent content is less than 0.1% by mass, the foamability may be insufficient, and when the foaming agent content is more than 20% by mass, the viscosity of the fixing liquid is increased, and there is a probability that the foamability degrades.

By incorporating a fatty acid having the same number of carbon atoms as that of the fatty acid salt serving as a foaming agent into the fixing liquid, the foamability and foam stability can be maintained even when the concentration of the liquid plasticizer is increased. When the concentration of the liquid plasticizer is less than 10% by mass, there is not problem if a fatty acid is not contained. However, When the concentration of the liquid plasticizer is 30% by mass or more, the fixing liquid is hardly foamed with only the fatty acid salt, and the foamability may be insufficient. Even when the foamability is insufficient, the foamability of the fixing liquid can be maintained by incorporating a fatty acid having the same number of carbon atoms as that of the fatty acid salt.

However, when the fatty acid content is excessively increased, the ratio of the fatty acid salt serving as a foaming agent is decreased, and the foamability may degrade again. In this case, in terms of excellence in foamability, the mole number of the fatty acid salt may be adjusted to be higher than the mole number of the fatty acid, and the molar ratio of the fatty acid to the fatty acid salt may be controlled in the range of 5:5 to 1:9.

Not only a combination of a fatty acid and a fatty acid salt each having the same number of carbon atoms, for example, but also a combination in which a fatty acid salt and a fatty acid each having a different number of carbon atoms within the range of 12 to 18 may be employed, such as a combination in which the fatty acid salt is myristic acid amine and the fatty acid is stearic acid; and a combination in which the fatty acid salt is potassium palmitate and the fatty acid is steric acid. By incorporating a fatty acid having carbon atoms in the range of from 12 to 18 into the fixing liquid, the fixing liquid will be excellent in foam stability and capable of foaming in extremely low density, without degrading the foamability.

In terms of capability of preventing the foamability from degrading, another anionic surfactant (e.g., alkyl ether sulfate (AES)) is used as a foaming agent, and a fatty acid having 12 to 18 carbon atoms may be further incorporated in the fixing liquid.

<<Diluent>>

The diluent contained in the fixing liquid in the present invention is not particularly limited as long as it contains water. For example, preferred diluents are water, an aqueous solvent in which alcohols are added to water. As water, for example, pure water such as ion exchanged water, ultrafiltrated water, reverse osmosis water, and distilled water; or ultrapure water can be used.

When an aqueous solvent is used as the diluent, surfactants may not be added to the aqueous solvent. Especially, it is preferable to control the surface tension of the fixing liquid from 20 mN/m to 30 mN/m. As the alcohols, in terms of increasing the stability of foams in the foam-like fixing liquid and preventing foams from being broken, mono-alcohol such as cetanol; and polyhydric alcohols (e.g., ethylene glycol, diethylene glycol, triethylene glycol, polyethylene glycol, propylene glycol, dipropylene glycol, tripropylene glycol, 1,3-butylene glycol, and glycerin) are preferable. By incorporating these mono or polyhydric alcohols into the fixing liquid, the fixing liquid will have an effect of preventing curling of recording media such as paper.

It is also preferable that the diluent contains oil components to be formed into an O/W emulsion or a W/O emulsion, for the purpose of improving the permeability, and preventing curling of recording media such as paper. As the oil components, known material can be used. In the case of a diluent containing oil components, and emulsion may be formed using a dispersant. As the dispersant for use in forming this emulsion, various known material an be used, however, preferred are sorbitan fatty acid esters (e.g., sorbitan monooleate and sorbitan monostearate, and sorbitan sesquioleate); and saccharose (e.g., saccharose laurate, and saccharose stearate).

The method of dispersing a fixing liquid in the form of an emulsion using a dispersant is not particularly limited, and various known methods can be used. For example, there may be exemplified mechanically stirring units such as a homomixer having rotatable blades, and a homogenizer, and units rendering a vibration such as a ultrasonic wave homogenizer. Among these, a method of applying a strong shearing force to the softening agent in the fixing liquid is preferable.

Further, embodiment of a fixing device according to the present invention will be described in detail based on drawings.

<Fixing Device>

<<Fixing Method and Fixing Device in the Case Foam-Like Fixing Liquid is Used>>

—Fixing Method and Fixing Device—

The fixing method in the case of using a foam-like fixing liquid includes a foam-like fixing liquid generation step, a film thickness controlling step, and a foam-like fixing liquid applying step, and further includes other steps as required.

The fixing device in the case of using a foam-like fixing liquid includes a foam-like fixing liquid generation unit, a foam-like fixing liquid applying unit, and a film thickness controlling unit, and further includes other units as required.

—Foam-Like Fixing Liquid Generation Step and Foam-Like Fixing Liquid Generation Step—

The foam-like fixing liquid generating step is step of foaming a fixing liquid to generate a foam-like fixing liquid, and is performed by a foam-like fixing liquid generation unit.

Figure 13:
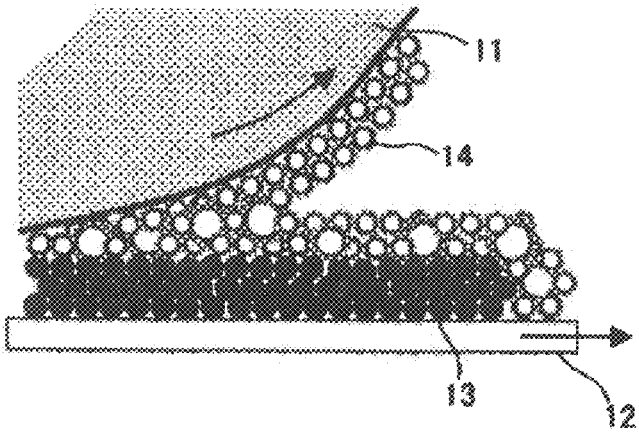
FIG. 13 is a schematic cross-sectional view illustrating the appearance where a toner is fixed after a fixing liquid is applied to the toner in a fixing method according to the present invention.

As illustrated in FIG. 13, by forming a fixing liquid into a foam-like fixing liquid 14 composed of foams by the foam-like fixing liquid generation unit, the bulk density of the fixing liquid can be reduced, and the thickness of a fixing liquid layer provided on a coating roller 11 can be increased. Further, since the influence of the surface tension of the fixing liquid can be suppressed, the foam-like fixing liquid 14 can be uniformly applied onto a toner image (hereinafter, may be referred to as "resin fine particle layer") 13 on a recording medium 12 while preventing offset of the toner on a coating roller 11.

Figure 14:
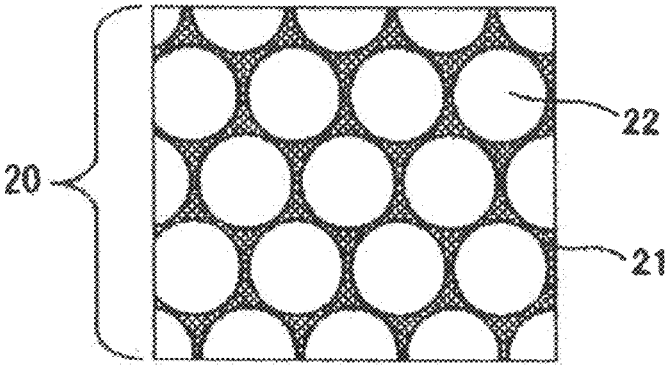
FIG. 14 is a schematic cross-sectional view illustrating the constitution of a foam-like fixing liquid.

FIG. 14 is a schematic view illustrating a layer configuration example of the foam-like fixing liquid when the foam-like fixing liquid is applied. A liquid 21 illustrated in the same figure contains a softening agent and is in the form of foams 22 in a liquid. By incorporation of the foams 22 in a large amount, the bulk density of the foam-like fixing liquid 20 can be significantly reduced. With this configuration, the foam-like fixing liquid 20 has a low bulk density and a small coat weight even when the fixing liquid is applied in a large volume during the application of the fixing liquid, and when the foams 22 are broken thereafter, the actual coat amount can be extremely reduced. The term "foam-like" in the present invention means a state where foams are dispersed in a liquid and the liquid takes on compressibility.

The foam-like fixing liquid generation step and the foam-like fixing liquid generation unit are not particularly limited, as long as the above-mentioned fixing liquid of the present invention can be formed into foams to generate a foam-like fixing liquid. One aspect thereof will be described with reference to FIG. 15.

Figure 15:
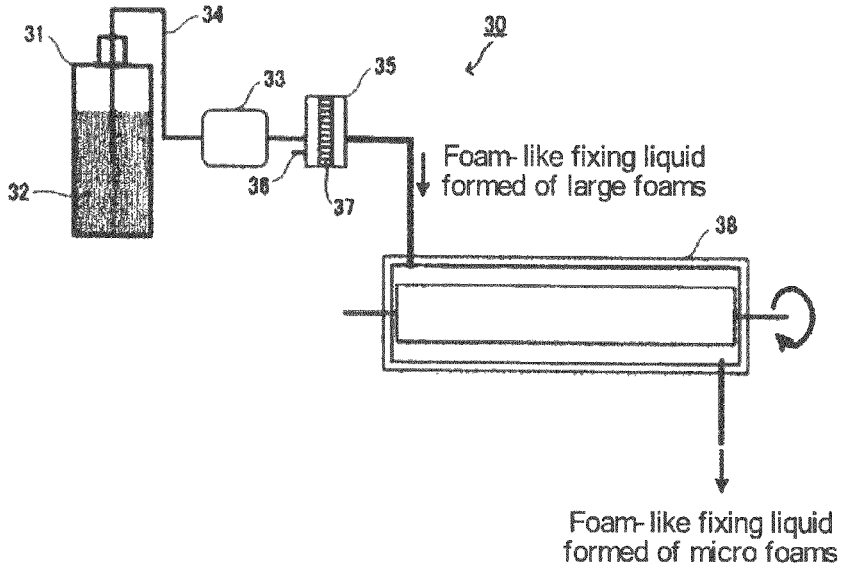
FIG. 15 is a schematic view illustrating one example of the construction of a foam-like fixing liquid generation unit in a fixing device for carrying out a fixing method according to the present invention.

FIG. 15 is a schematic view illustrating the construction of a foam-like fixing liquid generation unit provided to a fixing device of the present invention. A foam-like fixing liquid generation unit 30 illustrated in FIG. 15 includes a fixing liquid container 31 to store a fluid-form fixing liquid 32 such as the fixing liquid in the present invention, a pipe 34 through which the fluid-form fixing liquid 32 is conveyed, a conveyance pump 33 for obtaining a driving force to convey the fluid-form fixing liquid 32, a gas-liquid mixing unit 35 for mixing a gas and a liquid, and a foam generation unit 36 for foaming the fluid-form fixing liquid 32 to obtain a desired foam-like fixing liquid.

The fluid-form fixing liquid 32 stored in the fixing liquid container 31 is conveyed through the liquid conveyance pipe 34 by a driving force from the conveyance pump 33 and then conveyed to the gas-liquid mixing unit 35. the conveyance pump is not particularly limited as long as capable of conveying the fluid-form fixing liquid. For example, a gear pump and bellows pump are exemplified; however, a tube pump is preferable. With provision of a vibration mechanism such as a gear pump, there is a concern that the fixing liquid foams in the pump and has compressibility, and the transportability degrades. Also, there is a concern that the mechanism components contaminate the fixing liquid and reversely, the fixing liquid deteriorates the mechanism components. A tube pump is a mechanism to push out a liquid inside while being deformed, and thus member contacting the fixing liquid is only the tube. By using a material having liquid resistance to the fixing liquid, contamination of liquid and deterioration of pump components do not occur. In addition, by only deforming the tube, the liquid is not foamed and the degradation of the transportability of the fixing liquid can be prevented.

The gas-liquid mixing unit 35 is provided with an air opening 36, a negative pressure is generated in the air opening 36 together with the flow of the liquid, a gas is introduced from the air opening 36 into the gas-liquid mixing unit 35, and the liquid and the gas are mixed. Further, the liquid and the gas pass through a micro-pore sheet 37, and thereby large foams uniform in foam diameter can be generated. The pore diameter is preferably 30 μm to 100 μm. The micro-pore sheet is not limited to the micro-pore sheet 37 in FIG. 15, it may be a porous member having a consecutive foam structure, and may be a sintered ceramics plate and an unwoven cloth, and a Styrofoam resin sheet. As another method of generating large foams, there may be a configuration in which while the fluid-form fixing liquid supplied from the conveyance pump and air introduced from the air opening being agitated with an agitator, and large foams are generated while involving foams in the liquid; and a configuration of generating large foams by performing bubbling of the fluid-form fixing liquid supplied from the conveyance pump by an air supply pump or the like.

Next, the fluid-form fixing liquid 32 mixed with air is fed to a foam generation unit 38 for obtaining a desired foam-like fixing liquid. In the foam generation unit 38, the fluid-form fixing liquid 32 mixed with air is applied with a shearing force and a large foam is divided into two or more foams. The construction of the foam generation unit 38 is not particularly limited as long as capable of performing the above process. However, it may be configured such that it has a closed double cylinder and an inside cylinder is rotatable, a large foam-like fixing liquid is supplied from a part of the outer cylinder, a shearing force is received from the rotatable cylinder while passing through a space between the inside rotatable cylinder and the outer cylinder (flow path). With this shearing force, large foams change into microscopic foams, and a foam-like fixing liquid including a desired microscopic foam diameter can be obtained from an outlet provided on the outer cylinder.

Further, a spiral groove may be provided on the inside cylinder to increase the liquid transportability in side the cylinder.

The fixing liquid is sufficient to be formed in foams when applied to a resin fine particle layer such as toner on a recording medium (e.g., paper), is not necessarily formed in foams in the fixing liquid container. A configuration is preferable to provide such a unit that in the fixing liquid container, the fixing liquid is a liquid containing no foams therein, and is foamed at the point of supplying the liquid from the container and in the conveyance passage to be applied to the resin fine particle layer. This is because a configuration where the fixing liquid is in a liquid state in the fixing liquid container and is formed into foams after the liquid is taken out from the container, is greatly advantageous in that the container can be reduced in size.

The fixing liquid is formed into foams, and the thickness of a foam-like fixing liquid layer formed of the foamed fixing liquid on a surface of the foam-like fixing liquid applying unit as described below which applies the fixing liquid to the entire surface of the recording layer is adjusted depending on the thickness of the resin fine particle layer to be fixed. For example, when the resin fine particles constitute a toner an a color image and a monochrome image are mixed on a recording medium, the entire surface of the recording medium is provided with a foam-like fixing liquid having the same thickness, a thick toner layer such as a color photographic image may cause fixing defects and image dropout, or monochrome character portion causes partial defects such as tackiness and printed images adhere to each other.

Typically, in the case of large foams of about 0.5 mm to about 1 mm in size, the large foams are easily generated relatively by merely agitating the liquid, in a short time of several seconds or shorter (for a time not more than 0.1 seconds). Then, focusing on forming large foams which can be visually observed easily and speedy, the present inventors carried out extensive examinations to find a method of quickly forming microscopic foams of about 5 μm to about 50 μm from large foams, and found that large foams are divided by applying a shearing force, thereby microscopic foams having a desired size can be generated extremely faster than the method of foaming microscopic foams from a liquid as described above. In this point, the configuration of the foam-like fixing liquid generation unit 30 is suitable for realizing this.

As described above, by combining a large foam generation unit which changes the fluid-form fixing liquid into a liquid having large foams and a microscopic foam generation unit which generates microscopic foams, it is possible to change the fluid-form fixing liquid to generate a foam-like fixing liquid having microscopic foams of 5 μm to 50 μm in an extremely short time.

Particularly when the average particle diameter of the resin fine particles is about 5 μm to about 10 μm, to apply the foam-like fixing liquid 14 to the resin fine particle layer 13 without disturbing the resin fine particle layer 13 on the recording medium 12, the diameter of foams of foam-like fixing liquid 14 is preferably in the range of 5 μm to 50 μm. As illustrated in FIG. 14, the foam-like fixing liquid 20 formed of the foams 22 is made of a liquid 21 dividing the foam 22 into individual foams.

—Film Thickness Controlling Step and Film Thickness Controlling Unit—

The film thickness controlling step in the fixing method according to the present invention is a step of forming a foam-like fixing liquid in a desired thickness on a contact surface of a foam-like fixing liquid applying unit, and cay be performed by a film thickness controlling unit, The film thickness controlling unit is not particularly limited, as long as capable of forming a foam-like fixing liquid in a desired thickness on a contact surface of the foam-like fixing liquid applying unit, and may be suitably selected in accordance with the intended use. For example, a combination of a film thickness controlling blade, a blade and a coating roller is exemplified. Note that aspects of the film thickness controlling step and the film thickness controlling unit are described later.

—Foam-Like Fixing Liquid Applying Step and Foam-Like Fixing Liquid Applying Unit—

The foam-like fixing liquid applying step in the fixing method according to the present invention is a step of applying the foam-like fixing liquid formed in a desired thickness onto a resin fine particle layer (toner layer) on the recording medium, and is performed by a foam-like fixing liquid applying unit.

Figure 16A:
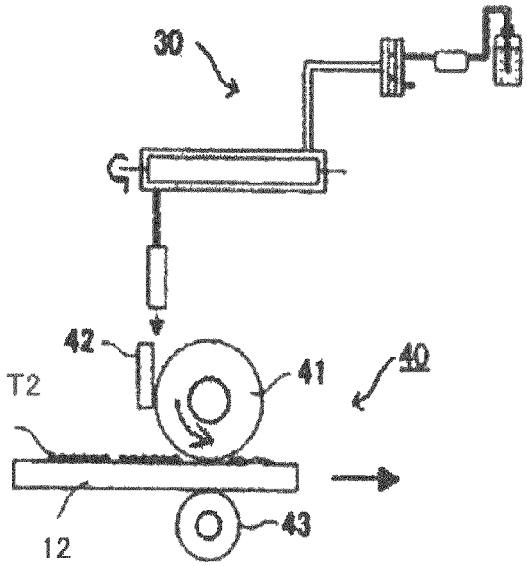
FIG. 16A is a schematic block view illustrating one example of a foam-like fixing liquid-generation unit and a foam-like fixing liquid-applying unit in a fixing device for carrying out a fixing method according to the present invention.
Figure 16B:
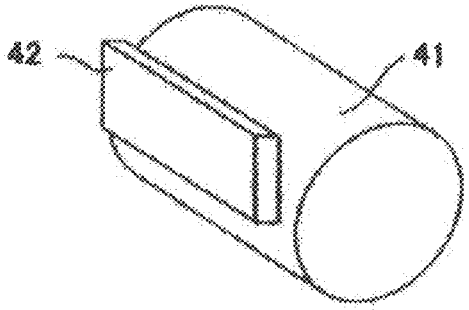
FIG. 16B is an enlarged view of a part of the units of FIG. 16A.

FIG. 16A and FIG. 16B are respectively a schematic view illustrating one example of the film thickness controlling unit and foam-like fixing liquid applying unit in the fixing device according to the, present invention. A fixing device 40 of the present invention illustrated in FIG. 16A includes a coating roller 41 for applying the foam-like fixing liquid formed of desired microscopic foams generated by the foam-like fixing liquid generation unit 30 onto a resin fine particle layer (toner particle layer) constituting a toner; a film thickness controlling blade 42 serving as a film thickness controlling unit configured to control the film thickness of the foam-like fixing liquid formed of a desired microscopic foam on the surface of a coating roller according to the thickness of an unfixed toner layer on a recording medium 12 to provide an optimum film thickness of the foam-like fixing liquid, and a pressure roller 43 disposed facing to the coating roller 41.

The recording medium 12 having on its surface an unfixed toner T2 (made of resin fine particles) passes a nip part constituted by the coating roller 41 and the pressure roller 43. Meanwhile, the foam-like fixing liquid generated by the foam-like fixing liquid generation unit 30 is subjected to film thickness adjustment by the film thickness controlling blade 42 and then disposed as a foam-like fixing liquid layer having a desired thickness on the coating roller 41. The foam-like fixing liquid layer formed on the coating roller 41 is applied onto the unfixed toner T2 in synchronization with the timing when the recording medium 12 having on its surface the unfixed toner T2 passes through the nip part.

FIG. 16B is an enlarged schematic view of the coating roller 41 and the film thickness controlling blade 42. On the coating roller 41 constituting the foam-like fixing liquid applying unit, the foam-like fixing liquid layer is formed through the film thickness controlling blade 42 serving as the film thickness controlling unit, according to the thickness of the unfixed toner T2 on the recording medium 12. By the film thickness controlling blade 42 serving as a film thickness controlling unit, the fixing liquid layer will have a thickness optimized with respect to the size of foams of the foam-like fixing liquid, the viscosity of foams, applied coating pressure, and the permeation time of the foam-like fixing liquid to the unfixed toner layer corresponding to the thickness of the unfixed toner layer, the foam-like fixing liquid formed of microscopic foams having a desired size is generated by the foam-like fixing liquid generating unit 30 which includes a large foam generating unit configured to generate large foams and a microscopic foam generating unit configured to divide the large foams by a shearing force to generate microscopic foam, and is dropped between the coating roller 41 and the film thickness controlling blade 42 serving as a film thickness controlling unit, from a liquid supply port.

Figure 17A:
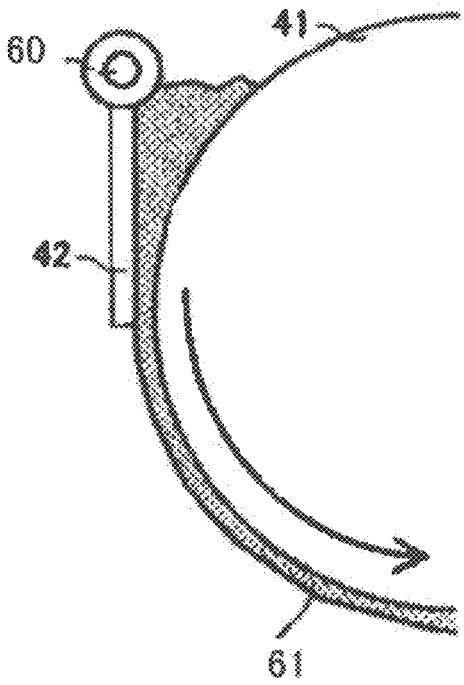
FIG. 17A is a schematic view illustrating the appearance of controlling the thickness of a film on a foam-like fixing-liquid-coating roller using a film thickness controlling blade.
Figure 17B:
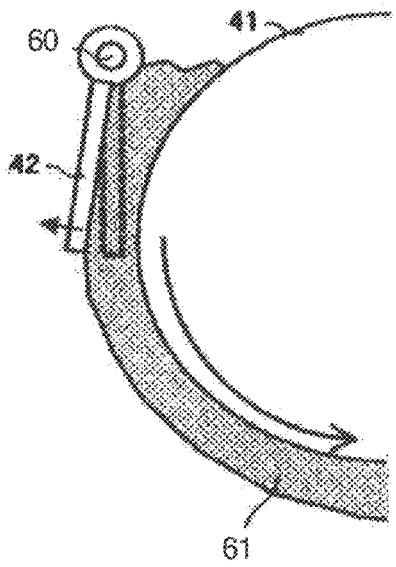
FIG. 17B is another schematic view illustrating the appearance of controlling the thickness of a film on a foam-like fixing-liquid-coating roller using a film thickness controlling blade.

As illustrated in FIGS. 17A and 17B, using the film thickness controlling blade 42 having a gap with the coating roller 41, when the film thickness is made thin, the gap may be made narrower as illustrated in FIG. 17A, and when the film thickness is made thick, the gap may be made wider, as illustrated in FIG. 17B. To adjust the gap, a rotation shaft capable of driving is used, and the film thickness of the foam-like fixing liquid may be adjusted to an optimum film thickness for adjusting the permeation time of the foam-like fixing liquid to the unfixed toner layer in accordance with the thickness of the toner layer, environmental temperature, and further the size of foams of the foam-like fixing liquid, viscosity of foams and the coating pressure The shape, structure, size and materials constituting the foam-like fixing liquid applying unit are not particularly limited, as long as the foam-like fixing liquid can be applied thereby, however, the foam-like fixing liquid applying unit preferably has, on at least a part of its surface, a curved portion.

The film thickness controlling blade may be a wire bar, besides the film thickness controlling blades illustrated in FIG. 17A and FIG. 17B. In this case, the thickness of the foam-like fixing liquid on the application roller is controlled by the wire bar. The foam-like fixing liquid is generated by a unit including a large-foam generation unit generating large foams and a unit breaking the large foams by applying a shear force thereto and dropped from an agent supply opening to a point between the wire bar and the application roller. By using the wire bar to control the agent layer thickness, a more uniform layer of the foam-like fixing liquid can be achieved in the axial direction of the application roller than with the blade.

The bulk density of the foam-like fixing liquid is preferably in the range of about 0.01 g/cm$^3$ to about 0.1 g/cm$^3$. Further, to prevent generation of residual liquid on a recording medium 12 in the application of the fixing liquid, the bulk density is preferably 0.01 g/cm$^3$ to 0.02 g/cm$^3$. The reason is that a coating roller 41 illustrated in FIGS. 16A and 16B, a foamed film of the fixing liquid on the surface of contact application unit must be thicker than the thickness of the resin fine particle layer on the recording layer (to fill the clearance of the resin fine particle layer with the foam-like fixing liquid). The thickness of the foamed film is preferably 50 μm to 80 μm. Meanwhile, to prevent generation of residual liquid on a recording medium 12 in the application of the fixing liquid, the adhesion amount of the fixing liquid is preferably 0.1 mg/cm$^2$ or less per unit area of the recording medium 12. From this point, the bulk density of foams is preferably in the range of from 0.0125 g/cm$^3$ to 0.02 g/cm$^3$.

Figure 18:
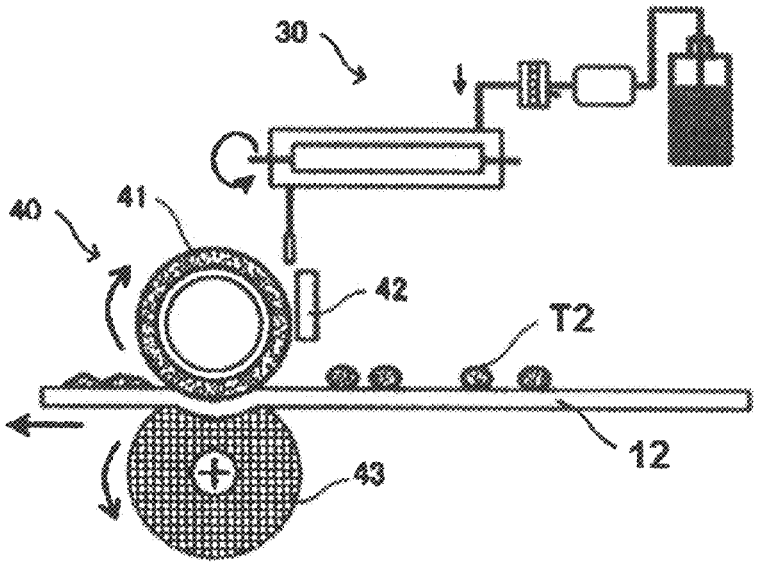
FIG. 18 is a schematic view illustrating the construction of a fixing device according to one embodiment for carrying out a fixing method according to the present invention.

FIG. 18 is a schematic view illustrating the construction of a fixing device according to one embodiment for carrying out a fixing method according to the present invention. In the fixing device 40 as an embodiment illustrated in FIG. 18, the pressure roller 43 may include a porous elastic body (hereinafter referred to as sponge) as an elastic layer. After the foam-like fixing liquid penetrates through the resin fine particle layer and reaches a recording medium 12 such as paper, it is necessary to control timing of the nip time so that the coating roller and the resin fine particle layer separate from each other. In this point, sponge-made pressure roller 43 is preferable in that it ensures the nip time in the range of 50 mill seconds to 300 mill seconds and is largely deformable by a weak pressure force.

The nip time is calculated by dividing a nip width by a conveyance rate of a paper sheet. The conveyance rate is obtained by using design data of a drive mechanism for conveying paper sheets. The nip width is obtained by pinching a paper sheet between the coating roller 41, which is entirely colored with a non-dry pigmented coating, and the pressure roller 43 opposing the coating roller 41, pressing the paper sheet therebetween (without rotating the rollers) to attach the pigmented coating to the paper sheet, and measuring a length of the colored portion (generally colored in a rectangular shape) of the paper sheet in the direction of conveying the paper sheet.

By adjusting the nip width according to the conveyance rate, the nip time is set to be equal to or greater than the penetration time. In the example illustrated in FIG. 18, the pressure roller 43 includes a porous elastic body (hereinafter referred to as sponge). Therefore, the nip width is easily changed by changing a distance between the shafts of the coating roller 41 and the sponge pressure roller 43 according to the conveyance rate. Although an elastic rubber is also suitable as a substitute for the sponge, the sponge is deformed by a force smaller than with the elastic rubber, thereby ensuring a long nip width without excessively increasing the pressure force applied by the coating roller 41.

The fixing liquid contains a plasticizer (softening agent) to soften or swell resin, which may cause problems such as softening the sponge of the pressure roller when the fixing liquid is attached to the pressure roller. Therefore, it is preferable that a resin material of the sponge is not softened or swollen by the softening or swelling agent. The sponge pressure roller may be covered with a flexible film. When the pressure roller including a sponge material that deteriorates with the softening or swelling agent is covered with the flexible film that is not softened or swollen by the softening or swelling agent, degradation of the sponge pressure roller can be prevented. Preferable sponge materials include a resin porous body of, for example, polyethylene, polypropylene, or polyamide. The flexible film for covering the sponge is preferably formed of polyethylene terephthalate, polyethylene, polypropylene, or polytetrafluoroethylene-perfluoroalkyl vinyl ether copolymer (PFA).

In the configuration illustrated in FIG. 18, the coating roller 41 continuously contacts the sponge pressure roller 43. In this case, the foam-like fixing liquid on the coating roller 41 may be attached to and contaminate the sponge pressure roller 43 when the paper sheet is not conveyed. To prevent such a problem, it is preferable that a detection unit, not illustrated, that detects a leading end of a paper sheet before the paper sheet is conveyed to the coating roller 41 be provided and the foam-like fixing liquid be timely formed on the coating roller 41 based on a detection signal produced by the detection unit so that the fixing liquid is applied only from the leading end to the trailing end of the paper sheet.

In addition, in FIG. 18, it is preferable that the coating roller 41 be separated from the sponge pressure roller 43 while not in use and the coating roller 41 contact the sponge pressure roller 43 in applying the fixing liquid in response to the detection signal from the detection unit detecting the leading end of a paper sheet by using a drive mechanism, not shown. In this case, it is also preferable that the trailing end of the paper sheet be detected to separate the coating roller 41 from the sponge pressure roller 43 in response to detection of the trailing end.

Figure 19:
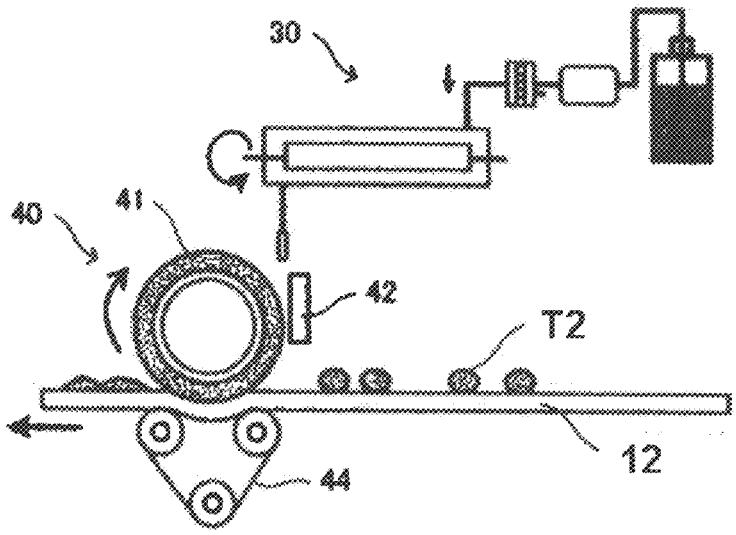
FIG. 19 is a schematic view illustrating the construction of a fixing device according to another embodiment for carrying out a fixing method according to the present invention.

FIG. 19 is a schematic view illustrating the construction of a fixing device according to another embodiment for carrying out a fixing method according to the present invention. As illustrated in FIG. 19, instead of using the pressure roller 43 illustrated in FIG. 18, a pressure belt 44 is used as a substitute for the pressure roller 43. A foam-like fixing liquid including small foams is generated by the foam-like fixing liquid generation unit 30 including a large-foam generation unit generating large foams and a small-foam generation unit breaking the large foams by applying a shear force thereto. The foam-like fixing liquid including foams with the desirable foam diameter is supplied from the agent supply opening of a film thickness controlling blade 42 serving as a film thickness controlling unit, via a tube. The thickness of the foam-like fixing liquid layer on the coating roller 41 is controlled by controlling the gap between the film thickness controlling blade 42 and the coating roller 41, thereby achieving an optimum thickness of the foam-like fixing liquid. As the pressure belt 44, a member including a substrate, such as a seamless nickel belt or a seamless polyethylene terephthalate (PET) film, coated with a releasing fluororesin such as PFA is used.

The nip width is easily widened by using the pressure belt 44. The configuration using the pressure belt 44 is not limited to the configuration illustrated in FIG. 19. It is also preferable that a roller be used instead of a belt on the pressing side. Also, it is preferable that a roller be used on the application side and a belt be used on the pressing side. By using a belt on at least one of the application side and the pressing side, the nip width is easily widened, an unnecessary force causing a crease on a paper sheet is not generated, and the conveyance rate of paper sheets is increased for the same nip time, thereby enabling high-speed fixing.

Further, the toner fixing device may include a pair of smoothing rollers (hand rollers) at least a part of which presses softened or swollen toner after the toner fixing device supplies the fixing liquid in the present invention. By pressing the softened or swollen toner, it is possible to smooth the surface of the softened or swollen toner layer and to impart the glossiness to the toner. Further, by pressing the softened or swollen toner against a recording medium, the toner fixability to the recording medium can be improved.

<Other Steps and Other Units>

<<Heating Step and Heating Unit>>

The fixing method and fixing device of the present invention may further include a heating step of warming the resin fine particle layer having the foam-like fixing liquid provided thereon and a heating unit. The temperature used for the heating step and heating unit is not particularly limited, as long as sufficient fixability can be obtained. For example, it is preferably 50° C. to 100° C. When the heating temperature is lower than 50° C., the toner may be insufficiently fixed, and when it is higher than 100° C., it is uneconomical in terms of energy consumption.

Figure 20:
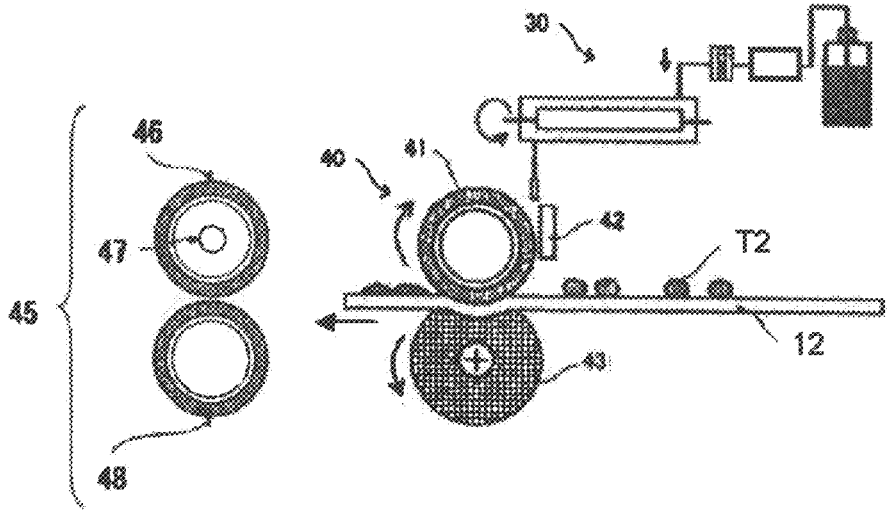
FIG. 20 is a schematic view illustrating the construction of a fixing device according to still another embodiment for carrying out a fixing method according to the present invention.

The form of the heating unit may be suitably selected, such as a roller, as long as the above-mentioned aspect can be conducted. When a roller is employed as the heating unit, for example, as illustrated in FIG. 20, the fixing device may be a fixing device 45 which includes pressure rollers 46 and 48 and is mounted with a heating medium such as an infrared heater 47 as a roller contacting with a fixing target.

(Image Forming Method)

An image forming method according to the present invention uses the fixing method of the present, and an image forming apparatus according to the present invention uses a fixing device in which the fixing method of the present invention is converted into a tangible form.

The image forming method of the present invention includes a charging step for uniformly charging the surface of a latent electrostatic image bearing member (hereinbelow, which may be simply referred to as "latent image bearing member"); an exposing step for exposing the surface of the charged latent image bearing member based on image data to write an electrostatic latent image (latent electrostatic image forming step); a developing step for forming a developer layer having a predetermined layer thickness on a developer bearing member by a developer layer regulating member and developing, via the developer layer, an electrostatic latent image formed on the surface of the latent image bearing member so as to form a visible image (toner image); a transferring step for transferring the visible image on the surface of the latent image bearing member onto a transfer material (recording medium); and a fixing step for fixing the visible image on the transfer material. That is, the image forming method of the present invention includes at least a latent electrostatic image forming step, a developing step, a transferring step and a fixing step and further includes other steps suitably selected as required, for example, a charge elimination step, a cleaning step, a recycling step, and a controlling step. Then, the fixing step is carried out by the fixing method of the present invention. Note that the developing step is realized by a developing unit which includes a developer bearing member which carries, on its surface, a developer to be supplied to the latent electrostatic image bearing member, a developer supply member which supplies the surface of the developer bearing member with the developer and a developer housing for accommodating the developer containing a toner and which is configured to develop the latent electrostatic image using the developer to form a toner image.

The image forming apparatus of the present invention includes at least a latent electrostatic image bearing member (hereinbelow, which may be simply referred to as "latent image bearing member") which carries a latent electrostatic image, a charging unit configured to uniformly charge the surface of the latent image bearing member, an exposing unit (latent electrostatic image forming unit) configured to expose the charged surface of the latent electrostatic image bearing member based on image data to write a latent electrostatic image, a developing unit configured to supply a toner to the latent electrostatic image formed on the surface of the latent image bearing member so as to form a visible image (toner image), a transfer unit configured to transfer the visible image on the surface of the latent image bearing member to a transfer material (recording medium), and a fixing unit configured to fix the visible image on the transfer material (recording medium), and further includes other units suitably selected as required, for example, such as a charge eliminating unit, a cleaning unit, a recycling unit, and a controlling unit. The toner is a toner according to the present invention. More specifically, the developing unit includes a which carries, on its surface, a developer to be supplied to the latent electrostatic image bearing member, a developer supply member which supplies the surface of the developer bearing member with the developer and a developer housing for accommodating the developer containing a toner and which is configured to develop the latent electrostatic image using the developer to form a toner image.

The formation of a latent electrostatic image can be performed, for example, by uniformly charging a surface of the latent image bearing member and then exposing the surface of the latent image bearing member imagewise.

The formation of a visible image in the developing step can be performed as follows: a toner layer is formed on a developer roller as the developer bearing member, the toner layer on the developer roller is conveyed to be brought into contact with a photoconductor drum serving as the latent image bearing member, and a latent electrostatic image on the photoconductor drum is developed. The toner is stirred by a stirring unit and mechanically supplied to the developer supply member. The toner which is supplied from the developer supply member and accumulates on the developer bearing member passes the developer layer regulating member disposed so as to be contact with the surface of the developer bearing member to thereby formed into a thin layer having a uniform thickness, and is then charged. The latent electrostatic image formed on the latent image bearing member is developed by attaching a toner charged in a developing area by the developing unit thereto.

The transfer of a visible image can be performed, for example, by charging the visible image on the surface of the latent image bearing member (photoconductor) using a transfer charger and can be performed by the transfer unit.

The fixing of the transferred visible image can be perfumed by fixing the visible image on the recording medium using the fixing unit, and the fixing may be carried out for each color toner at every transferring onto the recording medium or may be carried out for color toner images all together in a state where all the color toners are superimposed. As the fixing device, a fixing device by which the fixing method of the present invention can be implemented may be directly employed.

Hereinafter, the basic construction of an image forming apparatus (printer) according to the embodiment of the present invention will be described with reference to FIGS. 21 and 22.

Figure 21:
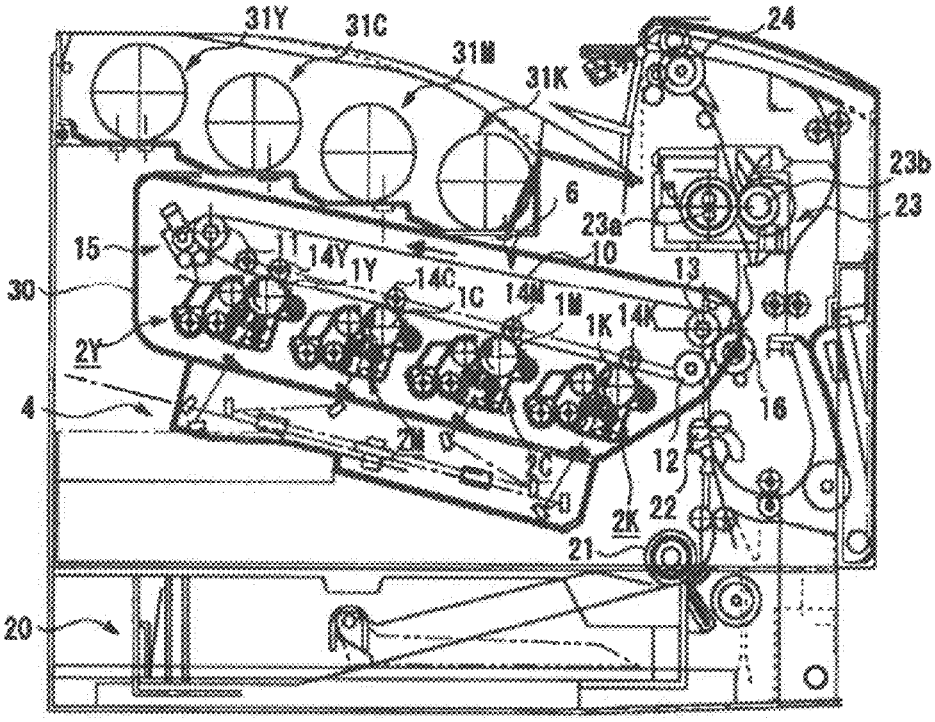
FIG. 21 is a schematic view illustrating the construction of an image forming apparatus according to one embodiment of the present invention.

FIG. 21 is a schematic view illustrating the construction of an image forming apparatus according to one embodiment of the present invention. The following describes one embodiment of an electrophotographic image forming apparatus. The image forming apparatus is the one for forming a color image composed of four color toners of yellow (hereinafter, abbreviated as "Y"), cyan (hereinafter, abbreviated as "C"), magenta (hereinafter, abbreviated as "M") and black (hereinafter, abbreviated as "K").

First, the following describes the basic configuration of an image forming apparatus ("tandem-type image forming apparatus") in which a plurality of latent image bearing members are arranged in parallel along the moving direction of a member having a movable surface. This image forming apparatus is provided with four photoconductors 1Y, 1C, 1M and 1K as latent image bearing members. In the present embodiment, the photoconductors are drum-shaped, for example. Alternatively, belt-like photoconductors may also be employed. Being in contact with an intermediate transfer belt 10, which is a member having a movable surface, the photoconductors 1Y, 1M, 1C, and 1K are driven to rotate in the direction indicated by the arrow in FIG. 21. as the intermediate transfer belt 10 at respective contact positions at which the photoconductors 1Y, 1M, 1C, and 1K are in contact with the intermediate transfer belt 10. That is, the intermediate transfer belt 6*a* is driven to rotate in the counterclockwise direction. In each of the photoconductors 1Y, 1M, 1C, and 1K, a photosensitive layer is formed on a cylindrical shape conductive substrate having a relatively thin thickness, and a protective layer is further formed on the photosensitive layer. In addition, an intermediate layer may be provided between the photosensitive layer and the protective layer.

Figure 22:
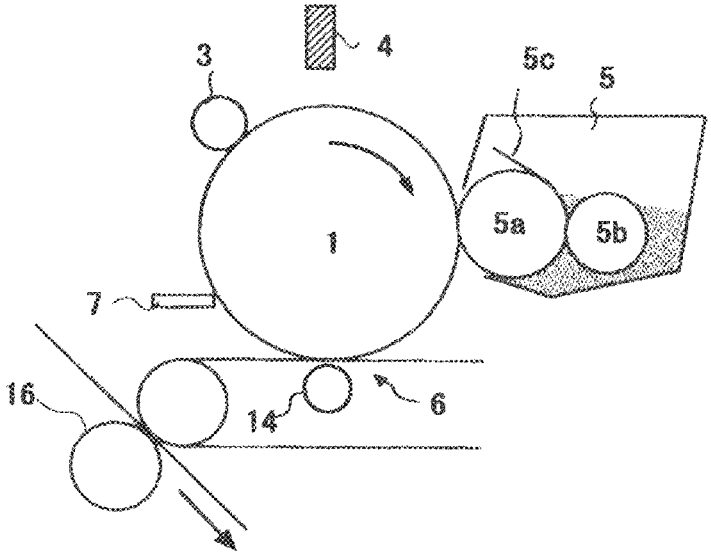
FIG. 22 is an enlarged view of an image forming unit which is a part of the image forming apparatus of FIG. 21.

FIG. 22 illustrates the construction of an image forming unit 2 in which the photoconductor is provided. Note that since the components provided around each of the photoconductors 1Y, 1C, 1M, and 1K in image forming units 2Y, 2C, 2M, and 2K are identical, only one image forming unit 2 is illustrated, and reference numerals for differently colored components are omitted. The image forming unit 2 include a photoconductor 1, and there are provided, around the photoconductor 1, a charging device 3, a developing device 5, a transfer device 6 and a cleaning device 7 in the mentioned order. The charging device serves as a charging unit, the developing device 5 serves as a developing unit, the transfer device serves as a transfer unit for transferring a toner image on the photoconductor 1 onto a recording medium or an intermediate transfer member 10, and the cleaning device 7 removes untransferred toner remaining on the photoconductor 1. Between the charging device 3 and the developing device 5, a space is secured so that light emitted from an exposing device 4 serving as an exposing unit configured to expose the charged surface of the photoconductor 1 imagewise based on image data to write a latent electrostatic image can pass through to the photoconductor 1.

The charging device 3 charges the surface of the photoconductor 1 to the negative polarity. The charging device 3 in the present embodiment includes a charging roller serving as a charging member which performs a charging process in a so-called contact or proximity charging method. That is, the charging device 3 brings the charging roller into contact or proximity with the surface of the photoconductor 1, and applies a negative polarity bias voltage to the charging roller. Thereby, the surface of the photoconductor 1 is charged. The charging roller is applied with a direct-current charging bias voltage such that the photoconductor 1 is charged to have a surface potential of approximately −500V.

As the charging bias voltage, a direct-current bias voltage superimposed with an alternating-current bias voltage may also be used. The charging device 3 also includes a cleaning brush which cleans a surface of the charging roller. The cleaning device 3 may be configured such that a thin film is wound around opposite end portions on the circumferential surface of the charging roller in the axial direction thereof, and the thus configured charging device 3 may be provided to be in contact with the surface of the photoconductor 1. With this configuration, the surface of the charging roller and the surface of the photoconductor 1 are substantially proximate to each other, with the two surfaces apart from each other by a distance corresponding to the thickness of the film. Accordingly, electrical discharge is generated between the surface of the charging roller and the surface of the photoconductor 1 by a charge bias applied onto the charging roller, and the surface of the photoconductor 1 is charged by the electrical discharge.

The surface of the photoconductor 1 charged as described above is exposed by an exposing device 4, and thereby a latent electrostatic image of the corresponding each color is formed on the surface of the photoconductor 1. On the basis of image information of the corresponding color, the exposing device 4 emits scanning light of the corresponding color to the photoconductor 1 of the corresponding color. Thereby, an electrostatic latent image of the corresponding color is written on the photoconductor 1. The exposure device 4 of the present embodiment is an exposure device using a laser system. Alternatively, an exposure device using another system, such as an exposure device including an LED (Light-Emitting Diode) array and an imaging device, may also be employed.

Each color toner supplied into a developing device 5 (a part of which functions as a developer housing) from toner bottles 31Y, 31C, 31M, and 31K is conveyed by a supply roller (developer supply member) 5*b* and is carried on a developing roller (developer bearing member) 5*a*. The toner on the developer roller 5*a* is conveyed in a developing area provided facing to the photoconductor 1. In the developing area in which the developing roller 5*a* faces the photoconductor 1 (hereinbelow, referred to as "developing area"), the surface of the developing roller 5*a* moves in the same direction as the surface of the photoconductor 1 at a linear velocity faster than the linear velocity of the surface of the photoconductor 1. Then, the toner on the developing roller 5*a* is supplied to the surface of the photoconductor 1, while rubbing against the surface of the photoconductor 1. In this process, the developing roller 5*a* is applied with a developing bias voltage of approximately −300 V from a power supply (not illustrated). Thereby, a developing electric field is formed in the developing area. Then, between the latent electrostatic image on the photoconductor 1 and the developing roller 5*a*, an electrostatic force which faces toward the latent electrostatic image works on the toner on the developing roller 5*a*. With this, the toner on the developing roller 5*a* is attached to the latent electrostatic image on the photoconductor 1. By the attachment of the toner, the latent electrostatic image on the photoconductor 1 is developed into a toner image of the corresponding color.

An intermediate transfer belt 10 of the transfer device 6 is configured to be stretched over three support rollers 11, 12 and 13 and circularly move in the direction indicated by the corresponding arrow in FIG. 21. The respective toner images on the photoconductors 1Y, 1M, 1C, and 1K are sequentially transferred to the intermediate transfer belt 10 from the upstream side in accordance with an electrostatic transfer method to be superimposed on one another. Some configurations according to the electrostatic transfer method use transfer chargers. The present embodiment, however, employs a configuration using a transfer rollers 14, which generates a relatively small amount of transfer dust. Specifically, primary transfer rollers 14Y, 14C, 14M, 14K each serving as a transfer device 6 are provided on respective portions of the back surface of the intermediate transfer belt 10 in contact with the photoconductors 1Y, 1M, 1C, and 1K. In the present embodiment, the photoconductors 1Y, 1M, 1C, and 1K and the respective portions of the intermediate transfer belt 10 pressed by the primary transfer rollers 14Y, 14C, 14M, and 14K form respective primary transfer nip parts. In the transfer process of the respective toner images on the photoconductors 1Y, 1M, 1C, and 1K to the intermediate transfer belt 10, the primary transfer rollers 14Y, 14C, 14M, and 14K are applied with a positive polarity bias voltage. Thereby, a transfer electric field is formed in the respective primary transfer nip parts in which the primary transfer process is performed. Further, the toner images on the photoconductors 1Y, 1M, 1C, and 1K electrostatically adhere to the intermediate transfer belt 10 to be transferred thereto.

At a position around the intermediate transfer belt 10, a belt cleaning device 15 is provided to remove toner remaining on the surface of the intermediate transfer belt 10. The belt cleaning device 15 is configured to collect unnecessary toner adhering to the surface of the intermediate transfer belt 10 by using a fur brush and a cleaning blade. The collected unnecessary toner is conveyed from the belt cleaning device 15 to a waste toner tank (not illustrated) through a conveying device (not illustrated).

A portion of the intermediate transfer belt 10 stretched by the support roller 13 is in contact with a secondary transfer roller 16. Between the intermediate transfer belt 10 and the secondary transfer roller 16, a secondary transfer nip part is formed. A transfer paper sheet as a recording medium is conveyed into the secondary transfer nip part at predetermined timing. The transfer paper sheet is stored in a sheet feeding cassette 9 provided below the exposing device 4 in FIG. 21, and is conveyed to the secondary transfer nip part by a paper feeding roller 21, a registration roller pair 22, and so forth. Then, in the secondary transfer nip part, the toner images superimposed on the intermediate transfer belt 10 are transferred at one time to the transfer paper sheet. In the secondary transfer process, the secondary transfer roller 16 is applied with a positive polarity bias voltage. Thereby, a transfer electric field is formed, and the toner images on the intermediate transfer belt 10 are transferred to the transfer paper sheet due to the transfer electric field.

On the downstream side of the secondary transfer nip part in the direction to which the transfer paper sheet is conveyed, the toner image is fixed by a fixing device 23 configured to control the film thickness of a foamed fixing liquid based on image information sent from an exposing device (not illustrated). Onto the unfixed toner image which has been ejected from an image forming unit 30 and transferred onto the recording medium, a foam-like fixing liquid, in which the film thickness of a foam-like fixing liquid layer is controlled based on image information (for example, a color image or a black solid image) sent from the exposing device, is supplied from the toner fixing device. The unfixed toner image is fixed on a recording member by action of a softening agent which is contained in the foam-like fixing liquid to dissolve or swell at least a resin contained in the toner. With this, the toner image carried on the transfer paper sheet is fixed thereon. Then, the fixed transfer paper sheet is discharged on a sheet discharging tray disposed at the upper part of the image forming apparatus. Note that the fixing device 23 includes, for example, a pair of rollers 23*a* and 23*b*.

<<Fixing Method and Fixing Device Employing Spray System>>

—Fixing Method and Fixing Device—

Figure 23:
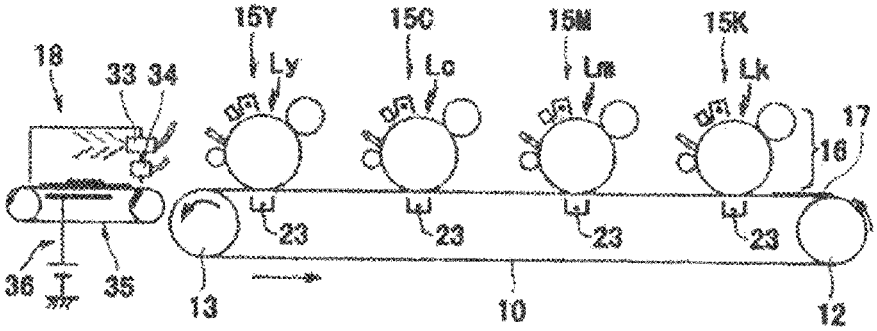
FIG. 23 is a schematic view illustrating the construction of an image forming apparatus according to another embodiment of the present invention.

FIG. 23 illustrates the constriction of main parts of an image forming apparatus such as a copier, a printer, a facsimile or a complex machine thereof. The image forming apparatus illustrated in the figure is a tandem-type color image forming apparatus employing electrophotographic process, in which an image is directly transferred onto a paper sheet serving as a recording material on a toner image on an image bearing member, without using an intermediate transfer member.

In FIG. 23, numerical reference 10 designates an endless-shaped conveyance belt. The conveyance belt 10 is provided, in the example illustrated in the figure, is stretched over a drive roller 12 and a driven roller 13 so as to be driven to rotate in the clockwise direction in the figure. The number of rollers to stretch the conveyance belt 10 thereover is not limited two rollers, and a roller for controlling the deviation of the conveyance belt 10 and a tension roller may be separately provided so that the conveyance belt 10 is stretched over three or more rollers.

Around the conveyance belt 10, four image forming units 15K, 15M, 15C, and 15Y for black, magenta, cyan and yellow colors are arranged in parallel in this order along the traveling direction of the conveyance belt 10 on a horizontally spanned portion between a drive roller 12 and a driven roller 13 to constitute a tandem image forming device 16. An exposing device and the like (although illustrated thereof is omitted) is further provided on the tandem image forming device 16.

Between the conveyance belt 10 and the tandem image forming device 16, a paper feeding path is formed for conveying paper 17, which is a recording medium from the right side to left side in FIG. 23 with the counterclockwise traveling of the conveyance belt 10. Along the paper feeding path, a not illustrated registration roller is placed at the upstream side, and a fixing device 18 is placed at the downstream side.

Figure 24:
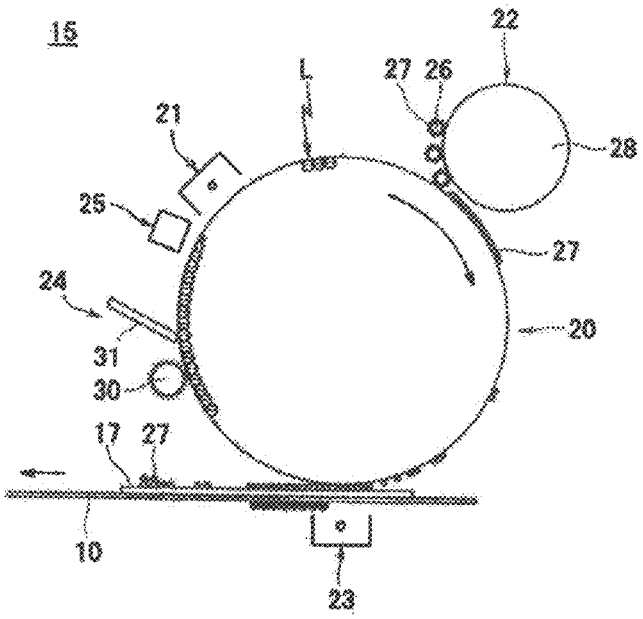
FIG. 24 is an enlarged view enlarging an image forming unit which is a part of the image forming apparatus of FIG. 23.

FIG. 24 illustrates a schematic construction of one unit of image forming unit 15 provided to the image forming apparatus illustrated in FIG. 23. Four image forming units 15K, 15M, 15C and 15Y each have the same configuration as illustrated in FIG. 24.

Reference numeral 20 in FIG. 24 is a photoconductor serving as a drum-shaped latent electrostatic image bearing member. Around the photoconductor 20, in order of the rotation direction indicated by the arrow in the figure from a charger 21 disposed at the top left side in the figure, there are provided a developing device 22, a transfer device 23, a cleaning device 24, a charge eliminating device 25, and the like.

In an example of the image forming unit illustrated in the figure, the charger 21 employs a non-contact charging process in which a charger is used to apply a uniform minus charge, however, a contact charging process using a charge roller may be employed. In the exposing device 22, a two-component developer made of a positively charged carrier 26 and a negatively charged toner 27 is used, and the two-component developer is carried on a developing sleeve (developer bearing member) 28 to make only the toner 27 adhere on the photoconductor 20 to form an electrostatic latent image on the photoconductor 20 into a visible image (toner image).

The transfer device 23 illustrated in the figure employs a non-contact and positive transfer corona charger process, a conveyance belt 10 is pinched to be arranged facing to the photoconductor 20, and other than the non-contact corona charger process, a conductive brush and a transfer roller may also be used. The cleaning device 24 is provided with a cleaning brush 30 and a cleaning blade 31. With this configuration, a toner scraped off by the cleaning brush 30 and cleaning blades 31 can be collected by a recycling screw and a toner recycling device to the developing device 22 to be recycled. In addition, as the charge eliminating device 25, a charge eliminating lamp is used, for example.

With the clockwise rotation of the photoconductor 20, the surface of the photoconductor 20 is uniformly charged by the charger 21, and the surface of the photoconductor 20 is irradiated with writing light L (In FIG. 23, Lk, Lm, Lc, and Ly) to form a latent electrostatic image on the respective photoconductors 20, and the corresponding color toner is attached by the developing device 22 to visualize the latent electrostatic image into a visible image, thereby each monochrome color toner is formed on each of the photoconductors 20.

A recording medium (recording material, paper sheet) 17 is conveyed through a paper feeding path and then fed onto a conveyance belt 10 by a registration roller in timing of the each color toner image formed on the photoconductor 20. Then, with the traveling of the conveyance belt 10, the recording material (paper sheet) 17 is further conveyed, and the respective monochrome color images are sequentially transferred onto the conveyed paper sheet 17 by each transfer device 23, and the monochrome toner images are superimposed on the paper sheet 17 to form a composite color image. The surface of the photoconductor 20 after transfer of the toner image is cleaned by the cleaning device 24, and then electric charges remaining thereon is eliminated by the charge eliminating device 25 for initialization, and is poised for subsequent image formation starting from the charger 21 again.

A negatively charged toner 27 on the paper sheet 17 on which the composite color image is to be formed is only electrically attached to the paper sheet 17 at this point in time, and thus when the charged toner receives strong impact on its surface or rubbed, it peels off from the paper sheet 17. Therefore, a paper sheet on which surface a composite color is formed, is conveyed on a conveyance belt 10 to be introduced into the fixing device 18, and then subjected to fixing of the transferred image by the fixing device 18 to be ejected to a not-illustrated paper ejection stack section.

The fixing device 18 is provided, as illustrated in FIG. 23, with a spray unit 33 configured to spray a toner fixing liquid as fixing liquid droplets; a liquid droplet charging unit 34 configured to apply a negatively charges of the same polarity as that of unfixed toner T2 to the sprayed fixing liquid droplets sprayed by the spray unit 33; a medium conveyance unit 35 configured to convey the paper sheet 17 carrying the unfixed toner T2 via an atmosphere of fixing liquid droplets to which electric charges are applied by the liquid droplet charging unit 34, and a recording material charging unit 36 configured to reversely charge the paper sheet 17 conveyed by the medium conveyance unit 35 to be positively charged to have a reverse polarity to the unfixed toner T2 and the fixing liquid droplets.

Figure 25:
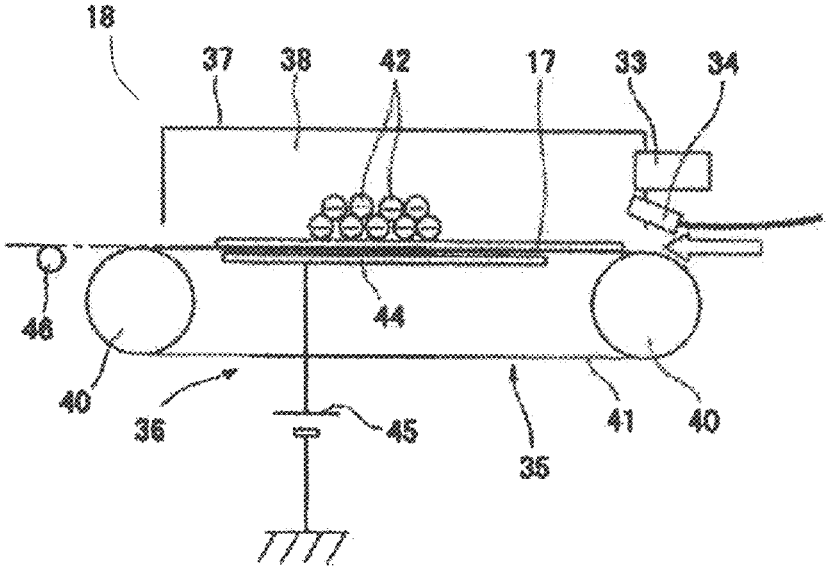
FIG. 25 is an enlarged view enlarging a fixing unit (fixing device) which is a part of the image forming apparatus of FIG. 23.

FIG. 25 is an enlarged view of the fixing device 18 illustrated in FIG. 23.

As clear from FIG. 25, the spray unit 33 is arranged facing toward the inside of a spray chamber 38 which is sectioned by a housing 37 and then stored as fixing liquid droplets having a droplet diameter of 15 μm or smaller, the toner fixing liquid stored in a not-illustrated fixing liquid reservoir is sprayed as fixing liquid droplets having a droplet diameter mode value of 15 μm or smaller, and then the spray chamber 38 is filled with fixing liquid droplets.

As the liquid droplet charging unit 34, an ionizer or the like is used to spray air ions into the spray chamber 38. The air ions are mixed with the fixing liquid droplets by the spray unit 33 so as to negatively charge the fixing liquid droplets to have the same polarity as that of unfixed toner T2. Unlike, the example illustrated in the figure, when unfixed toner is positively charged, the fixing liquid droplets are also positively charged.

The recording medium conveyance unit 35 include a plurality of rollers 40 and a conveyance belt 41 which is stretched over the plurality of rollers 40 and electrostatically attracts and conveys the paper sheet 17. Then, the paper sheet 17 carrying unfixed toner 42 including residual charges is conveyed by the conveyance belt 19 and fed into the fixing device 18 as illustrated in the figure, and then continuously conveyed from the right side to the left side in FIG. 25 by the conveyance belt 41 of the medium conveyance unit 35 in the fixing device 18 in an atmosphere including fixing liquid droplets applied with charges.

A recording medium-charging unit 36 is composed of an electrode 44 and a power supply 45 connected to the electrode 44. The electrode 44 is disposed inside the conveyance belt 41 which wound around the rollers 40. When a voltage is applied to the electrode 44 with the power supply 45, the paper 17 to be conveyed by a conveyance belt 41 is charged so as to have the positive polarity opposite to the unfixed toner T2 and the fixing liquid droplets. Needless to say, the conveyance belt 41 is made of a material which does not prevent the paper 17 from being charged. By absorbing the back surface of the paper 17 by the action of a coulomb force, the fixing liquid droplets attached on the paper 17 further penetrate the paper 17 to the back surface. As a result, the front and back surfaces of the paper 17 are made to be uniform in the liquid concentration, to thereby suppress the curling of the paper 17.

Notably, in FIG. 25, reference numeral 46 denotes a charge-eliminating roller serving as a charge-eliminating member, which comes into contact with/charge-eliminates the paper discharged from the fixing device 18. Needless to say, other types of charge-eliminating members such as brush can be used in addition to the roller.

As described above, in FIGS. 23 to 25, the fixing liquid droplets sprayed from the spraying unit 33 are charged with a droplet-charging unit 34 so as to have the same polarity as in unfixed toner T2 on the paper 17, which is then transferred with a medium-conveying unit 35 through an atmosphere of the charged fixing liquid droplets. The paper 17 to be conveyed is charged with a medium-charging unit 36 so as to have the opposite polarity to the unfixed toner T2 and the fixing liquid droplets. The unfixed toner T2 and the fixing liquid droplets 53 are forcedly adsorbed/fixed on the recording medium (paper) 17 by the action of a coulomb force.

When the toner fixing liquid is sprayed with the spray unit 33 as fixing liquid droplets whose mode value of diameter is 15 μm or smaller, the sprayed fixing liquid droplets are uniformly suspended in the atmosphere as dry mist, and all of the fixing droplets are attached evenly onto a paper 17. Since all of the fixing liquid droplets are attached onto the paper 17, the fixing liquid can be advantageously effectively used and uneven fixing can be avoided.

<<Contact-Type Fixing Method or Device>>

—Fixing Method and Device—

Figure 26:
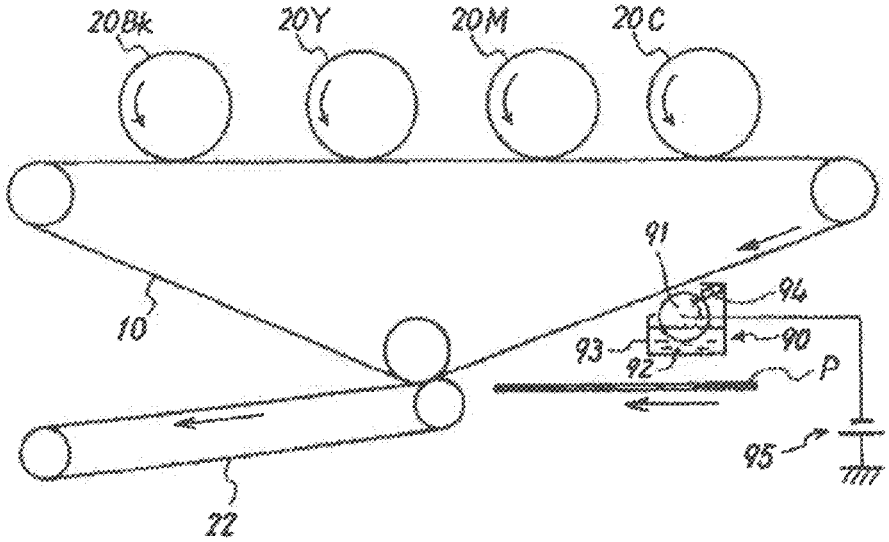
FIG. 26 is a schematic view illustrating the construction of an image forming apparatus according to still another embodiment of the present invention.

FIG. 26 illustrates a tandem color image forming apparatus based on electrophotography. This image forming apparatus is that employing an intermediate transfer member, in which a toner mage on an electrostatic image bearing member 20 is primarily transferred onto the intermediate transfer member, and then the toner image on the intermediate transfer member is secondarily transferred onto a recording medium.

FIG. 26 is schematic view of the configuration of a part including a fixing device (fixing unit) of an image forming apparatus according to this embodiment. The image forming apparatus of this embodiment includes a fixing device 90 which is disposed upstream of a secondary transfer portion in a direction in which the surface of the intermediate transfer belt 10 is moved. The fixing device 90 includes a supply roller 91 serving as a fixing liquid supplying unit (fixing liquid applying unit) which is disposed so as to face the surface of the intermediate transfer belt 10 via a fine space. The fixing device 90 is configured to be movable by an unillustrated driving mechanism, so that the supply roller 91 becomes close to or separated from the surface of the intermediate transfer belt 10. Also, the fixing device 90 includes a fixing liquid tank 93 containing a fixing liquid 92, and the supply roller 91 is disposed so that it is immersed in the fixing liquid 92. The supply roller 91 is rotated in the direction indicated by the arrow in this figure when applying the fixing liquid 92 to the toner. As a result, the fixing liquid 92 is transferred to the surface of the supply roller 91. The thus-transferred fixing liquid 92 is controlled by a metering blade 94 to appropriately adjust the amount of the fixing liquid attached onto the surface of the fixing roller 91. Then, the supply roller 91 is conveyed to a position facing the surface of the intermediate transfer belt 10 in accordance with the rotation of the supply roller 91, to thereby supply the fixing liquid to the surface of the intermediate transfer belt 10.

Also, when the supply roller 91 is used as a fixing liquid supplying unit configured to supply the fixing liquid to the toner on the intermediate transfer belt 10, the toner image on the intermediate transfer belt 10 may be disturbed. Thus, in this embodiment, the supply roller 91 used is a supply roller formed by coating a conductive material base with an insulating layer or a high-resistance layer, and the supply roller 91 is connected with a power supply 95 serving as an electrical field-applying unit. Specifically, in one employable supply roller, a conductive rubber layer is formed on a core metal made of stainless steel, and the surface of the resultant product is covered with a PFA tube. With this configuration, such an electrical field that puts toner particles toward the intermediate transfer belt is formed between the supply roller 91 and the intermediate transfer belt 10. Formation of this electrical field can increase the attracting force of the toner, present on the intermediate transfer belt 10 at the liquid supplying position, toward the intermediate transfer belt 10. In this manner, the fixing liquid 92 can be supplied to the toner without disturbing the toner image on the intermediate transfer belt 10.

Then, a recording medium bearing the toner image, to which the fixing liquid 92 has been supplied, is further conveyed to reach a position facing a fixing conveyance belt 22.

At this position, the toner image is pressed to be a completely fixed image.

Thereafter, the recording medium is further conveyed on the fixing conveyance belt 22 to be discharged outside of the image forming apparatus.

EXAMPLES

Hereinafter, the present invention will be further described in detail with reference to Examples, which however shall not be construed as limiting the scope of the present invention.

Production Example 1

Production of Binder Resin (1)

Into a reaction vessel equipped with a condenser tube, a stirrer and a nitrogen inlet tube, 173 parts by mass of ethylene oxide (2 mol) adduct of bisphenol A, 553 parts by mass of propylene oxide (2 mol) adduct of bisphenol A, 251 parts by mass of terephthalic acid, and 3 parts by mass of dibutyltin oxide were added, reacted under normal pressure at 230° C. for 8 hours and further reacted under a pressure of 10 mmHg to 15 mmHg for 5 hours. Subsequently, 73 parts by mass of trimellitic anhydride were added to the reaction vessel and reacted at 180° C. under normal pressure for 2 hours to obtain a binder resin (1). The binder resin (1) was found to have a weight average molecular weight of 4,900, and a Tg of 61° C.

Production Example 2

Production of Binder Resin (2)

Into a reaction vessel equipped with a condenser tube, a stirrer and a nitrogen inlet tube, 66 parts by mass of ethylene oxide (2 mol) adduct of bisphenol A, 535 parts by mass of propylene oxide (2 mol) adduct of bisphenol A, 231 parts by mass of terephthalic acid, 41 parts by mass of isophthalic acid and 3 parts by mass of dibutyltin oxide were added, reacted under normal pressure at 210° C. for 10 hours and further reacted under a pressure of 10 mmHg to 15 mmHg for 5 hours. Subsequently, 127 parts by mass of salicylic acid were added to the reaction vessel and reacted at 210° C. under normal pressure for 5 hours to obtain a binder resin (2). The binder resin (2) was found to have a weight average molecular weight of 3,200, and a Tg of 52° C.

Production Example 3

Production of Binder Resin (3)

Into a reaction vessel equipped with a condenser tube, a stirrer and a nitrogen inlet tube, 681 parts by mass of ethylene oxide (2 mol) adduct of bisphenol A, 81 parts by mass of propylene oxide (2 mol) adduct of bisphenol A, 275 parts by mass of terephthalic acid, 7 parts by mass of adipic acid and 2 parts by mass of dibutyltin oxide were added, reacted under normal pressure at 230° C. for 8 hours and further reacted under a pressure of 10 mmHg to 15 mmHg for 5 hours. Subsequently, 22 parts by mass of salicylic acid were added to the reaction vessel and reacted at 180° C. under normal pressure for 2 hours to obtain a binder resin (3). The binder resin (3) was found to have a weight average molecular weight of 8,900, and a Tg of 54° C.

Production Example 4

Production of Binder Resin (4)

Into a reaction vessel equipped with a condenser tube, a stirrer and a nitrogen inlet tube, 359 parts by mass of propylene oxide (2 mol) adduct of bisphenol A, 414 parts by mass of propylene oxide (3 mol) adduct of bisphenol A, 290 parts by mass of terephthalic acid, and 3 parts by mass of dibutyltin oxide were added, reacted under normal pressure at 230° C. for 8 hours and further reacted under a pressure of 10 mmHg to 15 mmHg for 5 hours to obtain a binder resin (4). The binder resin (4) was found to have a weight average molecular weight of 8,300, and a Tg of 69° C.

Production Example 5

Production of Binder Resin (5)

Into a reaction vessel equipped with a condenser tube, a stirrer and a nitrogen inlet tube, 500 parts by mass of propylene oxide (2 mol) adduct of bisphenol A, 126 parts by mass of isophthalic acid, and 3 parts by mass of dibutyltin oxide were added, reacted under normal pressure at 230° C. for 8 hours and further reacted under a pressure of 10 mmHg to 15 mmHg for 5 hours. Next, 111 parts by mass of succinic anhydride were added to the reaction vessel and reacted under normal pressure at 160° C. for 2 hours to obtain a binder resin (5). The binder resin (5) was found to have a weight average molecular weight of 2,900, and a Tg of 45° C.

Production Example 6

Production of Binder Resin (5)

Into a reaction vessel equipped with a condenser tube, a stirrer and a nitrogen inlet tube, 681 parts by mass of ethylene oxide (2 mol) adduct of bisphenol A, 81 parts by mass of propylene oxide (2 mol) adduct of bisphenol A, 262 parts by mass of terephthalic acid, 18 parts by mass of adipic acid, and 2 parts by mass of dibutyltin oxide were added, reacted under normal pressure at 230° C. for 8 hours and further reacted under a pressure of 10 mmHg to 15 mmHg for 5 hours. Next, 22 parts by mass of trimetric anhydride were added to the reaction vessel and reacted under normal pressure at 180° C. for 2 hours to obtain a binder resin (6). The binder resin (6) was found to have a weight average molecular weight of 8,600, and a Tg of 48° C.

Production Example 7

Production of Binder Resin (7)

Into a reaction vessel equipped with a condenser tube, a stirrer and a nitrogen inlet tube, 682 parts by mass of ethylene oxide (2 mol) adduct of bisphenol A, 81 parts by mass of propylene oxide (2 mol) adduct of bisphenol A, 264 parts by mass of terephthalic acid, and 3 parts by mass of dibutyltin oxide were added, reacted under normal pressure at 230° C. for 8 hours and further reacted under a pressure of 10 mmHg to 15 mmHg for 5 hours. Next, 41 parts by mass of trimetric anhydride were added to the reaction vessel and reacted under normal pressure at 180° C. for 3 hours to obtain a binder resin (7). The binder resin (7) was found to have a weight average molecular weight of 11,400, and a Tg of 72° C.

The resulting binder resins (1) to (7) were each measured for their weight average molecular weight (Mw), Tg[° C.] and penetration time [sec/1 μm] according to the above mentioned methods. The results are shown in Table 1.

TABLE 1

| | MW | Tg/° C. | Penetration time sec/1 μm |
|---|---|---|---|
| Binder resin (1) | 4,900 | 61 | 0.60 |
| Binder resin (2) | 3,200 | 52 | 0.48 |
| Binder resin (3) | 8,000 | 54 | 0.88 |
| Binder resin (4) | 8,300 | 69 | 0.97 |
| Binder resin (5) | 2,900 | 45 | 0.39 |
| Binder resin (6) | 8,600 | 48 | 1.26 |
| Binder resin (7) | 11,400 | 72 | 1.96 |

Examples 1 to 7, Comparative Examples 1 to 4

Production of Toner Base Particles 1, 4, 5, and 7 to 12

The following describes a method of producing Toner Base Particles 1, 4, 5, and 7 to 12. Since the method includes a number of steps, the steps are divided into sub-steps. First, a method of producing Toner Base Particle 1 is described.

—Preparation of Colorant Dispersion Liquid—

First, a dispersion liquid of carbon black as a colorant was prepared.

Carbon black (PRINTEX 35, produced by Degussa HULS AG, DBP oil absorption: 42 mL/100 g, pH: 9.5) (17 parts by mass), and a pigment dispersant (3 parts by mass) were primarily dispersed in ethyl acetate (80 parts by mass) by a mixer having stirring blades.

As the pigment dispersant, AJISPER (produced by Ajinomoto Fine-Techno Co., Inc.) was used. The obtained primary dispersion liquid was finely dispersed under strong shearing force using a dyno mill, and a secondary dispersion liquid from which agglomerates having a size of 5 μm or greater were completely removed was prepared.

—Preparation of Composition Liquid of Toner Base Particle 1—

Binder resin 1 (100 parts by mass), the colorant dispersion liquid (30 parts by mass), ethyl acetate (840 parts by mass) were stirred for 10 minutes, using a mixer having stirring blades so as to uniformly dispersed, to thereby obtain [Toner Composition Liquid 1]. The pigment did not aggregate due to dilution of the solvent.

—Production of Toner Base Particle 1—

The obtained [Toner Composition Liquid 1] (500 mL) was fed to a path flow 111 of a liquid droplet discharging unit 210 of the above-mentioned toner production device 210 (FIG. 9).

A thin film 111*a* used has a nozzle (N) having a round-shape and a diameter of 10 μm on a nickel plate having an outer diameter of 20.0 mm, and a thickness of 40 μm, and thin film 111*a* was prepared by electroforming.

Ejection holes were provided only a range of about 2 mm 4) in the center portion of the thin film 111*a* in a houndstooth form so that the distance between each of the ejection holes had a pitch of 100 μm.

A vibration unit (vibration generating unit) 212 is made of lead zirconium titanate having an inner diameter of 4 mm, a diameter of 15 mm and a thickness of 1.5 mm.

After liquid droplets were discharged under the following toner production conditions, the liquid droplets were dry-solidified, thereby producing a toner base particle.

[Conditions for Producing Toner Base 1]
Solid content of toner composition liquid: 10.0%
Dry air flow rate: dry nitrogen in device 30.0 L/min
Inside temperature of device: 27° C. to 28° C.
Frequency of vibration: 45.7 kHz
Peak value of applied voltage sine curve: 40.5 Vp-p Note that the term "frequency of vibration" is an input vibration frequency to a liquid droplet discharging unit 210 by an electric drive unit 112*e* illustrated in FIG. 10. The toner particles dried and solidified in air flow were subjected to antistatic elimination by irradiation with soft X-ray, and then collected by suction with a filter having pores of 1 μm in diameter. The suction-collected toner particles were dried under an atmosphere of 35° C. to thereby obtain Toner Base 1.

—Preparation of Toner Base 4—

[Toner Composition Liquid 4] used for producing Toner Base 4 was obtained in the same manner as in the production method of [Toner Composition Liquid 1] except that the solid content of the toner composition liquid was changed by adjusting the amount of ethyl acetate.

The thus obtained [Toner Composition Liquid 4] was subjected to the same production process of Toner Base 1 except that the production conditions were changed as described below, and Toner Base 4 was obtained.

Toner Base 4 had small diameters and a narrow particle size distribution and the particle diameters can be decreased by reducing the solid content of the composition liquid in the conditions for producing Toner Base 1. Further, generation of fine particles was suppressed by lowering the input voltage, and the amount of dry air was increased to prevent particles from being combined with each other to thereby obtain Toner Base 4.

[Conditions for Producing Toner Base 4]
Solid content of toner composition liquid: 6.0%
Dry air flow rate: dry nitrogen in device 40.0 L/min
Inside temperature of device: 27° C. to 28° C.
Frequency of vibration: 45.7 kHz
Peak value of applied voltage sine curve: 38.5 Vp-p —Preparation of Toner Base 5—

[Toner Composition Liquid 5] used for producing Toner Base 5 was obtained in the same manner as in the production method of [Toner Composition Liquid 1] except that the solid content of the toner composition liquid was changed by adjusting the amount of ethyl acetate.

The thus obtained [Toner Composition Liquid 5] was subjected to the same production process of Toner Base 1 except that the production conditions were changed as described below, and Toner Base 5 was obtained.

Toner Base 5 had large diameters, and the particle diameters can be increased by increasing the solid content of the composition liquid in the conditions for producing Toner Base 1.

[Conditions for Producing Toner Base 5]
Solid content of toner composition liquid: 12.6%
Dry air flow rate: dry nitrogen in device 30.0 L/min
Inside temperature of device: 27° C. to 28° C.
Frequency of vibration: 45.7 kHz
Peak value of applied voltage sine curve: 41.5 Vp-p —Preparation of Toner Base 6—

[Toner Composition Liquid 6] used for producing Toner Base 6 was obtained in the same manner as in the production method of [Toner Composition Liquid 1] except that [Binder Resin 2] was used instead of [Binder Resin 1].

The thus obtained [Toner Composition Liquid 6] was subjected to the same production process of Toner Base 1 except that the production conditions were changed as described below, and Toner Base 6 was obtained.

Toner Base 6 had large diameters, and the particle diameters can be increased by increasing the solid content of the composition liquid in the conditions for producing Toner Base 1.

[Conditions for Producing Toner Base 6]
Solid content of toner composition liquid: 12.5%
Dry air flow rate: dry nitrogen in device 40.0 L/min
Inside temperature of device: 27° C. to 28° C.
Frequency of vibration: 45.7 kHz
Peak value of applied voltage sine curve: 41.5 Vp-p —Preparation of Toner Base 7—

[Toner Composition Liquid 7] used for producing Toner Base 7 was obtained in the same manner as in the production method of [Toner Composition Liquid 1] except that [Binder Resin 3] was used instead of [Binder Resin 1].

The thus obtained [Toner Composition Liquid 7] was subjected to the same production process of Toner Base 1 except that the production conditions were changed as described below, and Toner Base 7 was obtained.

[Conditions for Producing Toner Base 7]
Solid content of toner composition liquid: 8.0%
Dry air flow rate: dry nitrogen in device 30.0 L/min
Inside temperature of device: 27° C. to 28° C.
Frequency of vibration: 45.7 kHz
Peak value of applied voltage sine curve: 40.5 Vp-p —Preparation of Toner Base 8—

[Toner Composition Liquid 8] used for producing Toner Base 8 was obtained in the same manner as in the production method of [Toner Composition Liquid 1] except that the solid content of the composition liquid was changed by using [Binder Resin 3] instead of [Binder Resin 1].

The thus obtained [Toner Composition Liquid 8] was subjected to the same production process of Toner Base 1 except that the production conditions were changed as described below, and Toner Base 8 was obtained.

[Conditions for Producing Toner Base 8]
Solid content of toner composition liquid: 12.5%
Dry air flow rate: dry nitrogen in device 30.0 L/min
Inside temperature of device: 27° C. to 28° C.
Frequency of vibration: 45.7 kHz
Peak value of applied voltage sine curve: 40.8 Vp-p —Preparation of Toner Base 9—

[Toner Composition Liquid 9] used for producing Toner Base 9 was obtained in the same manner as in the production method of [Toner Composition Liquid 1] except that the solid content of the composition liquid was changed by using [Binder Resin 4] instead of [Binder Resin 1].

The thus obtained [Toner Composition Liquid 9] was subjected to the same production process of Toner Base 1 except that the production conditions were changed as described below, and Toner Base 9 was obtained.

[Conditions for Producing Toner Base 9]
Solid content of toner composition liquid: 12.5%
Dry air flow rate: dry nitrogen in device 30.0 L/min
Inside temperature of device: 27° C. to 28° C.
Frequency of vibration: 45.7 kHz
Peak value of applied voltage sine curve: 40.9 Vp-p —Preparation of Toner Base 10—

[Toner Composition Liquid 10] used for producing Toner Base 10 was obtained in the same manner as in the production method of [Toner Composition Liquid 1] except that [Binder Resin 5] was used instead of [Binder Resin 1].

The thus obtained [Toner Composition Liquid 10] was subjected to the same production process of Toner Base 1 except that the production conditions were changed as described below, and Toner Base 10 was obtained.

[Conditions for Producing Toner Base 10]
Solid content of toner composition liquid: 10.0%
Dry air flow rate: dry nitrogen in device 30.0 L/min
Inside temperature of device: 27° C. to 28° C.
Frequency of vibration: 45.7 kHz
Peak value of applied voltage sine curve: 40.9 Vp-p —Preparation of Toner Base 11—

[Toner Composition Liquid 11] used for producing Toner Base 11 was obtained in the same manner as in the production method of [Toner Composition Liquid 1] except that [Binder Resin 6] was used instead of [Binder Resin 1].

The thus obtained [Toner Composition Liquid 11] was subjected to the same production process of Toner Base 1 except that the production conditions were changed as described below, and Toner Base 11 was obtained.

[Conditions for Producing Toner Base 11]
Solid content of toner composition liquid: 10.0%
Dry air flow rate: dry nitrogen in device 30.0 L/min
Inside temperature of device: 27° C. to 28° C.
Frequency of vibration: 45.7 kHz
Peak value of applied voltage sine curve: 41.0 Vp-p —Preparation of Toner Base 12—

[Toner Composition Liquid 12] used for producing Toner Base 12 was obtained in the same manner as in the production method of [Toner Composition Liquid 1] except that [Binder Resin 7] was used instead of [Binder Resin 1].

The thus obtained [Toner Composition Liquid 12] was subjected to the same production process of Toner Base 1 except that the production conditions were changed as described below, and Toner Base 12 was obtained.

[Conditions for Producing Toner Base 12]
Solid content of toner composition liquid: 10.0%
Dry air flow rate: dry nitrogen in device 30.0 L/min
Inside temperature of device: 27° C. to 28° C.
Frequency of vibration: 45.7 kHz
Peak value of applied voltage sine curve: 41.2 Vp-p <Production of Toner Base 3 by Emulsification Aggregation Method>

The following describes a method of producing Toner Base 3.

Since the method includes a number of steps, the steps are divided into sub-steps.

—Preparation of Masterbatch (1)—

Binder Resin (1) (100 parts by mass), carbon black (PRINTEX 35, produced by Degussa HULS AG, DBP oil absorption: 42 mL/100 g, pH: 9.5) (100 parts by mass), and water (50 parts by mass) were mixed by a HENSCHEL MIXER (manufactured by Mitsui Mining Co., Ltd.). The obtained mixture was kneaded by a two-roll at 80° C. for 30 minutes, rolled and cooled, and then pulverized with a pulverizer (manufactured by Hosokawa Micron K.K.), thereby obtaining [Masterbatch (1)].

Similarly to the above-mentioned manner, [Masterbatch (1)] and [Masterbatch (2)] using, respectively, Binder Resins (2) and (3).

—Preparation of Resin Fine Particle-Dispersion Liquid—

Into a reaction vessel equipped with a stirrer and a thermometer, 683 parts by mass of water, 15 parts by mass of sodium salt of methacrylic acid ethylene oxide adduct sulfate ester (ELEMINOL RS-30, produced by Sanyo Chemical Industries, Ltd.), 85 parts by mass of methacrylic acid, 110 parts by mass butyl acrylate, and 3 parts by mass of ammonium persulfate were charged and then stirred at 3,800 rpm for 30 minutes to obtain a white liquid emulsion. Then, the temperature of the system was raised to 75° C. by heating and reacted for 4 hours. Next, 30 parts by mass of a 1% by mass ammonium persulfate aqueous solution was added to the system and aged at 75° C. for 6 hours to thereby synthesize an aqueous dispersion liquid of [Resin Fine Particle-Dispersion Liquid] vinyl-based resin (a copolymer of methacrylic acid-butyl acrylate-sodium salt of methacrylic acid ethylene oxide adduct sulfate ester).

The volume average particle diameter of [Resin Fine Particle-Dispersion Liquid] was measured by a particle size distribution measuring device (LA-920, manufactured by HORIBA Ltd.) and found to be 50 nm. A part of [Resin Fine Particle-Dispersion Liquid] was dried so that the resin parts were isolated therefrom. The resin was found to have a glass transition temperature (Tg) of 53° C. and a weight average molecular weight of 125,000.

—Preparation of Aqueous Phase—

Water (990 parts), [Resin Fine Particle-Dispersion Liquid] (83 parts) and a 48.5% by mass aqueous solution of sodium dodecyldiphenyl ether disulfonate (37 parts) (ELEMINOL MON-7, produced by Sanyo Chemical Industries, Ltd.) and ethyl acetate (90 parts) were mixed and stirred, thereby obtaining [Aqueous Phase].

—Preparation of Oil Phase—

Next, in the vessel, [Masterbatch (1)] (100 parts by mass) and ethyl acetate (100 parts by mass) were charged and mixed for 1 hour to obtain a material solution. The thus obtained material solution (110 parts by mass) and ethyl acetate (100 parts by mass) were mixed, and then transferred to a reaction vessel. Then, the carbon black was dispersed with a bead mill (ULTRA VISCOMILL manufactured by Aimex Co., Ltd.) under the following conditions: liquid feed rate: 1 kg/hr, disc circumferential speed: 6 m/sec, 0.5 mm-zirconia bead filled at 80% by volume, and three passes. Subsequently, a 65% ethyl acetate solution of [Binder Resin (1)] (415 parts by mass) was added to the dispersion liquid, and passed through the bead mill once under the conditions described above, thereby obtaining [Oil Phase (3)].

—Production of Toner Base (3)—

Next, [Oil Phase (3)] (100 parts by mass) was added ton a vessel into which [Aqueous Phase] (170 parts by mass) was poured, mixed at 12,000 rpm for 10 minutes using a TK homomixer to obtain an emulsion slurry. Further, in a container equipped with a stirrer and a thermometer, the emulsion slurry was added and then subjected to desolventation at 30° C. for 10 hours while being stirred at a stirring circumferential speed of 20 m/min. Thereafter, the mixture was washed, filtrated and dried, and finally sieved with a mesh with openings of 75 μm to thereby produce [Toner Base (3)].

<Production of Toner Bases (2) and (6) by Pulverization Method>

The following describes Toner Bases (2) and (6) obtained by a pulverization method. Here, first, the details of Toner Base (2) and production of pigment masterbatch used are described.

—Preparation of Toner Base (2)—

[Binder Resin (1)] (88 parts by mass), and Masterbatch (1) (the same one used in the emulsification aggregation method) (2 parts by mass) were added to a HENSCHEL MIXER (MF 20C/I Model, manufactured by Mitsui Mining Co., Ltd.) and mixed at a circumferential speed of 30 m/sec for 30 seconds, and then the revolution was stopped for 60 seconds. This mixing treatment was repeated 5 times. The mixture was melt-kneaded by a biaxial extruder (manufactured by TOSHIBA MACHINE CO., LTD.) and then cooled on a stainless steal belt with the temperature controlled at 10° C. The kneading conducted so that the temperature of the kneaded product at the exit of the biaxial extruder was approximately 120° C. Next, the kneaded product was further finely pulverized with a jet mill (IDS-2 Model: manufactured by Nihon Pneumatic Industry Co., Ltd.), followed by wind force classification to thereby obtain [Toner Base (2)].

—Preparation of Masterbatch (2)—

Binder Resin (2) (100 parts by mass), carbon black (PRINTEX 35, produced by Degussa HULS AG, DBP oil absorption: 42 mL/100 g, pH: 9.5) (100 parts by mass), and water (50 parts by mass) were mixed by a HENSCHEL MIXER (manufactured by Mitsui Mining Co., Ltd.). The obtained mixture was kneaded by a two-roll at 80° C. for 30 minutes, rolled and cooled, and then pulverized with a pulverizer (manufactured by Hosokawa Micron K.K.). The pulverized product sieved through a mesh with openings of 2 mm in diameter was collected, thereby producing [Masterbatch (2)].

—Production of Toner Base (6)—

Binder Resin (2) and [Masterbatch (2)] were used and treated similarly to the above-mentioned manner, and the conditions for pulverization/classification were controlled, thereby producing [Toner Base (6)].

—Production of Toners (1) to (12)—

Each [Toner Base (1)] to [Toner Base (12)] (100 parts by mass), and a hydrophilic silica (H2000, produced by Clariant Japan K.K.) (1.0 part by mass) as an external additive were used and mixed by a HENSCHEL MIXER (manufactured by Mitsui Mining Co., Ltd.) at a circumferential speed of 30 m/sec for 30 seconds, and then the revolution was stopped for 1 minute. This mixing treatment was repeated 5 times. The mixture was sieved with a mesh with openings of 35 μm to thereby produce [Toner (1)] to [Toner (12)].

<Production of Carrier>

A silicone resin (organo straight silicone) (100 parts by mass), γ-(2-aminoethyl)aminopropyl trimethoxy silane (5 parts by mass), carbon black (10 parts by mass), and toluene (100 parts by mass) were dispersed by a homomixer for 20 minutes to prepare [Resin Layer Coating Liquid]. Subsequently, [Resin Layer Coating Liquid] was applied to the surface of a spherical ferrite having a volume average particle diameter of 35 μm (1,000 parts by mass) using a fluidized-bed coating device, thereby producing [Carrier].

<Preparation of Developer>

Each [Toner (1)] to [Toner (12)] (5 parts by mass) and the thus obtained [Carrier] (95 parts by mass) were mixed, thereby producing developers of Examples 1 to 9 and Comparative Examples 1 to 3.

Next, each of the thus obtained toner and each of the developers were measured for their fixability and heat resistant storage stability to determine overall evaluation. The evaluation results are shown in Table 2, together with the weight average molecular weight and glass transition temperature, Dv, and Dv/Dn thereof.

<<Fixability>>

Each of the developers was placed in an electrophotographic printer (IPSIO COLOR CX8800, manufactured by Ricoh Company Ltd.) from which a fixing device had been removed was applied on a PPC paper, on which a toner unfixed halftone image (set so that the fixed image had an ID of 0.25) had been formed, by a roller of a fixing device illustrated in FIG. 18. The fixing was carried out by the fixing device including a coating device, as an example, provided with a fixing liquid obtained as follows under the condition that the distance between shafts of a pressure roller (sponge) and a coating roller was set to 15 mm (nip time: 100 ms). The paper conveyance speed at this point was 150 mm/s.

<Production of Fixing Liquid>

| Liquid containing a softening agent | |
|---|---|
| Diluted solvent: ion exchanged water | 53 wt % |
| Softening agent: diethoxy ethyl succinate (produced by Higher Alcohol Kogyo Co., Ltd.) | 10 wt % |
| propylene carbonate | 20 wt % |

-continued

| Liquid containing a softening agent | |
|---|---|
| Thickener: propylene glycol | 10 wt % |
| Foam increasing agent: coconut fatty acid diethanol amide (1:1) type (MARPON MM, produced by Matsumoto Yushi Seiyaku Co., Ltd.) | 0.5 wt % |
| Frothing agent: | |
| amine palmitate | 2.5 wt % |
| amine myristate | 1.5 wt % |
| amine stearate | 0.5 wt |
| Dispersant: POE (20) lauryl sorbitan (RHEODOL TW-S120V produced by Kao Corporation) | 1 wt % |
| Polyethylene glycol monostearate (EMANON 3199, produced by Kao Corporation) | 1 wt % |

Note that the dispersant was used for promoting the solubility of the softening agent in the diluted solvent (diluent), and the fatty acid amine was synthesized with a fatty acid and triethanol amine.

With the above composition ratio, first, the components excluding the softening agent were mixed and stirred at a liquid temperature of 120° C. Next, the softening agent was mixed and a ultrasonic wave homogenizer was used to prepare a fixing liquid (stock solution before being foamed) in which the softening agent was dissolved.

Five minutes later and 1 hour later of fixing, the surface of the image was rubbed with a cotton cloth (4): 1 cm) and the smear on the cotton cloth was measured by a reflection densitometer (X-Rite 939), and the fixability was evaluated based on the following criteria.

[Evaluation Criteria]

A: Reflection density was lower than 0.20.

B: Reflection density was 0.20 or higher and less than 0.30.

C: Reflection density was 0.30 or higher and less than 0.40.

D: Reflection density was 0.40 or higher.

<<Heat Resistant Storage Stability (Rate of Penetration)>>

A 50 mL glass container was filled with each of the toners, left standing at thermostatic bath (50° C.) for 24 hours, and then cooled to 24° C. Then, the rate of penetration (mm) of the toner was measured according to the penetration test (JIS K2235-1991), and the heat resistant storage stability was evaluated based on the following criteria. The greater in value of penetration rate means the more excellent in the heat resistant storage stability. The one having a rate of penetration less than 5 mm has a high probability of causing a problem in practical use.

[Evaluation Criteria]

A: Rate of penetration was 25 mm or more.

B: Rate of penetration was 15 mm or more and less than 25 mm.

C: Rate of penetration was 5 mm or more and less than 15 mm.

D: Rate of penetration was less than 5 mm.

<<Overall Evaluation>>

From the above evaluation results, each of the toners was comprehensively examined and evaluated based on the following criteria.

[Evaluation Criteria]

Each of the evaluation items was graded as A: 3 points, B: 2 points, C: 1 point and D: 0 (zero) point, and the respective toners were evaluated based on the following criteria.

A: Extremely excellent (8 to 9 points)

B: Good (5 points or more and less than 8 points (none of zero point)

C: Poor (3 points or more and less than 5 points (none of zero point)

D: Significantly poor (zero point: one or more)

TABLE 2

| | Toner | Resin | Mw of Toner | Tg (° C.) of Toner | Production method | Dv (μm) | Dv/Dn | Fixability 5 sec later | Fixability 1 hr later | Heat resistant storage stability | Overall evaluation |
|---|---|---|---|---|---|---|---|---|---|---|---|
| Ex. 1 | Toner (1) | Binder Resin (1) | 4,900 | 61 | Jet | 5.1 | 1.1 | A | A | A | A |
| Ex. 2 | Toner (2) | Binder Resin (1) | 4,500 | 57 | Pulverization | 6.0 | 1.15 | B | A | A | A |
| Ex. 3 | Toner (3) | Binder Resin (1) | 4,900 | 61 | Emulsification aggregation | 4.2 | 1.13 | A | A | A | A |
| Ex. 4 | Toner (4) | Binder Resin (1) | 4,900 | 61 | Jet | 3.2 | 1.07 | A | A | B | A |
| Ex. 5 | Toner (5) | Binder Resin (1) | 4,900 | 61 | Jet | 5.9 | 1.05 | A | A | A | A |
| Ex. 6 | Toner (6) | Binder Resin (2) | 3,200 | 50 | Pulverization | 5.9 | 1.15 | A | A | C | B |
| Ex. 7 | Toner (7) | Binder Resin (3) | 8,000 | 54 | Jet | 4.0 | 1.10 | B | A | C | B |
| Ex. 8 | Toner (8) | Binder Resin (3) | 8,000 | 54 | Jet | 5.9 | 1.11 | B | B | C | B |
| Ex. 9 | Toner (9) | Binder Resin (4) | 8,300 | 69 | Jet | 5.8 | 1.10 | C | B | A | B |
| Comp. Ex. 1 | Toner (10) | Binder Resin (5) | 2,900 | 45 | Jet | 5.2 | 1.10 | A | A | D | C |
| Comp. Ex. 2 | Toner (11) | Binder Resin (6) | 8,600 | 48 | Jet | 5.1 | 1.12 | D | B | D | C |
| Comp. Ex. 3 | Toner (12) | Binder Resin (7) | 11,400 | 72 | Jet | 5.2 | 1.11 | D | C | A | C |

The evaluation results of Examples 1 to 9 and Comparative Examples 1 to 3 demonstrate that the toners of the present invention have high strength of image immediately after fixing process regardless that the consumption energy was extremely small in the fixing process, and is capable of obtaining an image having high resistance to abrasion (even on halftone images) and is also excellent in heat resistant storage stability.

What is claimed is:

1. A fixing method comprising:

fixing a toner on a recording medium by applying a fixing liquid comprising a softening agent for softening the toner onto a toner image on the recording medium, wherein the toner comprises:

a colorant, and a binder resin, wherein the toner is fixed using the fixing liquid, and wherein a weight average molecular weight of a THF soluble fraction of the toner in a molecular weight distribution measured by gel permeation chromatography (GPC) is 3,000 to 5000; and a glass transition temperature of the toner measured by differential scanning calorimetry (DSC) is 50° C. to 70° C.

2. The fixing method according to claim 1, further comprising:

foaming the fixing liquid to generate a foam-like fixing liquid, adjusting the thickness of the foam-like fixing liquid on a contact surface of a foam-like fixing liquid applying unit to a predetermined value, and applying the foam-like fixing agent formed into the predetermined thickness onto the toner image on the recording medium, wherein the fixing liquid further comprises a diluent containing water and a foaming agent for foaming the fixing liquid.

3. The fixing method according to claim 2, wherein the softening agent is a solid plasticizer which is solid at normal temperature and soluble in the diluent, and makes at least a part of the toner softened and swollen, in a state of being dissolved in the diluent.

4. The fixing method according to claim 3, wherein the solid plasticizer is polyethylene glycol.

5. The fixing method according to claim 3, wherein the solid plasticizer is polyethylene glycol monostearate.

* * * * *